US008988331B2

(12) United States Patent
Yamazaki

(10) Patent No.: US 8,988,331 B2
(45) Date of Patent: Mar. 24, 2015

(54) OPTICAL RECORDING DISPLAY DEVICE, DRIVING METHOD OF THE OPTICAL RECORDING DISPLAY DEVICE, ELECTRO-OPTICAL DEVICE AND ELECTRONIC APPARATUS

(75) Inventor: Katsunori Yamazaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 301 days.

(21) Appl. No.: 12/817,386

(22) Filed: Jun. 17, 2010

(65) Prior Publication Data

US 2010/0328275 A1 Dec. 30, 2010

(30) Foreign Application Priority Data

Jun. 29, 2009 (JP) ..... 2009-153818
Nov. 13, 2009 (JP) ..... 2009-259846

(51) Int. Cl.
*G09G 3/30* (2006.01)
*G09G 3/34* (2006.01)

(52) U.S. Cl.
CPC ..... *G09G 3/344* (2013.01); *G09G 2300/0842* (2013.01); *G09G 2310/0251* (2013.01); *G09G 2360/142* (2013.01)
USPC ..... 345/81; 345/55

(58) Field of Classification Search
USPC ..... 345/103, 107, 173, 204, 94, 81
See application file for complete search history.

(56) References Cited

U.S. PATENT DOCUMENTS

2003/0132896 A1* 7/2003 Matsueda ..... 345/55
2006/0044250 A1* 3/2006 Maki ..... 345/98
2006/0181504 A1* 8/2006 Kawai ..... 345/107
2008/0072163 A1* 3/2008 Teng et al. ..... 715/761
2008/0238871 A1* 10/2008 Tam ..... 345/158
2008/0239174 A1* 10/2008 Ishii et al. ..... 349/12
2008/0259432 A1 10/2008 Kawai
2008/0273022 A1 11/2008 Komatsu

FOREIGN PATENT DOCUMENTS

JP S50-056121 9/1974
JP H2-085825 A 3/1990

(Continued)

OTHER PUBLICATIONS

Xilinx whitepaper, dated Mar. 7, 2008, entitled "Global reset isn't timing-critical" is attached here as filename Xilinx_wp272.pdf.*

(Continued)

*Primary Examiner* — Alexander S Beck
*Assistant Examiner* — Charles Zheng
(74) *Attorney, Agent, or Firm* — ALG Intellectual Property, LLC

(57) ABSTRACT

There is provided an optical recording display device having a display section. The display section includes: a plurality of pixels; a plurality of pixel electrodes each of which is formed for each of the plurality of pixels, and is connected to a transistor; a common electrode which is opposite to the plurality of pixel electrodes, and an electro-optical material layer having a memory property which is disposed between the plurality of pixel electrodes and the common electrode; a plurality of scanning lines which is respectively connected to a gate of the transistor and is connected to each other in a direct manner or through an electric circuit; and a plurality of data lines which is respectively connected to a source of the transistor and is connected to each other in a direct manner or through an electric circuit.

20 Claims, 32 Drawing Sheets

(56) References Cited

FOREIGN PATENT DOCUMENTS

| | | | |
|---|---|---|---|
| JP | 2004-126367 | A | 4/2004 |
| JP | 2004-177590 | A | 6/2004 |
| JP | 2007-171260 | A | 7/2007 |
| JP | 2008-216862 | A | 9/2008 |
| JP | 2008-268342 | A | 11/2008 |
| JP | 2009-098300 | A | 5/2009 |
| WO | WO-2005-071482 | A | 8/2005 |

OTHER PUBLICATIONS

Wiki (wayback machine archive of wiki page on photodiode dated Dec. 18, 2008, avaiable at URL: http://web.archive.org/web/20081218233102/http://en.wikipedia.org/wiki/Photodiode, attached here as wiki.pdf).*

* cited by examiner

OPTICAL RECORDING DISPLAY DEVICE, DRIVING METHOD OF THE OPTICAL RECORDING DISPLAY DEVICE, ELECTRO-OPTICAL DEVICE AND ELECTRONIC APPARATUS

CROSS REFERENCES TO RELATED APPLICATIONS

The present invention contains subject matter related to Japanese Patent Application No. 2009-153818 filed in the Japanese Patent Office on Jun. 29, 2009 and Japanese Patent Application No. 2009-259846 filed in the Japanese Patent Office on Nov. 13, 2009, the entire contents of which are incorporated herein by reference.

BACKGROUND

1. Technical Field

The present invention relates to an optical recording display device, a driving method of the optical recording display device, an electro-optical device and an electronic apparatus.

2. Related Art

In the related art, there is known an optical recording display device which employs a modulation medium having a memory property (cholesteric liquid crystals or electrophoretic dispersion liquids). For example, in JP-A-2007-171260 is disclosed an optical recording display device in which a multilayer electrode structure in which a connection electrode, a driving electrode and a release electrode are stacked is formed through a voltage dividing control layer which is disposed between a variable resistance layer having a resistance value which is varied according to light illumination and a display medium layer which performs image display.

In the optical recording display device as disclosed in JP-A-2007-171260, it is possible to entirely erase (reset) images displayed in a display region without light illumination. However, on the other hand, the configuration becomes complicated in order to form the electrodes of the multilayer structure for every pixel.

SUMMARY

An advantage of some aspects of the invention is that it provides an optical recording display device, a driving method thereof and an electro-optical device which is capable of easily performing a reset operation with a relatively simplified structure.

According to a first aspect of the invention, there is provided an optical recording display device having a display section, the display section including: a pixel electrode which is formed for every pixel, and a transistor which is connected to the pixel electrode; a common electrode which is opposite to the plurality of pixel electrodes, and an electro-optical material layer having a memory property which is disposed between the plurality of pixel electrodes and the common electrode; a plurality of scanning lines which is respectively connected to a gate of the transistor and is connected to each other in a direct manner or through an electric circuit; and a plurality of data lines which is respectively connected to a source of the transistor and is connected to each other in a direct manner or through an electric circuit.

With such a configuration, since the transistor is employed as a pixel switching element, the optical recording display device can be achieved with a simplified structure. As a scanning signal for enabling the transistor to be in a turned on state is input to the scanning lines which are connected to each other, and an image signal for enabling the electro-optical material layer to be in a predetermined display state is input to the data lines which are connected to each other, the entire display section can be easily and rapidly transited to the same display state. Thus, according to this aspect of the invention, it is possible to provide the optical recording display device which can easily perform a reset operation with a relatively simplified structure.

In this respect, the optical recording display device may include the plurality of display sections.

With such a configuration, the optical recording display device can display images with a variety of formats. For example, it is possible to realize an optical recording display device in which a desired image can be displayed using at least one display section and a handwriting input or the like can be performed using at least one display section.

The optical recording display device may include a first region and a second region which are sectioned in a planar surface, and the plurality of pixels which belongs to a first display section of the display section may be arranged in the first region and the plurality of pixels which belongs to a second display section of the display section which is different from the first display section may be arranged in the second region.

With such a configuration, it is possible to use a part of the display sections (first display section) as an image display region and to form a region in which a handwriting input or the like can be performed in another part of the display sections (second display section).

In this respect, the pixels which belong to a first display section among the plurality of display sections and the pixels which belong to a second display section which is different from the first display section may be alternately arranged along an extension direction of the scanning lines or the data lines.

With such a configuration, the optical recording display device has the display section in which the pixels which belong to the first display section and the pixels which belong to the second display section are mixed with each other. Accordingly, for example, it is possible to display a desired image through the pixels which belong to the first display section and to realize an overwriting function by means of a handwriting input or the like through the pixels which belong to the second display section.

The optical recording display device may further include a controller configured to perform a first operation for inputting a first gate electric potential at which the transistor is in a turned on state to the scanning lines and for inputting a first data electric potential to the data lines and a second operation for inputting a second data electric potential to the data lines which belong to the display section. In this respect, the second data electric potential may be lower than an electric potential of the common electrode in a case where the first data electric potential is higher than the electric potential of the common electrode, and may be higher than the electric potential of the common electrode in a case where the first data electric potential is lower than the electric potential of the common electrode.

Specifically, an image displayed on the display section is erased according to the first operation, and the display section is maintained in a recordable state according to the second operation. With such a configuration, it is possible to easily perform the reset operation of the display section according to the first operation. Also, in the second operation, it is possible to maintain the display section in the recordable state only by inputting the second data electric potential having the polarity different from the first operation (in which the positive or negative of the electric potential difference with respect to the common electrode is reversed).

The optical recording display device with such a configuration is specified so that the first gate electric potential is input to the scanning lines to enable the transistor to be in the turned on state and the first data electric potential is input to the data lines in a period of time when the image of the display section is erased, and that the second data electric potential, which is lower than the electric potential of the common electrode in the case where the first data electric potential is higher than the electric potential of the common electrode and is higher than the electric potential of the common electrode in the case where the first data electric potential is lower than the electric potential of the common electrode, is input to the data lines in a period of time when the display section is maintained in the recordable state.

The controller may perform a third operation for inputting a third data electric potential which is approximately the same as the electric potential of the common electrode to the data lines which belong to the display section, after the first operation or the second operation. Specifically, the display section is maintained in a rewriting protection state according to the third operation.

With such a configuration, it is possible to prevent unintended recording due to the incidence of outside light or the like after an image is displayed on the display section in the second operation, and to stably maintain a display state of the image.

The optical recording display device with such a configuration is specified so that the third data electric potential which is approximately the same as the electric potential of the common electrode is input to the data lines in a period of time when the display section is maintained in the rewriting protection state.

According to a second aspect of the invention, there is provided a driving method of an optical recording display device having a display section in which a plurality of pixels is arranged, the display section including: a pixel electrode which is formed for every pixel, and a transistor which is connected to the pixel electrode; a common electrode which is opposite to the plurality of pixel electrodes, and an electro-optical material layer having a memory property which is disposed between the plurality of pixel electrodes and the common electrode; a plurality of scanning lines which is respectively connected to a gate of the transistor and is connected to each other in a direct manner or through an electric circuit; and a plurality of data lines which is respectively connected to a source of the transistor and is connected to each other in a direct manner or through an electric circuit, the method including: image erasing in which a first gate electric potential at which the transistor is in a turned on state is input to the scanning lines which belong to the display section and a first data electric potential is input to the data lines; and image recording in which a second data electric potential which is lower than an electric potential of the common electrode in a case where the first data electric potential is higher than the electric potential of the common electrode, and is higher than the electric potential of the common electrode in a case where the first data electric potential is lower than the electric potential of the common electrode, is input to the data lines which belong to the display section.

With such a driving method, it is possible to easily perform the reset operation of the display section in the step of image erasing. In the step of image recording, the display section can be maintained in the image recordable state with such a simple operation that the second data electric potential, in which the positive or negative of the electric potential difference with respect to the common electrode is reverse compared with the first data electric potential, is input to the data lines.

In this respect, the driving method may further include image maintaining in which a third data electric potential which is approximately the same as the electric potential of the common electrode is input to the data lines which belong to the display section.

With such a driving method, it is possible to prevent unintended recording due to the incidence of outside light or the like after an image is displayed on the display section, and to stably maintain a display state of the image.

In the driving method, the optical recording display device may include a first display section and a second display section as the display section, and the second data electric potential may be input to the data lines which belong to the second display section, and a third data electric potential which is approximately the same as the electric potential of the common electrode may be input to the data lines which belong to the first display section, in the step of image recording.

With such a driving method, in the case where the optical recording display device includes the first display section and the second display section, it is possible to maintain the second display section in the recordable state and to maintain the first display section in the recording restriction state. Accordingly, it is possible to form a region in which a displayed image is retained and a region in which a handwriting input or the like can be performed.

According to a third aspect of the present invention, there is provided an electronic apparatus including the optical recording display device as described above.

With this configuration, the electronic apparatus can be provided with a display means including the optical recording display device which is improved in functionality and manufacturability.

According to a fourth aspect of the present invention, there is provided an electro-optical device including an electro-optical material layer having a memory property between a pair of substrates, wherein a first display section which is capable of rewriting an image display by means of an image signal input and a second display section which is capable of rewriting an image display by means of a light input are formed on the same substrates.

With such a configuration, since the transistor is employed as the pixel switching element, the electro-optical device can be achieved with a simplified structure. In such an electro-optical device, as a scanning signal for enabling the transistor to be in the turned on state to each scanning line, and an image signal for enabling the electro-optical material layer to be in a predetermined display state is input to each data line, the entire first display section can be easily and rapidly transited to the predetermined display state.

In addition, since the first display section which is capable of electronically rewriting the image display by means of the image signal input and the second display section which is capable of rewriting the image display by means of the light input are formed on the same substrates, it is possible to display images with a variety of formats.

For example, it is possible to perform the image display on the second display section by means of the optical recording (by means of the handwriting input), while displaying a predetermined image on the first display section. Accordingly, in such an electro-optical device, the images can be conveniently displayed with a relatively simple configuration, and the handwriting input can be also performed.

In such an electro-optical device, a plurality of first pixels may be arranged in the first display section, in each of the first pixels may be formed a pixel electrode and a transistor having a drain which is connected to the pixel electrode, the plurality of first pixels may be divided into a plurality of first sets, in each first set may be formed a plurality of scanning lines which is respectively connected to a gate of the transistor, is connected to each other, and is connected to a scanning line driving circuit, the plurality of first pixels may be divided into a plurality of second sets, in each second set may be formed a plurality of data lines which is respectively connected to a source of the transistor, is connected to each other, and is connected to a data line driving circuit, a plurality of second pixels may be arranged in the second display section, in each of the second pixels may be formed a pixel electrode and a transistor having a drain which is connected to the pixel electrode, and in each of the second pixels may be further formed scanning lines which are respectively connected to a gate of the transistor and are connected to each other and data lines which are respectively connected to a source of the transistor and are connected to each other.

With such a configuration, since the transistor is employed as the pixel switching element, the electro-optical device can be achieved with a simplified structure. In such an electro-optical device, the transistors which belong to the first display section are individually driven through the scanning line driving circuit and the data line driving circuit, and thus, it is possible to easily and rapidly display a predetermined image on the first display section.

In such an electro-optical device, predetermined electric potentials are input to the scanning lines which are connected to each other and the data lines which are connected to each other, which belong to the second display section, and thus, the entire second display section can be easily and rapidly transited to the same display state, and the handwriting input can be performed.

Accordingly, the electronic image display can be performed in the first display section, and the display by means of the handwriting input can be realized in the second display section.

Further, in such an electro-optical device, a plurality of first pixels may be arranged in the first display section, in each of the first pixels may be formed a pixel electrode and a transistor having a drain which is connected to the pixel electrode, the plurality of first pixels may be divided into a plurality of first sets, in each first set may be formed a plurality of scanning lines which is respectively connected to a gate of the transistor, is connected to each other, and is connected to a scanning line driving circuit, the plurality of first pixels may be divided into a plurality of second sets, in each second set may be formed a plurality of data lines which is respectively connected to a source of the transistor, is connected to each other, and is connected to a data line driving circuit, a plurality of second pixels may be arranged in the second display section, in each of the second pixels may be formed a pixel electrode and a transistor having a drain which is connected to the pixel electrode, the plurality of second pixels may be divided into a plurality of third sets, in each third set may be formed a plurality of scanning lines which is respectively connected to a gate of the transistor, is connected to each other, and is connected to a scanning line driving circuit, the plurality of second pixels may be divided into a plurality of fourth sets, and in each fourth set may be formed a plurality of data lines which is respectively connected to a source of the transistor, is connected to each other, and is connected to a data line driving circuit.

With this configuration, since the transistor is employed as the pixel switching element, the electro-optical device can be achieved with a simplified structure. In such an electro-optical device, an electronic display can be realized in the first display section, and a display by means of the handwriting input or an electronic display can be realized in the second display section.

In the first display section, as predetermined electric potentials are input to the scanning lines and the data lines which belong to the first display section through the scanning line driving circuit and the data line driving circuit which are respectively connected to the scanning lines and the data lines, the transistors which belong to the first display section can be individually driven, thereby making it possible to easily and rapidly display predetermined images on the first display section.

In the second display section, as predetermined electric potentials are input to the scanning lines and the data lines which belong to the second display section through the scanning line driving circuit and the data line driving circuit which are connected to the scanning lines and the data lines, the transistors which belong to the second display section can be individually driven, thereby making it possible to perform the electronic image display in the second display section as in the first display section. Of course, the entire second display section can be transited to the same display state by means of the scanning line driving circuit and the data line driving circuit, and thus, the handwriting input can be performed in the second display section.

In this way, since the plurality of transistors which belongs to the second display section can be individually driven, the electronic image display can be also performed in the second display section in which the handwriting can be performed, as demanded.

In such an electro-optical device, a plurality of first pixels may be arranged in the first display section, in each of the first pixels may be formed a pixel electrode and a transistor having a drain which is connected to the pixel electrode, the plurality of first pixels may be divided into a plurality of first sets, in each first set may be formed a plurality of scanning lines which is respectively connected to a gate of the transistor, is connected to each other, and is connected to a scanning line driving circuit, the plurality of first pixels may be divided into a plurality of second sets, in each second set may be formed a plurality of data lines which is respectively connected to a source of the transistor, is connected to each other, and is connected to a data line driving circuit, a plurality of second pixels may be arranged in the second display section, and in each of the second pixels may be formed a pixel electrode, a diode which is connected to the pixel electrode through a first terminal thereof, and signal lines which are respectively connected to a second terminal of the diode and are connected to each other.

With such a configuration, since the diode is employed as the pixel switching element, the electro-optical device can be achieved with a simplified structure. In such an electro-optical device, since a predetermined electric potential is input to the signal lines which are directly connected to each other, the entire second display section can be easily and rapidly transited to the same display state. Accordingly, the handwriting input can be performed in the second display section.

The electro-optical device may include a first region and a second region which are sectioned in a planar surface, the plurality of first pixels which belongs to the first display section may be arranged in the first region, and the plurality of second pixels which belongs to the second display section may be arranged in the second region.

With this configuration, it is possible to use the first region (first display section) as an image display region and to use the second region (second display section) as a region in which the handwriting input or the like can be performed.

In such an electro-optical device, the first pixels and the second pixels may be alternately arranged along an extension direction of the scanning lines or the data lines.

With this configuration, since the pixels which belong to the first display section and the pixels which belong to the second display section are mixed with each other in the display section, for example, it is possible to display a desired image by means of the pixels which belong to the first display section and to realize an overwriting function through the handwriting input or the like by means of the pixels which belong to the second display section.

According to a fifth aspect of the present invention, there is provided an electronic apparatus including the electro-optical device as described above.

With such a configuration, the electronic apparatus can be provided with a display means including the electro-optical device which is improved in functionality and manufacturability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an optical recording display device according to embodiments of the present invention will be described with reference to the accompanying drawings.

The scope of the present invention is not limited to the embodiments which will be described later, and may be modified variously within the technical scope thereof. In the following figures, for clarity of description, the reduction scale, number, etc. of respective configurations may be different from real configurations.

First Embodiment

Figure 1:
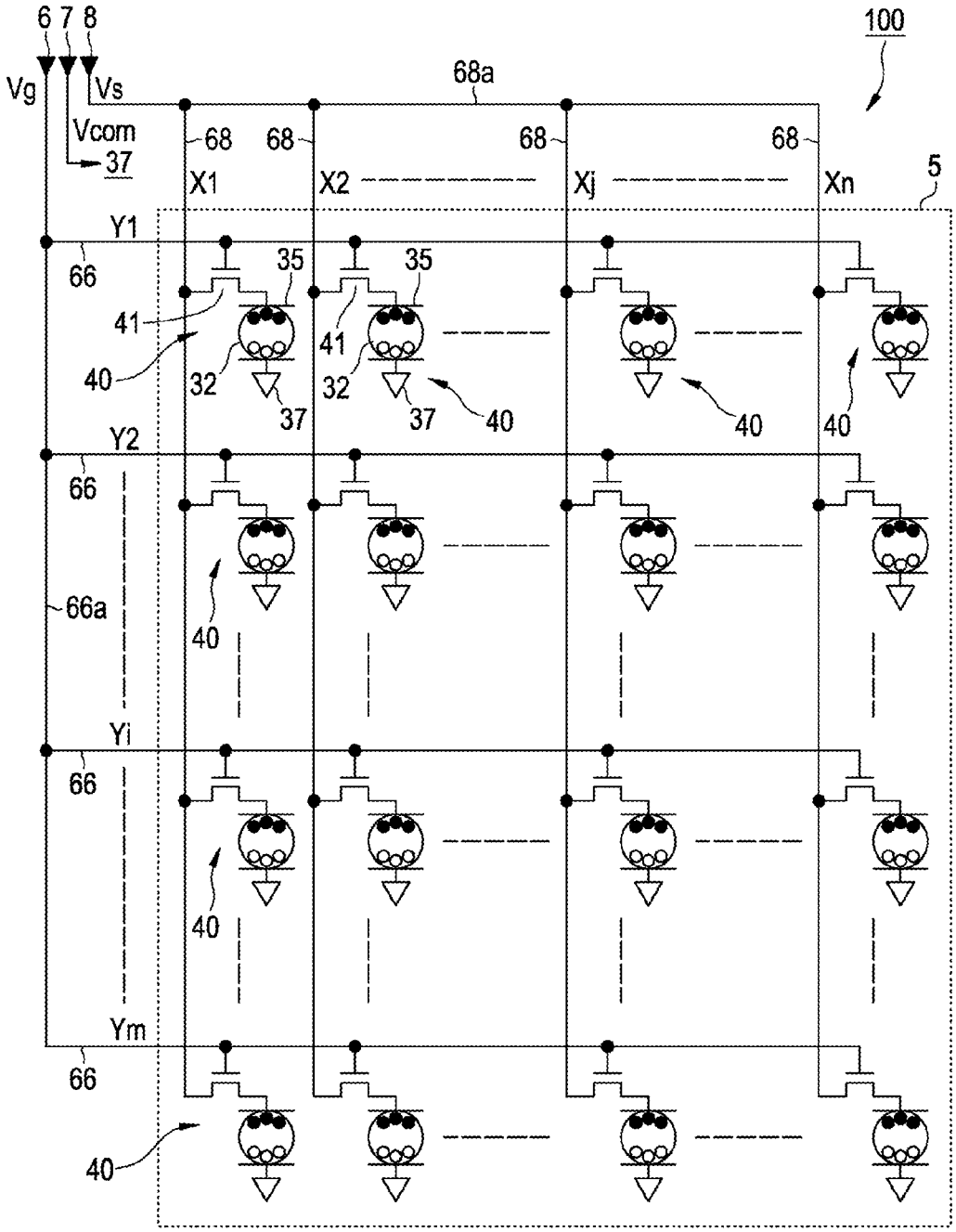
FIG. 1 is a diagram illustrating a circuit configuration of an electrophoretic display device according to a first embodiment of the present invention.

FIG. 1 is a diagram illustrating a circuit configuration of an electrophoretic display device of an optical recording display device according to a first embodiment.

The electrophoretic display device 100 is provided with a display section 5 in which a plurality of pixels 40 is arranged in a matrix shape. In the display section 5, m items of scanning lines 66 (Y1, Y2, . . . , Yi, . . . , Ym) and n items of data lines 68 (X1, X2, . . . , Xj, . . . , Xn) are extended in a direction where they intersect with each other. The pixel 40 is provided to correspond to an intersection of the scanning line 66 and the data line 68.

Around the display section 5 are formed a connection wiring 66*a* which connects end parts of the plurality of scanning lines 66 which extend from the display section 5, a connection wiring 68*a* which connects end parts of the plurality of data lines 68 which extend from the display section 5, and connection terminals 6, 7 and 8.

The connection terminal 6 is connected to all the scanning lines 66 of the display section 5 through the connection wiring 66*a*. The connection terminal 8 is connected to all the scanning lines 68 of the display section 5 through the connection wiring 68*a*. The connection terminal 7 is connected to a common electrode 37 which is formed as a common electrode in the plurality of pixels 40.

A selection transistor 41, a pixel electrode 35, an electrophoretic element 32 (electro-optical material layer), and the common electrode 37 are provided in each pixel 40 of the display section 5.

The selection transistor 41 is a pixel switching element which is formed of, for example, an NMOS (Negative Metal Oxide Semiconductor)-TFT (Thin Film Transistor). A gate of the selection transistor 41 is connected to the scanning line 66, a source thereof is connected to the data line 68, and a drain thereof is connected to the pixel electrode 35.

Figure 2A:
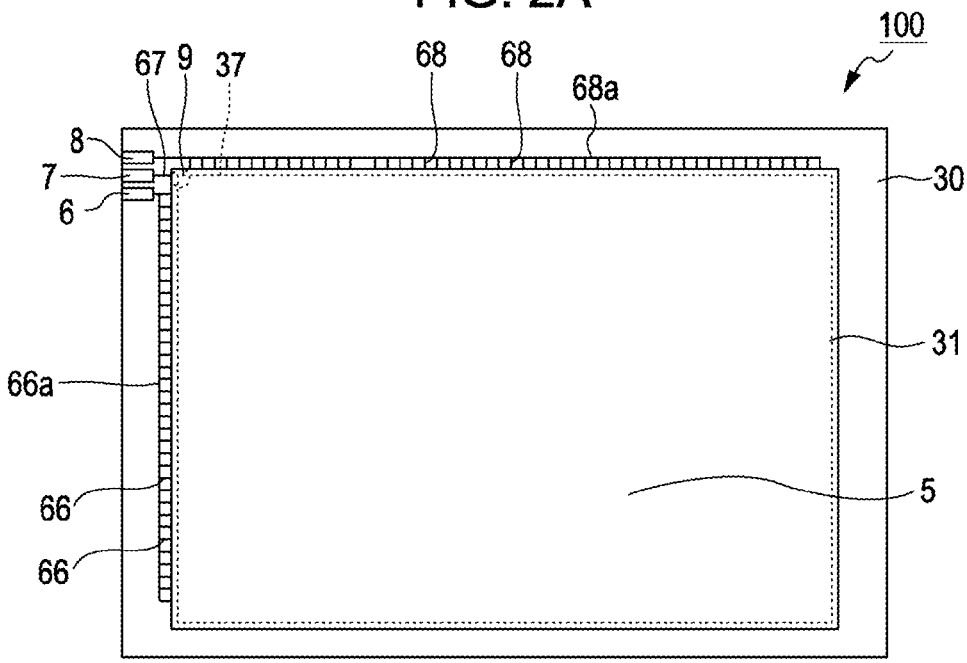
FIG. 2A is a plan view illustrating an electrophoretic display device according to the first embodiment.
Figure 2B:
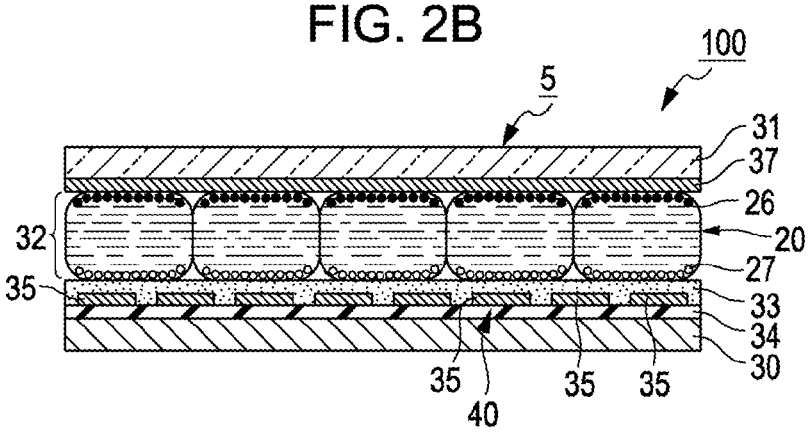
FIG. 2B is a sectional view illustrating an electrophoretic display device according to the first embodiment.

Next, FIG. 2A illustrates a plan view of the electrophoretic display device 100, and FIG. 2B illustrates a partial sectional view of the electrophoretic display device 100 in the display section 5.

As shown in FIG. 2A, the display section 5 is formed in a region in which an element substrate 30 and an opposite substrate 31 are overlapped with each other from a planar view. The connection wiring 66*a* and the connection wiring 68*a* are formed on a region on the element substrate 30 which extends outside the opposite substrate 31. The connection wiring 66*a* is connected to the scanning lines 66 which extend outside from the display section 5. The connection wiring 68*a* is connected to the data line 68 which are extended outside from the display section 5. The connection wirings 66*a* and 68*a* are connected to the connection terminals 6 and 8 which are formed in one corner of the element substrate 30, respectively. The connection terminal 7 which is formed between the connection terminals 6 and 8 is connected to the connection wiring 67 formed on the element substrate 30. The connection wiring 67 is connected to the common electrode 37 through an inter-substrate connection section 9 which electrically connects the element substrate 30 and the opposite substrate 31.

As shown in FIG. 2B, the electrophoretic display device 100 has a configuration in which the electrophoretic element 32 is disposed between the element substrate (first substrate) 30 and the opposite substrate (second substrate) 31. The electrophoretic element 32 has a configuration in which a plurality of microcapsules 20 is arranged therein.

In the display section 5, a circuit layer 34 in which the scanning lines 66, the data lines 68, the selection transistors 41 or the like are formed is provided on the side of the element substrate 30 facing the electrophoretic element 32. The plurality of pixel electrodes 35 is arranged on the circuit layer 34.

The element substrate 30 is a substrate which is formed of glass, plastic or the like. The element substrate 30 may not be necessarily transparent since the element substrate 30 is arranged on a side opposite to an image display surface. The element electrode 35 is an electrode which applies voltage to the electrophoretic element 32. The pixel electrode 35 is formed by sequentially stacking a nickel plate and a gold plate on a Cu (copper) foil, or is formed by Al (aluminum), ITO (indium tin oxide) or the like.

Figure 3A:
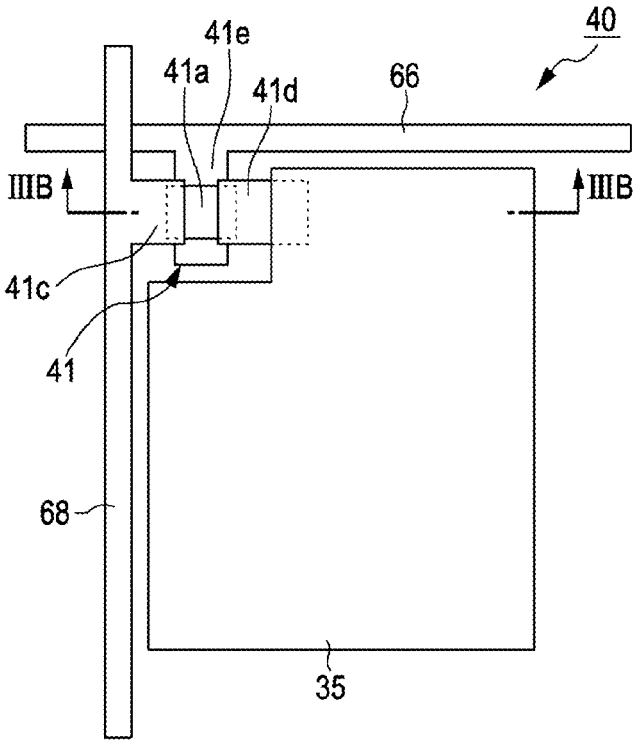
FIG. 3A is a plan view illustrating an element substrate in a single pixel.
Figure 3B:
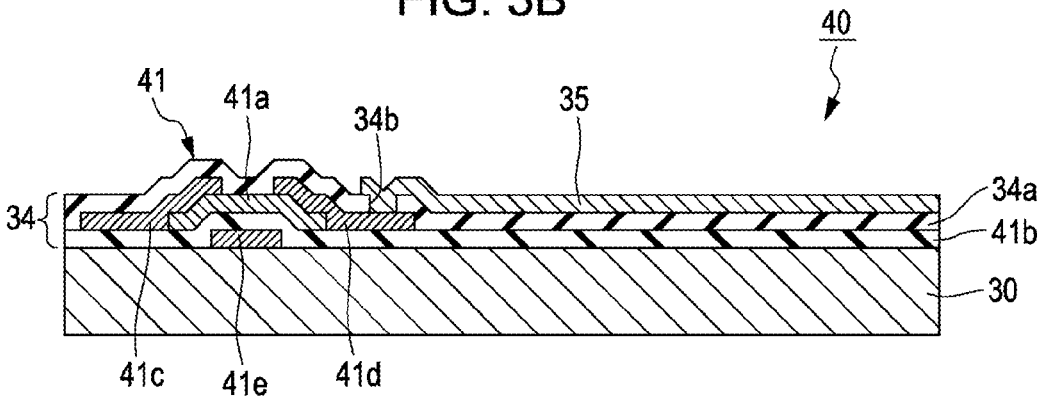
FIG. 3B is a sectional view illustrating an element substrate in a single pixel.

FIG. 3A is a plan view illustrating the element substrate 30 in the single pixel 40; and FIG. 3B is a sectional view in a position taken along line IIIB-IIIB in FIG. 3A.

As shown in FIG. 3A, the selection transistor 41 includes a semiconductor layer 41*a* which is an approximately rectangular shape from a planar view, a source electrode 41*c* which extends from the data line 68, a drain electrode 41*d* which connects the semiconductor layer 41*a* and the pixel electrode 35, and a gate electrode 41*e* which extends from the scanning line 66.

Referring to a sectional configuration in FIG. 3B, the gate electrode 41*e* (scanning line 66) which is formed of Al or Al alloy is formed on the element substrate 30. A gate insulating film 41*b* which is formed of silicon oxide or silicon nitride is formed to cover the gate electrode 41*e*. The semiconductor layer 41*a*, which is formed of amorphous silicon or polysilicon, is formed in a region opposite to the gate electrode 41*e* through the gate insulating film 41*b*. The source electrode 41*c* and the drain electrode 41*d* which are formed of Al or Al alloy are formed to partially run on the semiconductor layer 41*a*. The inter-layer insulating film 34*a* which is formed of silicon oxide or silicon nitride is formed so as to cover the source electrode 41*c* (data line 68), the drain electrode 41*d*, the semiconductor layer 41*a*, and the gate insulating film 41*b*. The pixel electrode 35 is formed on the inter-layer insulating film 34*a*. The pixel electrode 35 and the drain electrode 41*d* are connected with each other through a contact hole 34*b* which is formed through the inter-layer insulating film 34*a* and reaches the drain electrode 41*d*.

Returning to FIG. 2B, the common electrode 37 having a planar shape which is opposite to the plurality of pixel electrodes 35 is formed on the side of the opposite substrate 31 facing the electrophoretic element 32. The electrophoretic element 32 is provided on the common electrode 37.

The opposite substrate 31 is a substrate which is formed of glass, plastic or the like. The opposite substrate 31 is arranged on the side of the image display, and thus is a transparent substrate. The common electrode 37 is an electrode which is configured to apply voltage to the electrophoretic element 32 in corporation with the pixel electrode 35. The common electrode 37 is a transparent electrode which is formed of MgAg (magnesium Ag), ITO (Indium Tin Oxide), IZO (Indium Zinc Oxide) or the like.

The electrophoretic element 32 and the pixel electrode 35 are adhered to each other through an adhesive layer 33, and thus, the element substrate 30 and the opposite substrate 31 are adhered to each other.

The electrophoretic element 32 is formed on the side of the opposite substrate 31 in advance, and is generally treated as an electrophoretic sheet including the adhesive layer 33. In a manufacturing process thereof, the electrophoretic sheet is treated as in a state where a protection release sheet is attached to a surface of the adhesive layer 33. By attaching the corresponding electrophoretic sheet in which the release sheet is detached to the element substrate 30 (in which the pixel electrode 35 or a variety of circuits are formed) which is separately manufactured, the display section 5 is formed. Accordingly, the adhesive layer 33 is present only on the side of the pixel electrode 35.

Figure 2C:
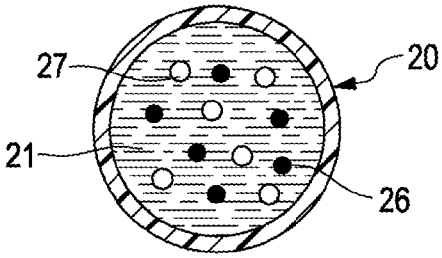
FIG. 2C is a sectional view illustrating a microcapsule which is provided in an electrophoretic display device according to the first embodiment.

FIG. 2C is a sectional view schematically illustrating the microcapsule 20. The microcapsule 20 has a particle diameter of, for example, about 50 μm. The microcapsule 20 is a round body in which a dispersing medium 21, a plurality of white color particles (electrophoretic particles) 27, and a plurality of black color particles (electrophoretic particles) 26 are enclosed therein. The microcapsule 20 is disposed between the common electrode 37 and the pixel electrode 35 as shown in FIG. 2B, and the single or plural microcapsules 20 are arranged inside the single pixel 40. The single microcapsule 20 may be configured to be arranged over the plurality of pixels 40.

An outer part (wall film) of the microcapsule 20 is formed by means of acryl resin such as poly methyl methacrylate, poly ethyl methacrylate or the like, urea resin, polymer resin having a translucency such as Arabia gum, or the like.

The dispersing medium 21 is a liquid which disperses the white color particle 27 and the black color particle 26 in the microcapsule 20. The dispersing medium 21 may include, for example, water, alcohols solvent (methanol, ethanol, isopropanol, butanol, octanol, methyl cellosolve or the like), ester (ethyl acetate, butyl acetate or the like), ketone (acetone, methyl ethyl ketone, methyl isobutyl ketone or the like), aliphatic hydrocarbon (pentane, hexane, octane or the like), alicyclic hydrocarbon (cyclohexane, methyl cyclohexane or the like), aromatic hydrocarbon (benzene, toluene, benzene having a long-chain alkyl group (xylene, hexylbenzene, hebutylbenzene, octylbenzene, nonylbenzene, decylbenzene, undecylbenzene, dodecylbenzene, tridecylbenzene, tetradecylbenzene or the like)), halogenated hydrocarbon (methylene chloride, chloroform, carbon tetrachloride, 1,2-dichloroethane or the like), carboxylate or the like. The dispersing medium 21 may be oil other than the above examples. The materials may be independently used or may be used as a mixture thereof. The dispersing medium 21 may be also blended with a surfactant.

The white color particle 27 is a particle made of a white color pigment (high molecule or colloid) such as titanium dioxide, zinc oxide, antimony trioxide or the like. For example, the white color particle 27 is negatively charged. The black color particle 26 is a particle made of a black color pigment (high molecule or colloid) such as aniline black, carbon black or the like. For example, the black color particle 26 is positively charged.

A charge-controlling agent which is formed of a particle such as electrolyte, surfactant, metallic soap, resin, rubber, oil, varnish, compound or the like; a dispersing agent such as a titanium series coupling agent, an aluminum series coupling agent, a silane series coupling agent; a lubricant agent; a stabilizing agent; or the like can be added to the pigment, as necessary.

Further, instead of the black color particle 26 and the white color particle 27, for example, a pigment such as red color, green color, blue color or the like may be used. According to such a configuration, the red color, green color, blue color or the like can be displayed in the display section 5.

Figure 4A:
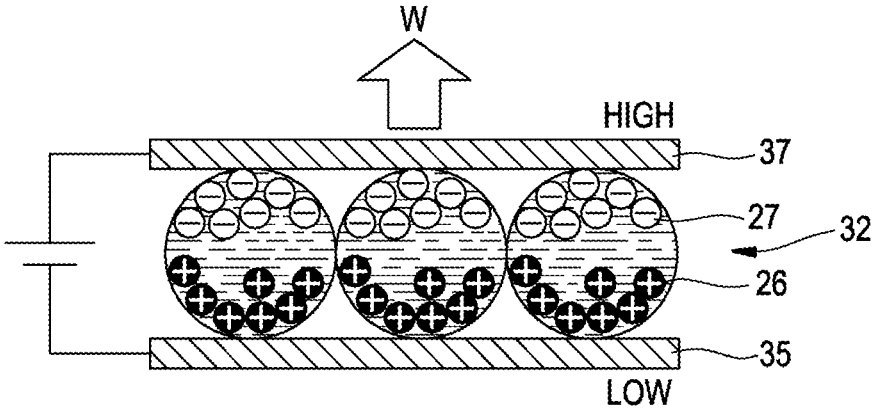
FIG. 4A is a diagram illustrating a white display operation of an electrophoretic display device.
Figure 4B:
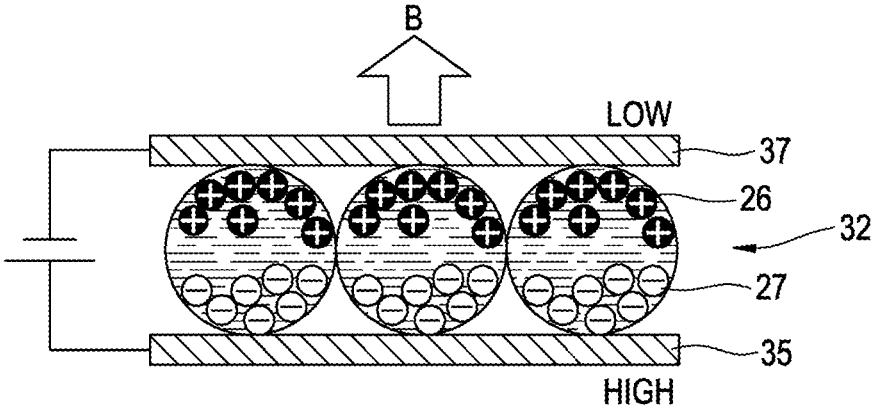
FIG. 4B is a diagram illustrating a black display operation of an electrophoretic display device.

FIG. 4 is a diagram illustrating an operation of the electrophoretic element. FIG. 4A is a diagram illustrating a case where the pixel 40 is white-displayed; and FIG. 4B is a diagram illustrating a case where the pixel 40 is black-displayed.

In the case of the white display as shown in FIG. 4A, the common electrode 37 is maintained at a relatively high electric potential, and the pixel electrode 35 is maintained at a relatively low electric potential. Thus, the white color particle 27 which is negatively charged is gravitated to the common electrode 37. On the other hand, the black color particle 26 which is positively charged is gravitated to the pixel electrode 35. As a result, when the pixel is viewed from the side of the common electrode 37 which is the display surface side, the white color (W) is recognized.

In the case of the black display as shown in FIG. 4B, the common electrode 37 is maintained at a relatively low electric potential, and the pixel electrode 35 is maintained at a relatively high electric potential. Thus, the black color particle 26 which is positively charged is gravitated to the common electrode 37. On the other hand, the white color particle 27 which is negatively charged is gravitated to the pixel electrode 35. As a result, when the pixel is viewed from the side of the common electrode 37, the black color (B) is recognized.

FIGS. 4A and 4B are diagrams illustrating a case where the black particles are positively charged and the white particles are negatively charged, and the black particles may be negatively charged and the white particles may be positively charged as necessary. In this case, if the electric potentials are supplied in a similar way to the above case, a display in which the white display and the black display are reversed is obtained.

Driving Method

Next, a driving method of the electrophoretic display device according to the present embodiment will be described with reference to FIGS. 5 to 9.

Figure 5:
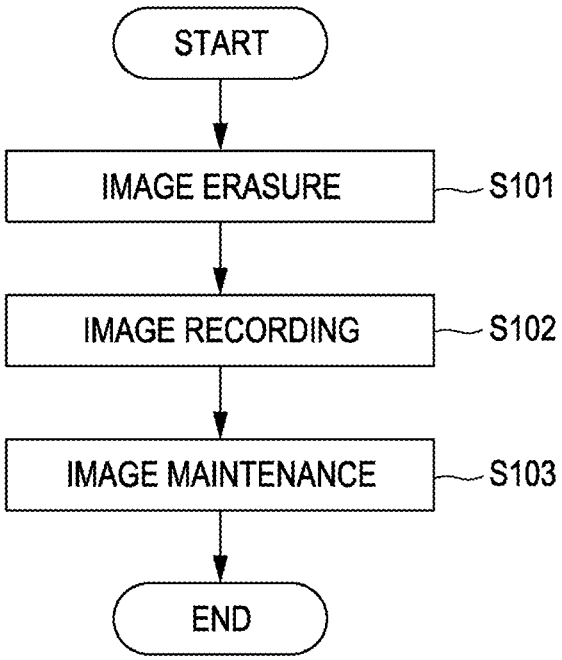
FIG. 5 is a flowchart illustrating a driving method according to the first embodiment.
Figure 6:
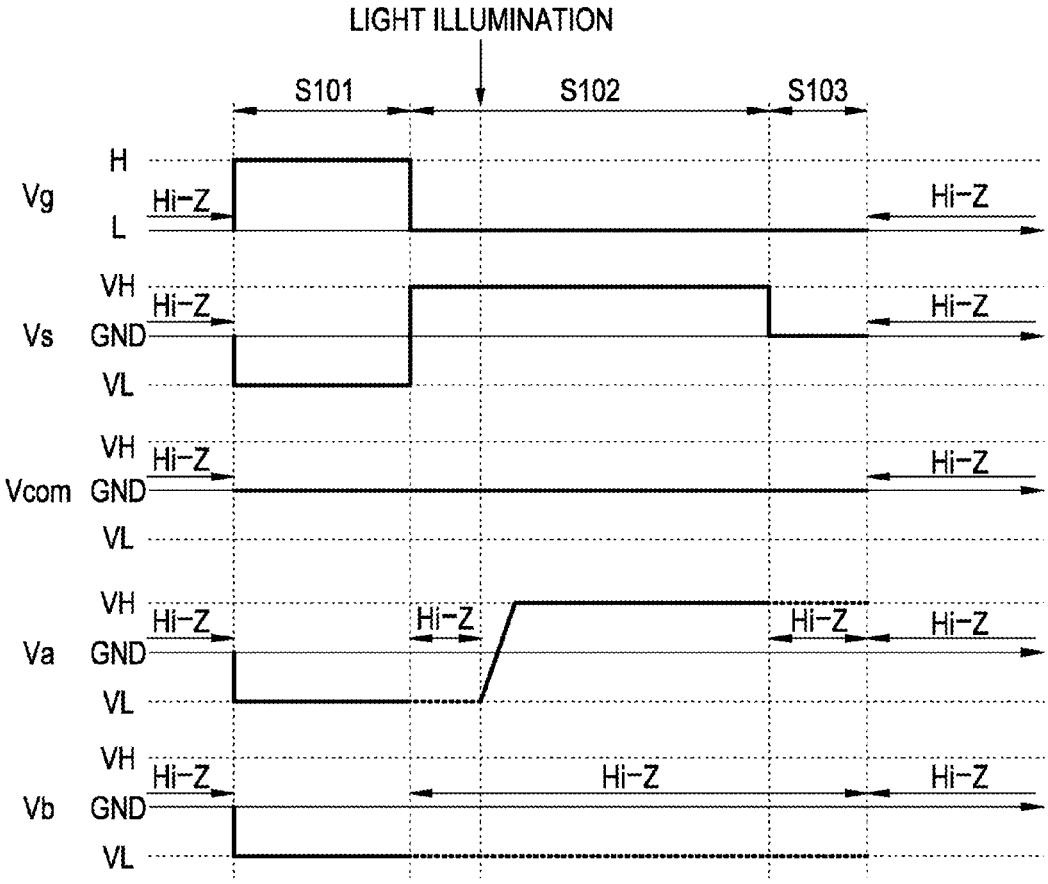
FIG. 6 is a timing chart illustrating a driving method according to the first embodiment.

FIG. 5 is a flowchart illustrating a series of operations at the time when an image is displayed in the electrophoretic display device 100. FIG. 6 is a timing chart corresponding to FIG. 5. FIGS. 7A to 7C and FIGS. 8A and 8B are diagrams illustrating electric potential states of two pixels in each step of the driving method according to the present embodiment. FIG. 9 is a diagram illustrating an image recording device which is used for realizing the driving method according to the present embodiment.

FIG. 5 illustrates a procedure in a case where an image 40A is black-displayed and an image 40B is white-displayed, as shown in FIGS. 7A to 7C, and FIGS. 8A and 8B. FIG. 6B illustrates an electric potential Vg of a scanning line 66 which is input through the connection terminal 6, an electric potential Vs of the data line 68 which is input through the connection terminal 8, an electric potential Vcom of the common electrode 37 which is input through the connection terminal 7, an electric potential Va of the pixel electrode 35A which belongs to the pixel 40A, and an electric potential Vb of the pixel electrode 35B which belongs to the pixel 40B.

In FIGS. 7A to 7C and FIGS. 8A and 8B, subscripts "A" and "B" of reference numerals (40A, 40B and the like) indicating configuration elements in the figure are used to clearly distinguish the two pixels 40A and 40B (pixels 40) which are description targets and components which belong to the two pixels 40A and 40B.

An image recording device 200 as shown in FIG. 9 includes a light source device 210, and a controller 220 (control section), and an image mask 230. A plurality of connection terminals 221 which is respectively connected to the connection terminals 6 to 8 which are installed in the electrophoretic display device 100 is installed in the controller 220. Predetermined electric potentials can be supplied to the connection terminals 6 to 8 through the connection terminals 221. The controller 220 controls driving of the light source device 210, and enables light LT emitted from the light source device 210 to illuminate the image mask 230, and then enables the light LT passed through an opening section 230*a* of the image mask 230 to illuminate the display section 5 of the electrophoretic device 100.

The image mask 230 may be obtained by forming the opening section 230*a* corresponding to an image on a base material of a light blocking property. The image mask 230 may be a device capable of electrically controlling transmission/blocking of light such as a liquid crystal device. A pattern of the light LT which is formed by the image mask 230 may to be reduced or enlarged in order to illuminate the electrophoretic display device 100.

As shown in FIG. 5, the driving method according to the present embodiment includes an image erasure step S101 (first operation), an image recording step S102 (second operation), and an image maintenance step S103.

Figure 7A:
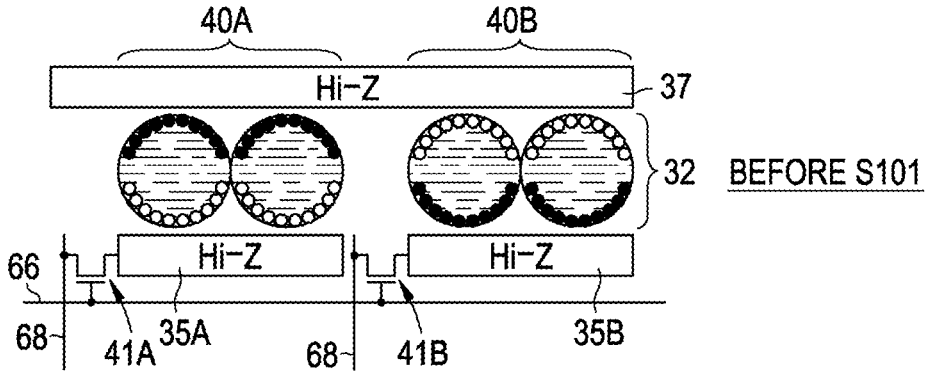
FIG. 7A is a diagram illustrating two pixels which are a description target of a driving method according to the first embodiment.

Firstly, in the display section 5 before the image erasure step S101, as shown in FIG. 7A, the pixel 40A is black-displayed, and the pixel 40B is white-displayed. Further, since a connection terminal of an external apparatus is not connected to the connection terminals 6 to 8, the pixel electrodes 35A, 35B and the common electrode 37 are in a high impedance (Hi-Z) state in which they are all electrically disconnected.

Next, when performing the image erasure step S101 and the image recording step S102, the electrophoretic display device 100 is set to the image recording device 200, as shown in FIG. 9. Specifically, the display section 5 of the electrophoretic display device 100 is arranged opposite to the image mask 230. The connection terminals 221 of the image recording device 200 corresponding to the connection terminals 6 to 8 are connected to the connection terminals 6 to 8 of the element substrate 30, respectively.

If the procedure goes to the image erasure step S101, an electric potential of a high level (for example, 12V) at which the selection transistor 41 is a turned on state is input to the scanning lines 66 (electric potential Vg) from the controller 220 of the image recording device 200 through the connection terminal 6. An electric potential VL of a low level (for example, −10V; a first data electric potential) is input to the data lines 68 (electric potential Vs) through the connection terminal 8. A ground electric potential GND (0V) is input to the common electric potential 37 (electric potential Vcom) through the connection terminal 7.

In the image erasure step S101, the light source device 210 is in a turned off state, and thus, the light LT does not illuminate the electrophoretic display device 100.

Figure 7B:
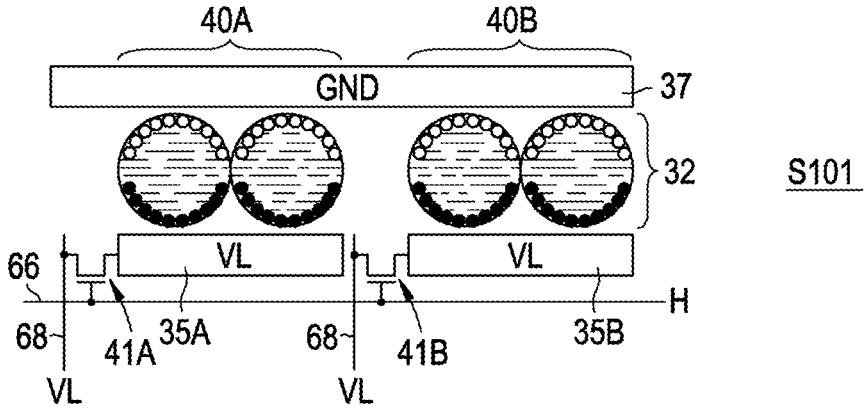
FIG. 7B is a diagram illustrating two pixels which are a description target of a driving method according to the first embodiment.

Then, as shown in FIG. 7B, selection transistors 41A and 41B are in a turned on state, by means of scanning signals of a high level input to the scanning lines 66, and the low level electric potential VL of the data lines 68 is input to the pixel electrodes 35A and 35B. The electrophoretic element 32 is driven by the electric potential difference of the pixel electrodes 35A and 35B which are the low level electric potentials VL and the common electrode 37 which is the ground electric potential GND, and both the pixels 40A and 40B are white-displayed (see FIG. 4A).

In the electrophoretic display device 100 according to the present embodiment, since all the scanning lines 66 of the display section 5 are connected to each other through the connection wiring 66*a* and all the data lines 68 are connected to each other through the connection wiring 68*a*, with such an operation, all the pixels 40 of the display section 5 are white-displayed, and the entire surface of the display section 5 is erased.

In the image erasure step S101, since all the pixels 40 of the display section 5 only have to be transited to a single gray-scale, a specific driving method can be changed in a range in which such an object can be achieved. For example, in the above description, the electric potential Vcom of the common electrode 37 is defined as the ground electric potential GND (0V), but may be defined as the high level electric potential VH (for example, 10V).

Next, if the procedure goes to the image recording step S102, an electric potential of a low level (for example, −12V) is input to the scanning lines 66 (electric potential Vg) from the controller 220 through the connection terminal 6. The high level electric potential VH (for example, 10V; a second data electric potential) is input to the data lines (electric potential Vs) through the connection terminal 8. The ground electric potential GND (0V) is input to the common electric potential 37 (electric potential Vcom) through the connection terminal 7.

Figure 7C:
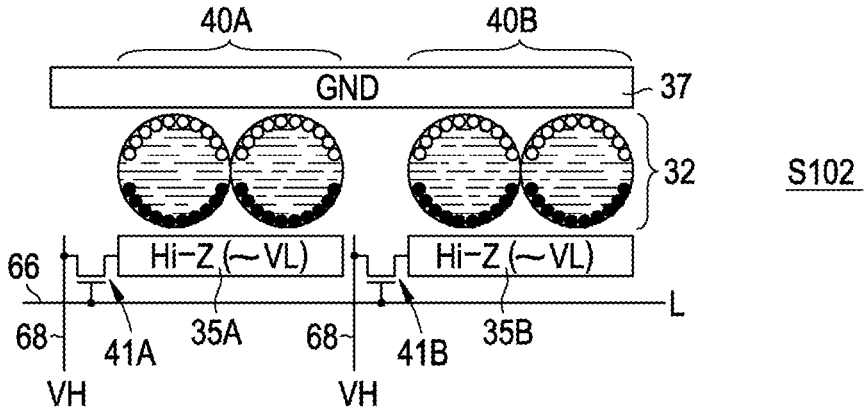
FIG. 7C is a diagram illustrating two pixels which are a description target of a driving method according to the first embodiment.

In the state shown in FIG. 7C, the scanning lines 66 are in the low level, and the selection transistors 41A and 41B are in the turned off state. Since the electric potential relationship between the pixel electrodes 35A and 35B of the high impedance state and the common electrode 37 is the same as in the image erasure step S101, a display state of the display section 5 is not changed.

If the electrophoretic display device 100 is maintained in the above described voltage application state, the light source device 210 is in the turn on state by means of the controller 220, and the light LT emitted from the light source device 210 illuminates the electrophoretic device 100 through the image mask 230. In an example shown in FIG. 8A, the light LT emitted from the image recording device 200 illuminates the pixel 40A, while the light LT does not illuminate the pixel 40B. Then, a leak current is generated only in the selection transistor 41A of the light-illuminated pixel 40A, and current flows from the data lines 68 which are maintained at the high level electric potential VH to the pixel electrode 35A.

Accordingly, an electric potential of the pixel electrode 35A is increased as shown in FIG. 6, an electric potential difference is generated with respect to the common electrode 37 which is maintained at the ground electric potential GND. The electrophoretic element 32 is driven by such an electric potential difference, and the pixel 40A is black-displayed (see FIG. 4B).

In this way, among the pixels 40 of the display section 5, only the pixel 40 which is illuminated by the light LT is selectively transited to the black display, and a predetermined image is recorded in the display section 5.

In the present embodiment, the electric potential Vcom of the common electrode 37 in the image recording step S102 is maintained at the ground electric potential GND, but may be maintained at the low level electric potential VL (for example, −10V). In this case, if an electric potential Va of the pixel electrode 35A which belongs to the pixel 40A which is illuminated by the light becomes a higher electric potential than the electric potential Vcom of the common electrode 37, the pixel 40A is changed into the black display.

With respect to the electric potential Vcom of the common electrode 37, the second data electric potential is selected to have a reverse polarity with respect to the first data electric potential. Alternatively, the second data electric potential is set to a lower electric potential than the electric potential Vcom in a case where the first data electric potential is higher than the electric potential Vcom of the common electrode 37, and the second data electric potential is set to a higher electric potential than the electric potential Vcom in a case where the first data electric potential is lower than the electric potential Vcom.

Figure 8A:
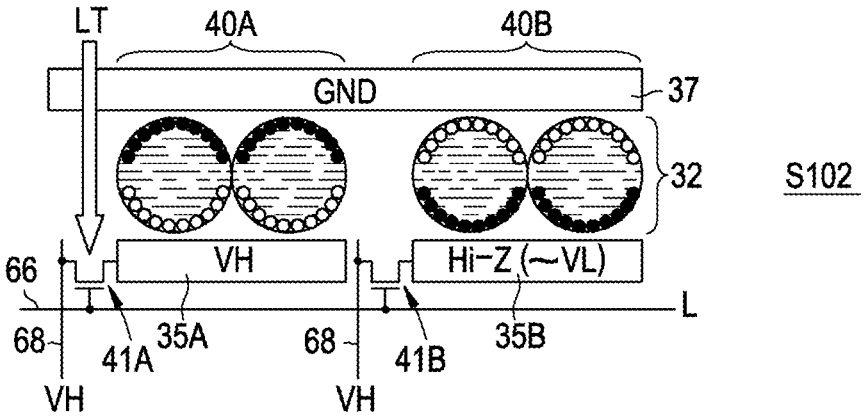
FIG. 8A is a diagram illustrating two pixels which are a description target of a driving method according to the first embodiment.
Figure 8B:
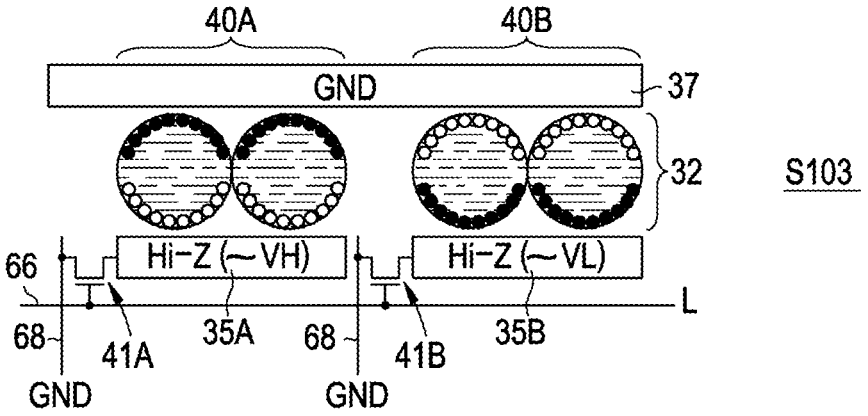
FIG. 8B is a diagram illustrating two pixels which are a description target of a driving method according to the first embodiment.
Figure 9:
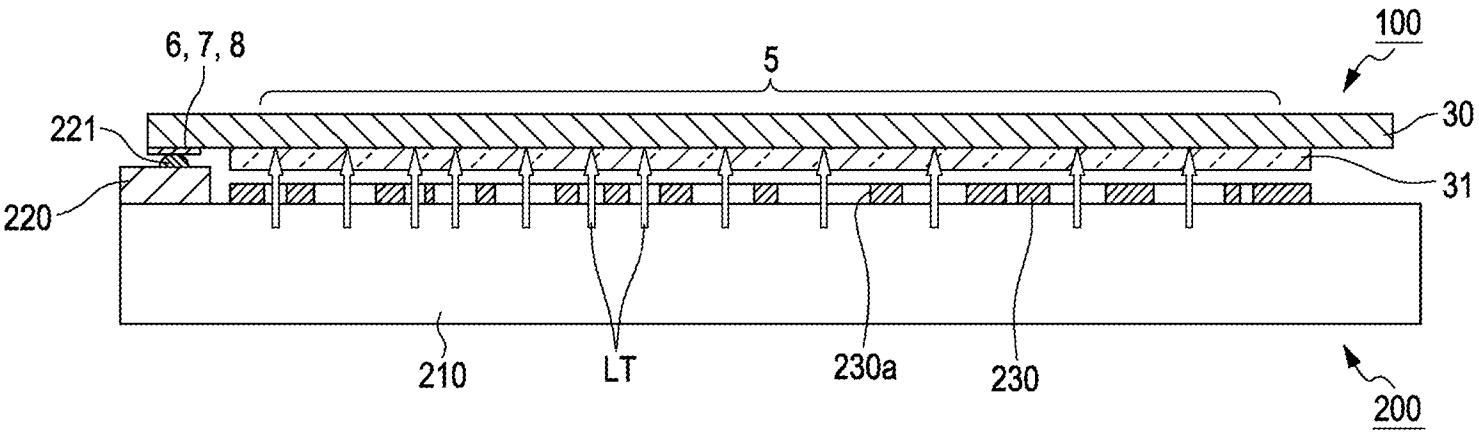
FIG. 9 is a diagram illustrating an image recording device in a driving method according to the first embodiment.

Next, if the procedure goes to the image maintenance step S103, as shown in FIGS. 8B and 6, the ground electric potential GND is input to the data lines 68 (electric potential Vs) and the common electrode 37 (electric potential Vcom) from the controller 220 through the connection terminals 8 and 7.

As the data line 68 and the common electrode 37 have the same electric potential as described above, a false recording can be prevented from being generated when the light illuminates the pixels 40 of the display section 5. That is, in the image maintenance step S103, even though the light leak is generated in the selection transistor 41 as the pixel 40 is illuminated by the light, since the electric potential of the pixel electrode 35 which belongs to the pixel 40 which is illuminated by the light becomes the ground electric potential GND, the electric potential difference with respect to the common electrode 37 which is maintained at the ground electric potential GND is not generated in a similar way, and thus, the display state of the electrophoretic element 32 is not changed.

After the image maintenance step S103, the electrophoretic display device 100 is separated from the image recording device 200, and the connection terminals 6 to 8 are disconnected from the connection terminal 221. Accordingly, the scanning lines 66, the data lines 68 and the common electrode 37 are in the high impedance state, and the image displayed in the display section 5 is maintained.

In the image maintenance step S103, the data lines 68 and the common electrode 37 may not necessarily be at the same electric potential. Specifically, the electric potential Vs of the data lines 68 and the electric potential Vcom of the common electrode 37 may be set so that the electric potential difference between the electric potential Vs of the data lines 68 and the electric potential Vcom of the common electrode 37 becomes equal to or smaller than a threshold voltage of the electrophoretic element 32. There may be a case where a distinct threshold voltage is not present in the electrophoretic element 32, and in this case, the threshold voltage may be set to a voltage which does not substantially affect the optical characteristic. In such a range, even though the light illuminates the pixel 40 so that the electric potential Vs of the data lines 68 is input to the pixel electrode 35, the electric potential difference between the pixel electrode 35 and the common electrode 37 becomes equal to or smaller than the threshold voltage of the electrophoretic element 32, and the display state of the pixels 40 is not changed.

As described above, in the electrophoretic display device 100 according to the present embodiment, since the same electrode structure as in an active matrix liquid crystal device is used, the structure can be simplified, manufacturability thereof can be enhanced, and a low cost can be achieved. Further, by inputting only the predetermined electric potential through the connection wirings 66*a* and 68*a*, the entire display section 5 can be transited to the single grayscale, and thus, the reset operation can be easily and rapidly performed.

First Modified Example

In the electrophoretic display device 100 according to the first embodiment, the image recording is performed by using the image recording device 200 having the image mask 230, but a handwriting input can be performed by using a light pen with respect to the electrophoretic display device 100.

Figure 10A:
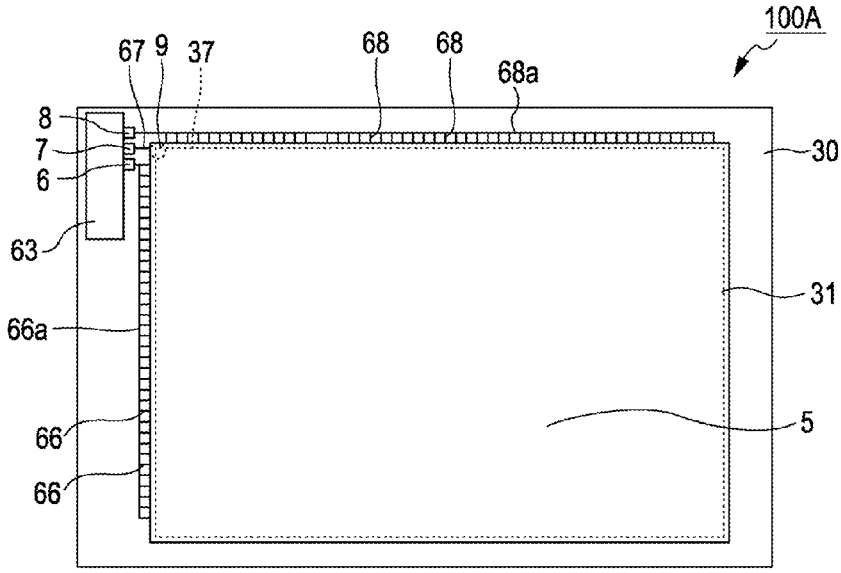
FIG. 10A is a plan view illustrating an electrophoretic display device according to a first modified example.
Figure 10B:
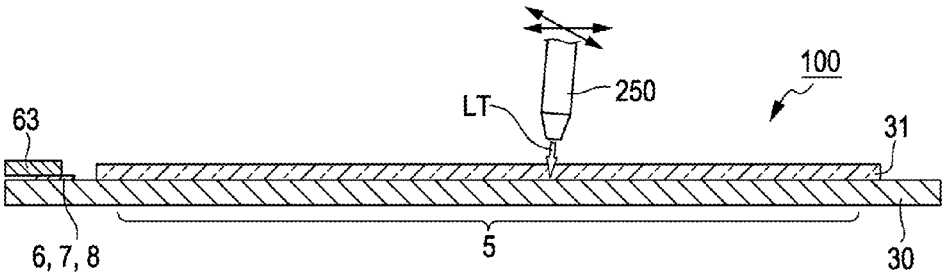
FIG. 10B is a diagram illustrating a manipulation of an electrophoretic display device according to the first example.

FIG. 10A is a plan view illustrating the electrophoretic display device 100A having a configuration suitable for the handwriting input. FIG. 10B is a diagram schematically illustrating a handwriting input manipulation.

The electrophoretic display device 100A shown in FIG. 10A is the same as the electrophoretic display device 100 according to the first embodiment in a basic configuration thereof, is different therefrom in that a controller 63 (control section) is mounted on the element substrate 30. The controller 63 is connected to the connection terminals 6 to 8 on the element substrate 30.

In the electrophoretic display device 100A, the controller 63 performs the respective steps of the image erasure step S101, the image recording step S102 and the image maintenance step S103 shown in FIG. 5. That is, in the respective steps S101 to S103, the controller 63 inputs predetermined electric potentials in the scanning lines 66 (connection wiring 66*a*), the common electrode 37 and the data lines 68 (connection wiring 68*a*) through the connection terminals 6 to 8, and controls the display section 5.

More specifically, the controller 63 starts an image display operation in the display section 5 by means of a signal input from a higher device (not shown). If the image display operation starts, the image erasure step S101 is firstly performed, the entire surface of the display section 5 is white-displayed, and then the image which has been previously displayed is erased.

Thereafter, if the procedure goes to the image recording step S102, the controller 63 inputs the high level electric potential VH to the data lines 68, inputs the ground electric potential GND to the common electrode 37, and then allows the display section 5 to go to a state where the recording is performable by the light pen 250. If the display section 5 maintained in the recordable state is scanned by the light pen 250 which emits the light LT from a front end thereof, only the pixel 40 which is illuminated by the light is selectively transited into the black display, and the image corresponding to the trace of the light pen 250 is displayed in the display section 5.

Then, after a predetermined time elapses from the starting of the image recording step S102, or by the signal input from the higher device, the procedure goes to the image maintenance step S103. In the image maintenance step S103, the controller 63 maintains the data lines 68 and the common electrode 37 at approximately the same electric potential. Accordingly, unintended recording can be prevented from being generated due to the incidence of outside light with respect to the display section 5 or a false input of the light pen 250.

In the above described first modified example, in a similar way to the first embodiment, in the image erasure step S101, the electric potential input to the common electrode 37 may be set at the high level electric potential VH. In the image recording step S102, the low level electric potential VL may be input to the common electrode 37. In the image maintenance step S103, the electric potential difference between the data lines 68 and the common electrode 37 may be set at a different electric potential in a range where the electric potential difference thereof becomes equal to or smaller than the threshold voltage of the electrophoretic element 32.

In the electrophoretic display device 100A, a mechanism which is configured to determine whether the light pen 250 comes in contact with or close to the electrophoretic display device 100A may be provided. For example, a touch panel may be disposed in an outer surface side of the opposite substrate 31. A piezoelectric sensor, an optical sensor or the like may be disposed in the opposite substrate 31 or the element substrate 30.

With such a mechanism, the electrophoretic display device 100A may be configured so that the ground electric potential GND (0V) is input to the data lines 68 when the light pen 250 does not come in contact with or is not close to the electrophoretic display device 100A, and the high level electric potential VH is input to the data lines 68 only when the light pen 250 comes in contact with or is close to the electrophoretic display device 100A. With such a driving method, the recording can be performed by the light pen 250 as necessary, and also a false operation (unintended recording) due to the incidence of the outside light or the like can be prevented.

The electrophoretic display device 100A has a configuration suitable for the recording input by means of the light pen 250, but the image recording by means of the image recording device 200 shown in FIG. 9 may be available. In this case, the electrophoretic display device 100A in which the display section 5 is in the image recordable state by the controller 63 is set to the image recording device 200, and enables the light LT to illuminate the display section 5 through the image mask 230. Through this operation, the image corresponding to the image mask 230 can be recorded in the electrophoretic display device 100A.

Further, the electrophoretic display device 100A is exemplified as a configuration suitable for the handwriting input by the light pen 250, but the handwriting input using the light pen in the electrophoretic display device 100 according to the above described first embodiment can be performed. In this case, an external controller is connected with the connection terminals 6 to 8 of the electrophoretic display device 100, and predetermined electric potentials in the image recording step S102 are input from the external controller.

Second Modified Example

In the first embodiment, in the image erasure step S101, the entire surface of the display section 5 is white-displayed so as to erase the image, and in the image recording step S102, a part of the pixels 40 of the display section 5 is black-displayed to display the image, but the white color image component may be displayed in a black background. The driving method in this case will be described hereinafter.

Firstly, in the image erasure step S101, an electric potential of a high level (for example, 12V) at which the selection transistor 41 is in the turned on state is input to the scanning lines 66 (electric potential Vg) from the controller 220 of the image recording device 200 through the connection terminal 6. The high level electric potential VH (for example, 10V) is input to the data lines (electric potential Vs) through the connection terminal 8. The ground electric potential GND (0V) is input to the common electrode 37 (electric potential Vcom) through the connection terminal 7.

Accordingly, the pixel electrode 35 becomes a relatively high electric potential, the common electrode 37 becomes a relatively low electric potential, and the entire display section 5 is black-displayed (see FIG. 4B). In the image erasure step S101, the low level electric potential VL (for example, −10V) may be input to the common electrode 37.

Next, in the image recording step S102, an electric potential of a low level (for example, −12V) is input to the scanning lines 66 (electric potential Vg) from the controller 220 through the connection terminal 6. The low level electric potential VL (for example, −10V) is input to the data lines 68 (electric potential Vs) through the connection terminal 8. The ground electric potential GND (0V) is input to the common electrode 37 (electric potential Vcom) through the connection terminal 7.

If the light LT illuminates the pixels 40 maintained in the above described electric potential state, a leak current is generated in the selection transistor 41 illuminated by the light, and the electric potential of the pixel electrode 35 is decreased. Thus, if the pixel electrode 35 becomes a relatively low electric potential and the common electrode 37 becomes a relatively high electric potential, the pixels 40 are changed into the white display. As a result, the display section 5 becomes in a state where the white image component (region illuminated by the light) in the black background is displayed.

In the image recording step S102, the high level electric potential VH may be input to the common electrode 37.

Second Embodiment

Next, a second embodiment according to the present invention will be described with reference to FIGS. 11 to 13.

Figure 11:
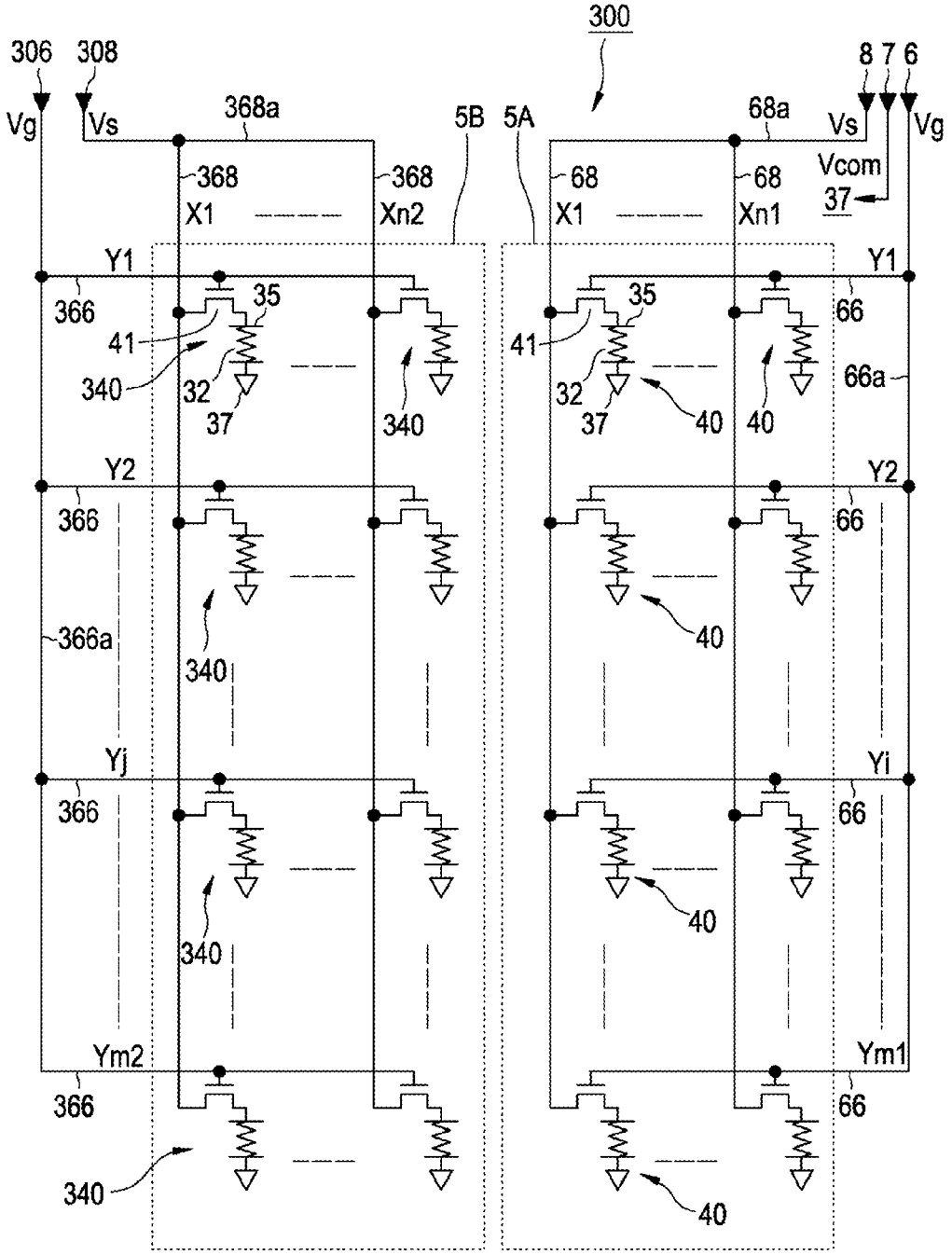
FIG. 11 is a diagram illustrating a circuit configuration of an electrophoretic display apparatus according to a second embodiment of the present invention.
Figure 12A:
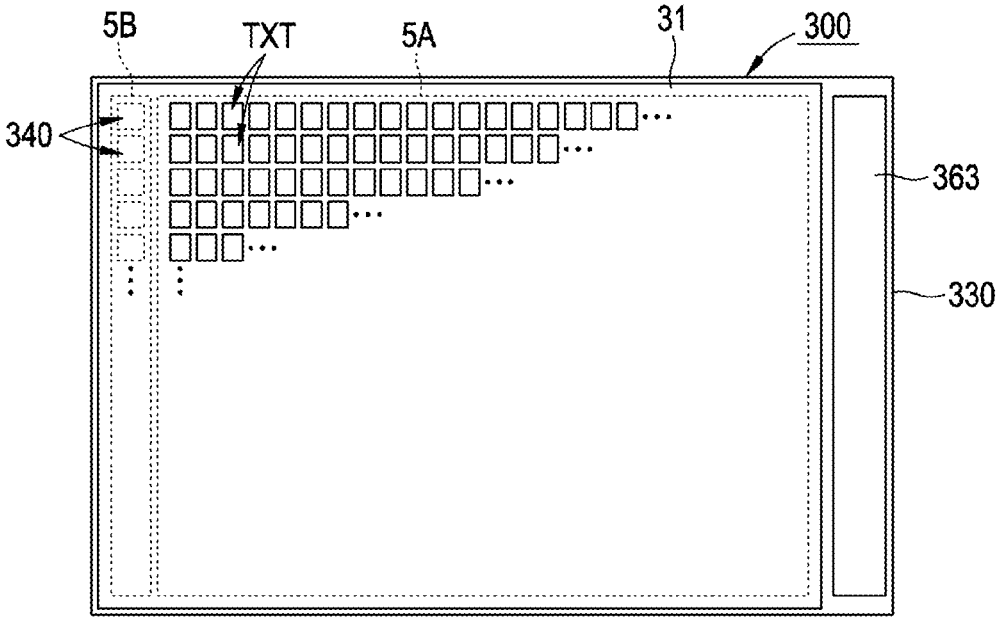
FIG. 12A is a plan view illustrating an electrophoretic display device according to the second embodiment.
Figure 12B:
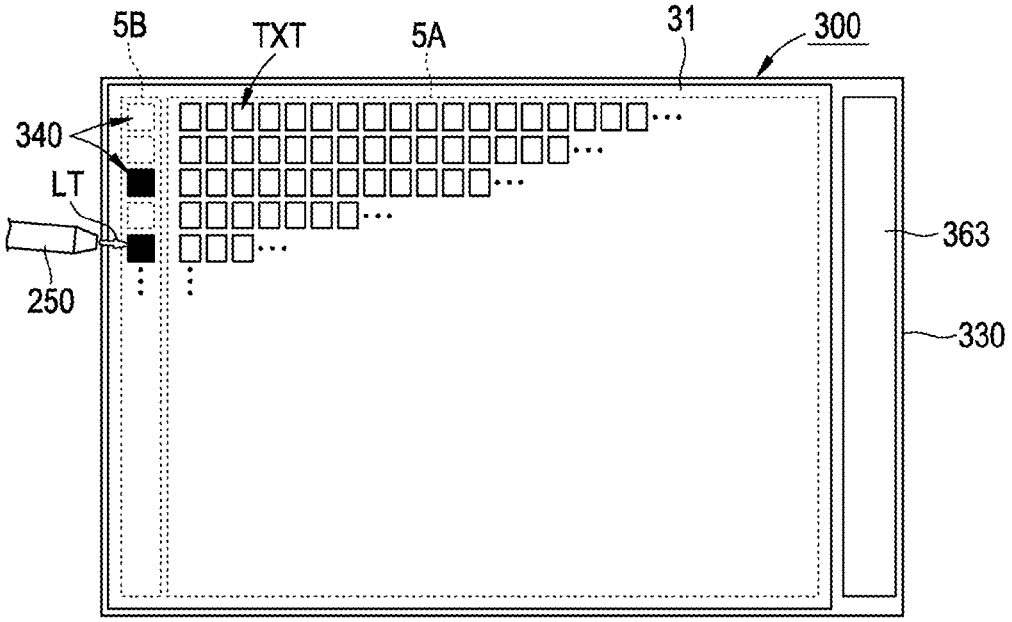
FIG. 12B is a diagram illustrating an operation of an electrophoretic display device according to the second embodiment.

FIG. 11 is a circuit configuration diagram illustrating an electrophoretic display device according to the second embodiment, and FIGS. 12A and 12B are diagrams illustrating an operation of the electrophoretic display device according to the second embodiment.

In the following figures, the same reference numerals are used for the same elements as in the first embodiment and the modified examples thereof, and detailed description thereof will be omitted.

As shown in FIG. 11, an electrophoretic display device 300 according to the present embodiment includes a first display section 5A and a second display section 5B.

In the first display section 5A, m1 items of scanning lines 66 and n1 items of data lines 68 are formed. A pixel 40 is formed to correspond to an intersection of the scanning line 66 and the data line 68. Accordingly, the pixels 40 are arranged in a matrix shape of m1 row×n1 column. The entire scanning lines 66 formed in the first display section 5A are connected with the connection terminal 6 through the connection wiring 66*a*. The entire data lines 68 formed in the first display section 5A are connected with the connection terminal 8 through the connection wiring 68*a*. A connection terminal 7, which is disposed adjacent to the connection terminals 6 and 8, is connected to the common electrode 37.

In the second display section 5B, m2 items of scanning lines 366 and n2 items of data lines 368 are formed. A pixel 340 is formed to correspond to an intersection of the scanning line 366 and the data line 368. Accordingly, the pixels 340 are arranged in a matrix shape of m2 row×n2 column. The entire scanning lines 366 formed in the second display section 5B are connected with the connection terminal 306 through the connection wiring 366*a*. The entire data lines 368 formed in the second display section 5B are connected with the connection terminal 308 through the connection wiring 368*a*. The pixel 340 has the same configuration as in the pixel 40 of the first display section 5A, and includes the selection transistor 41, the pixel electrode 35, the electrophoretic element 32 and the common electrode 37.

In the electrophoretic display device 300 according to the second embodiment, the number m1 of the scanning lines 66 and the number n1 of the data lines 68, and the number m2 of scanning lines 366 and the number n2 of the data lines 368 can be set as an arbitrary natural number. That is, the first display section 5A and the second display section 5B may be formed by an arbitrary number of pixels 40 and 340, respectively.

The accuracies of the pixels 40 and 340 may be different from each other in the first display section 5A and the second display section 5B. For example, the first display section 5A may be set to an accuracy (for example, about 300 to 600 ppi) suitable for display of letters or images, and the second display section 5B may be set to an accuracy (for example, about 50 to 100 ppi) suitable for the handwriting input.

External shapes of the first display section 5A and the second display section 5B are not limited to a rectangular shape, but may have an arbitrary planar shape such as a triangular shape, a polygonal shape higher than a pentagon, or a circular or elliptical shape.

FIG. 12A is a plan view schematically illustrating a configuration of the electrophoretic display device 300. FIG. 12B is diagram illustrating an operation of the electrophoretic display device 300.

The electrophoretic display device 300 includes an element substrate 330 and an opposite substrate 31. In a region in which the element substrate 330 and the opposite substrate 31 are overlapped with each other from a planar view, the first display section 5A and the second display section 5B are formed. In a region of the element substrate 330 which is extended outside the opposite substrate 31, a controller 363 (control section) is mounted. The controller 363 is connected with the connection terminal 6 to 8 and the connection terminals 306 and 308 shown in FIG. 11, through a wiring (not shown).

The element substrate 330 has the same configuration as that of the element substrate 30, except that the element substrate 330 includes the first display section 5A and the second display section 5B corresponding to the display section 5 of the element substrate 30 according to the first embodiment. The controller 363 is configured so as to supply predetermined electric potentials to the connection terminals 6 to 8 and the connection terminals 306 and 308.

Driving Method

Hereinafter, a driving method of the electrophoretic display device 300 according to the second embodiment will be described.

Figure 13:
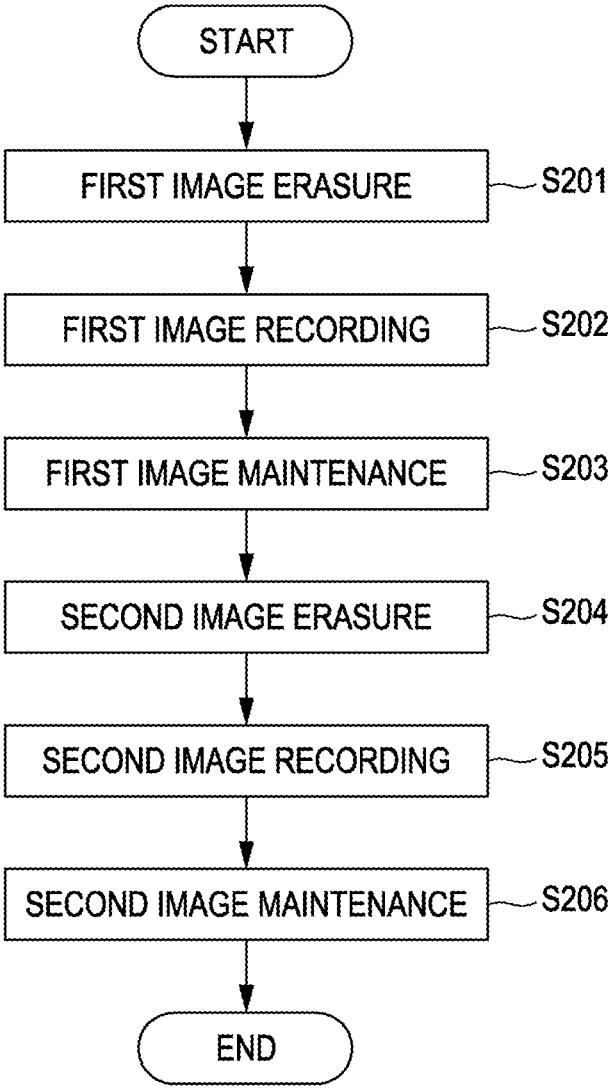
FIG. 13 is a flowchart illustrating a driving method according to the second embodiment.

FIG. 13 is a flowchart illustrating an example of a driving method of the electrophoretic display device according to the second embodiment.

As shown in FIG. 13, the driving method according to the second embodiment includes a first image erasure step S201, a first image recording step S202, a first image maintenance step S203, a second image erasure step S204, a second image recording step S205, and a second image maintenance step S206.

In the first image erasure step S201 to the first image maintenance step S203, for example, recording of letter information TXT as shown in FIG. 12A is performed, with respect to the first display section 5A.

Firstly, in the first image maintenance step S201, a high level electric potential at which the selection transistor 41 is in a turned on state is input to the entire scanning lines 66 of the first display section 5A from the controller 363 through the connection terminal 6. The low level electric potential VL (for example, −10V) for white-displaying the electrophoretic element 32 is input to the entire data lines 68 through the connection terminal 8. The ground electric potential GND (0V) is input to the common electrode 37 through the connection terminal 7. Accordingly, the entire surface of the first display section 5A is white-displayed, and becomes an erasure state.

Next, in the first image recording step S202, the electrophoretic display device 300 is set to the image recording device 200 as shown in FIG. 9. In this case, an image mask 230 in which a pattern corresponding to the letter information TXT shown in FIG. 12A is formed, and the first display section 5A of the electrophoretic display device 300 are aligned to each other. Here, since the electrophoretic display device 300 includes the controller 363, the connection terminal 221 of the image recording device 200 is not connected with the electrophoretic display device 300.

Then, the low level electric potential at which the selection transistor 41 is in the turned off state is input to the scanning lines 66 from the controller 363 through the connection terminal 6. The high level electric potential VH (for example, 10V) is input to the data lines 68 through the connection terminal 8. The ground electric potential GND (0V) is input to the common electrode 37 (electric potential Vcom) through the connection terminal 7. Accordingly, the first display section 5A is in the image recordable state.

Further, if the first display section 5A is maintained in the above described voltage application state, the light source device 210 of the image recording device 200 is operated so that the light LT illuminates the first display section 5A through the image mask 230. Thus, in the pixel 40 illuminated by the light LT, the leak current is generated in the selection transistor 41, and the electric potential of the pixel electrode 35 is increased. As a result, the pixel 40 illuminated by the light is selectively changed into the black display and the image corresponding to the image mask 230 is displayed in the first display section 5A.

Thereafter, if the procedure goes to the first image maintenance step S203, the ground electric potential GND is input to the data lines 68 and the common electrode 37 from the controller 363 through the connection terminals 7 and 8. Thus, thereafter, the display state in the first display section 5A can be prevented from being changed, thereby maintaining the display image.

As described above, if the letter information TXT is displayed in the first display section 5A, the procedure goes to a handwriting input mode by means of the light pen. In such a handwriting input mode, the second image erasure step S204 to the second image maintenance step S206 are performed one time, or repeatedly performed several times.

In the handwriting input mode (steps S204 to S206), the first display section 5A maintains the electric potential state of the image maintenance step S203, and the display image of the first display section 5A is not changed.

In the second image display step S204, the high level electric potential at which the selection transistor 41 is in the turned on state is input to the entire scanning lines 366 of the second display section 5B from the controller 363 through the connection terminal 306. The low level electric potential VL (for example, −10V) for white-displaying the electrophoretic element 32 is input to the entire data lines 368 through the connection terminal 308. The ground electric potential GND (0V) is input to the common electrode 37 through the connection terminal 7. Thus, the entire surface of the second display section 5B is white-displayed, and becomes in the erasure state.

Next, in the second image recording step S205, as shown in FIG. 12B, the handwriting input by means of the light pen 250 is performed in the second display section 5B of the electrophoretic display device 300.

In the second image recording step S205, the low level electric potential at which the selection transistor 41 is in the turned off state is input to the scanning lines 366 from the controller 363 through the connection terminal 306. The high level electric potential VH (for example, 10V) is input to the data lines 368 through the connection terminal 308. The ground electric potential GND (0V) is input to the common electrode 37 (electric potential Vcom) through the connection terminal 7. Thus, the second display section 5B is in the image recordable state.

As shown in FIG. 12B, if the light pen 250 moves close to the second display section 5B maintained in the above described voltage application state, the leak current is generated in the selection transistor 41 in the pixel 340 illuminated by the light LT of the light pen 250, and the electric potential of the pixel electrode 35 is increased. As a result, the pixel 340 illuminated by the light is selectively changed into the black display, and a black mark is recorded in the second display section 5B.

Then, if the procedure goes to the second image maintenance step S206, the ground electric potential GND is input to the data lines 368 from the controller 363 through the connection terminal 308, and the ground electric potential GND is input to the common electrode 37 through the connection terminal 7. Accordingly, the change in the display state in the second display section 5B is prevented and the recorded black mark is maintained.

As described above, according to the electrophoretic display device 300 of the second embodiment, the first display section 5A and the second display section 5B can be individually operated. That is, only the second display section 5B can be in the image recordable state while the display state of the first display section 5A is being maintained. Thus, for example, the electrophoretic display device 300 can be suitably used in such a manner that horizontal writing letter information is displayed in the first display section 5A, and a check mark or the like is added to a line head (second display section 5B) by the light pen 250 or the like.

In the electrophoretic display device 300 according to the second embodiment, a mechanism which is configured to determine whether the light pen 250 comes in contact with or is close to the electrophoretic display device 300 may be provided. Accordingly, the recording can be performed by means of the light pen 250 as necessary, and a false operation (unintended recording) due to the incidence of the outside light or the like can be prevented.

The second display section 5B is not only a line head (left side in the figure) of the letter information TXT shown in the first display section 5A, but also may be provided in a line end (right side in the figure). Further, the second display section 5B may be provided on one side part (upper side part) of a column direction (a direction orthogonal to the row direction) of the letter information TXT in the first display section 5A, or may be provided on the other side part (lower side part) thereof.

In the second embodiment, the letter information TXT is displayed in only the first display section 5A, and the display state is maintained at the time of the handwriting input, but the letter information or the image may be displayed with respect to the second display section 5B.

In a case where both of the first display section 5A and the second display section 5B are used in the image display, since the first display section 5A and the second display section 5B can be driven at the same time in the first image erasure step S201 to the first image maintenance step S203 as shown in FIG. 13, thereby recording the image in a simple manner.

Third Embodiment

Hereinafter, a third embodiment according to the present invention will be described with reference to FIGS. 14 and 15.

Figure 14:
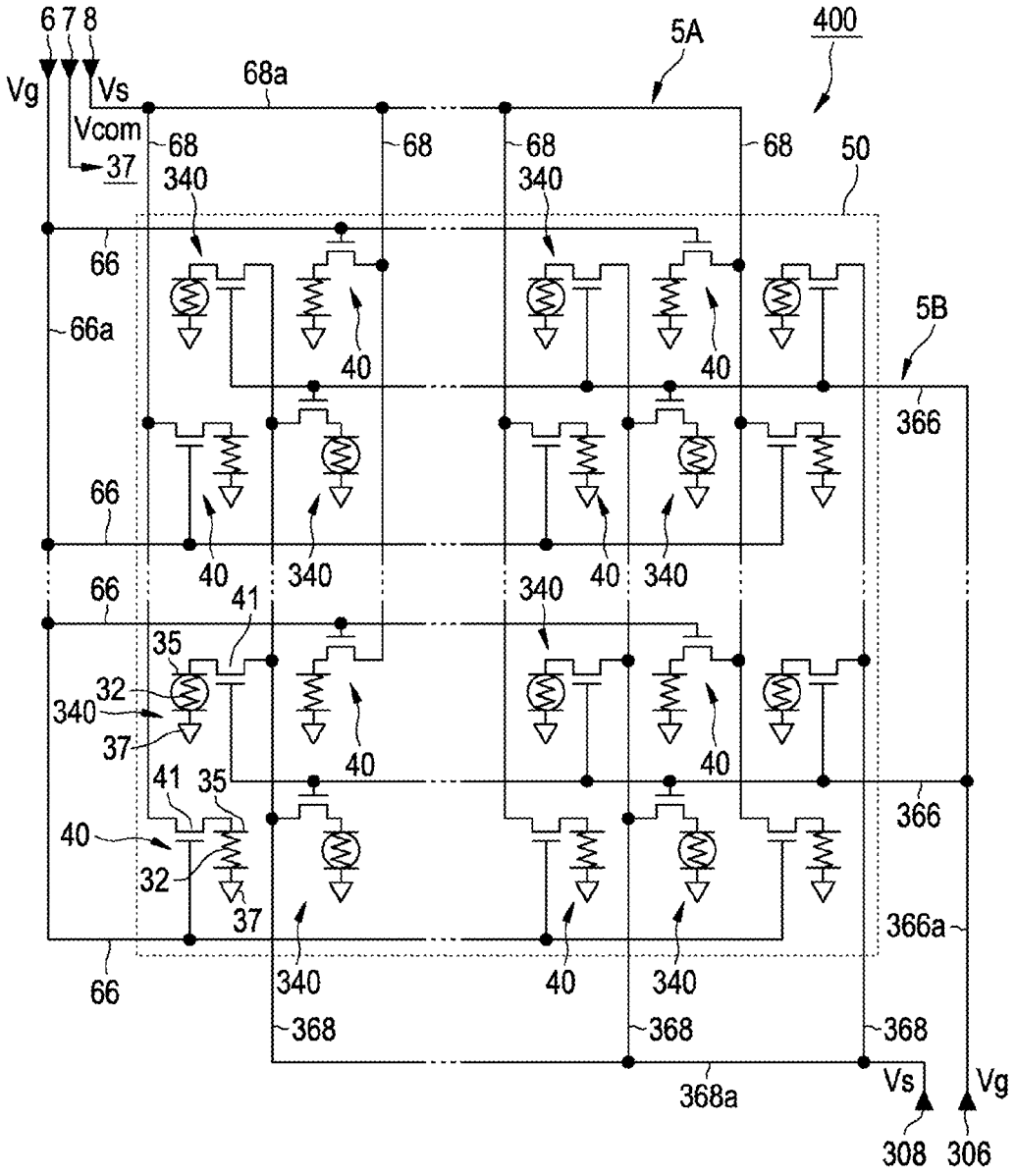
FIG. 14 is a diagram illustrating a circuit configuration of an electrophoretic display device according to a third embodiment of the present invention.
Figure 15A:
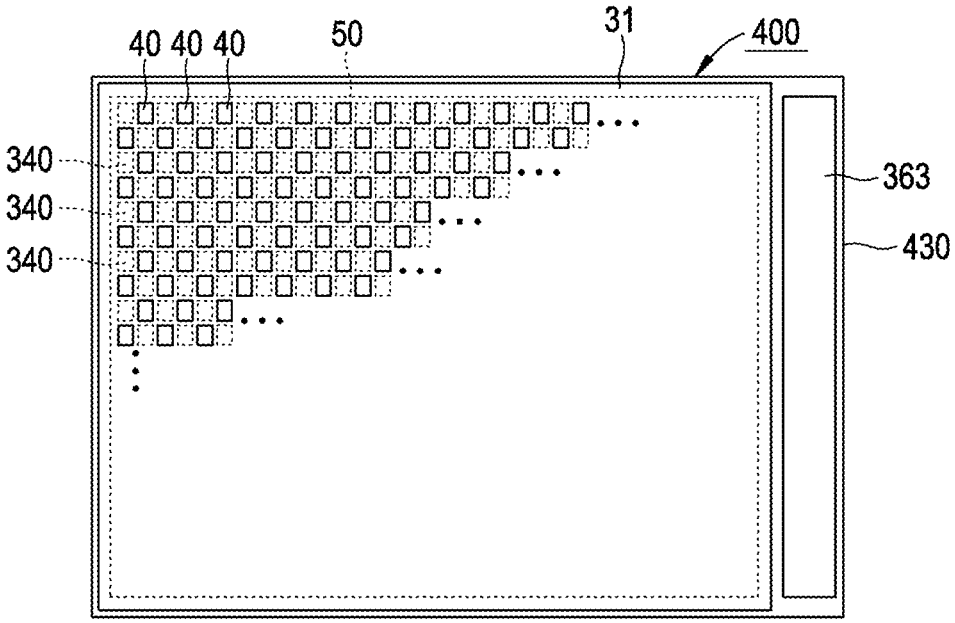
FIG. 15A is a plan view illustrating an electrophoretic display device according to the third embodiment.
Figure 15B:
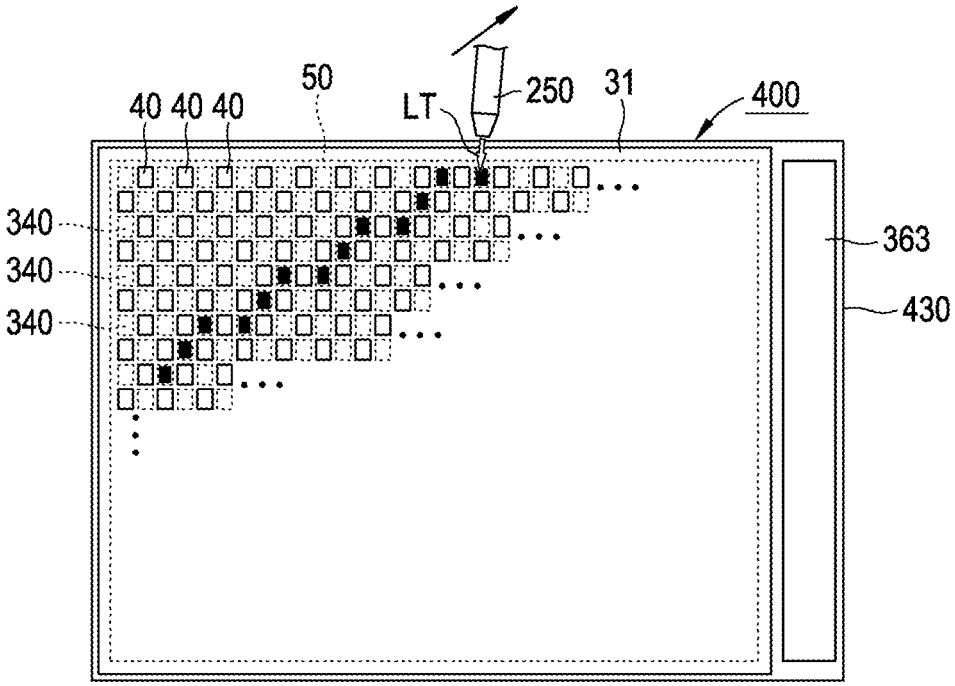
FIG. 15B is a diagram illustrating an operation of an electrophoretic display device according to the third embodiment.

FIG. 14 is a diagram illustrating a circuit configuration of an electrophoretic display device according to the third embodiment. FIGS. 15A and 15B are diagrams illustrating an operation of the electrophoretic display device according to the third embodiment.

In the following figures, the same reference numerals are used for the same elements as in the first embodiment, the modified examples thereof and the second embodiment, and detailed description thereof will be omitted.

As shown in FIG. 14, an electrophoretic display device 400 according to the present embodiment includes a display section 50 in which a plurality of pixels 40 and a plurality of pixels 340 are arranged.

A plurality of scanning lines 66 and a plurality of data lines 68 are formed in the display section 50. The pixel 40 is formed to correspond to an intersection of the scanning line 66 and the data line 68. The entire scanning lines 66 of the display section 50 are connected to the connection terminal 6 through the connection wiring 66*a*. The entire data lines 68 of the display section 50 are connected to the connection terminal 8 through the connection wiring 68*a*.

A plurality of scanning lines 366 and a plurality of data lines 368 are formed in the display section 50. The pixel 340 is formed to correspond to an intersection of the scanning line 366 and the data line 368. The entire scanning lines 366 of the display section 50 are connected to the connection terminal 306 through the connection wiring 366*a*. The entire data lines 368 of the display section 50 are connected to the connection terminal 308 through the connection wiring 368*a*.

Each of the pixels 40 and 340 includes the selection transistor 41, the pixel electrode 35, the electrophoretic element 32 and the common electrode 37.

In the third embodiment, in the display section 50, the pixels 40 and the pixels 340 are alternately arranged to be adjacent to each other in a row direction (an extending direction of the scanning lines 66 and 366) and a column direction (an extending direction of the data lines 68 and 368). That is, the electrophoretic display device 400 according to the third embodiment includes a configuration in which the pixels 40 of the first display section 5A and the pixels 340 of the second display section 5B according to the second embodiment are mixed with each other and arranged in a checker board shape.

FIG. 15A is a plan view illustrating a schematic configuration of the electrophoretic display device 400.

The electrophoretic display device 400 includes an element substrate 430 and the opposite substrate 31. The display section 50 is formed in a region where the element substrate 430 and the opposite substrate 31 are overlapped with each other from a planar view. A controller 363 (control section) is mounted in a region of the element substrate 430 which is extended outside the opposite substrate 31. The controller 363 is connected with the connection terminals 6 to 8 and the connection terminals 306 and 308 shown in FIG. 15, through a wiring (not shown).

The element substrate 430 has the same configuration as that of the element substrate 330 according to the second embodiment, except the arrangement of the pixels 40 and the pixels 340. The controller 363 is configured to be able to supply predetermined electric potentials to the connection terminals 6 to 8 and the connection terminals 306 and 308. The controller 363 controls the plurality of pixels 40 which belongs to the display section 50 by the electric potential input through the connection terminals 6 and 8, and controls the plurality of pixels 340 by the electric potential input through the connection terminals 306 and 308.

Driving Method

Next, a driving method of the electrophoretic display device 400 according to the third embodiment will be described.

The flowchart as shown in FIG. 13 can be applied to the driving method of the electrophoretic display device 400 according to the third embodiment. That is, the driving method can include the first image erasure step S201, the first image recording step S202, the first image maintenance step S203, the second image erasure step S204, the second image recording step S205 and the second image maintenance step S206.

In the first image erasure step S201 to the first image maintenance step S203 in the third embodiment, a desired image recording is performed with respect to the arrangement of the pixels 40 of the display section 50.

Specifically, in the first image maintenance step S201, the high level electric potential at which the selection transistor 41 is in the turned on state is input to the entire scanning lines 66 of the display section 50 from the controller 363 through the connection terminal 6. The low level electric potential VL (for example, −10V) for white-displaying the electrophoretic element 32 is input to the entire data lines 68 through the connection terminal 8. The ground electric potential GND (0V) is input to the common electrode 37 through the connection terminal 7. Thus, the entire pixels 40 of the display section 50 are white-displayed, and become in the erasure state.

Next, in the first image recording step S202, the electrophoretic display device 400 is set to the image recording device 200 shown in FIG. 9. In this case, the image mask 230 in which a pattern corresponding to the image displayed in the display section 50 is formed and the display section 50 of the electrophoretic display device 300 are arranged in alignment with each other. Here, since the electrophoretic display device 400 includes the controller 363, the connection terminal 221 of the image recording device 200 is not connected with the electrophoretic display device 400.

Then, the low level electric potential at which the selection transistor 41 is in the turned off state is input to the scanning lines 66 from the controller 363 through the connection terminal 6. The high level electric potential VH (for example, 10V) is input to the data lines 68 through the connection terminal 8. The ground electric potential GND (0V) is input to the common electrode 37 (electric potential Vcom) through the connection terminal 7. Thus, the pixels 40 of the display section 50 are in the image recordable state.

If the pixels 40 are maintained in the above described voltage application state, the light source device 210 of the image recording device 200 is operated so that the light LT illuminates the display section 50 through the image mask 230. Accordingly, the leak current is generated in the selection transistor 41 in the pixel 40 illuminated by the light LT, and the electric potential of the pixel electrode 35 is increased. As a result, the pixel 40 illuminated by the light is changed into the black display, and the image corresponding to the image mask 230 is displayed in the display section 50.

Then, if the procedure goes to the first image step S203, the ground electric potential GND is input to the data lines 68 and the common electrode 37 from the controller 363 through the connection terminals 7 and 8. Accordingly, thereafter, the change in the display state of the pixels 40 is prevented, and the display image is maintained.

If the image formed by the pixels 40 as described above is displayed, the procedure goes to the handwriting input mode by means of the light pen. In such a handwriting mode, the second image erasure step S204 to the second image maintenance step S206 are performed one time, or repeatedly performed several times.

In the handwriting input mode (steps S204 to S206), the pixels 40 maintain the electric potential state of the image maintenance step S203 as described above, and the displayed image is not changed.

In the second image erasure step S204, the high level electric potential at which the selection transistor 41 is in the turned on state is input to the entire scanning lines 366 of the display section 50 from the controller 363 through the connection terminal 306. The low level electric potential VL (for example, −10V) for white-displaying the electrophoretic element 32 is input to the entire data lines 368 through the connection terminal 308. The ground electric potential GND (0V) is input to the common electrode 37 through the connection terminal 7. Accordingly, the entire pixels 340 of the display section 50 are white-displayed and become in the erasure state.

Next, in the second image recording step S205, as shown in FIG. 15B, the handwriting input is by means of the light pen 250 is performed in the region, which is formed of the pixels 340, of the display section 50 of the electrophoretic display device 400.

In the second image recording step S205, the low level electric potential at which the selection transistor 41 is in the turned off state is input to the scanning lines 366 from the controller 363 through the connection terminal 306. The high level electric potential (for example, 10V) is input to the data lines 368 through the connection terminal 308. The ground electric potential GND (0V) is input to the common electrode 37 (electric potential Vcom) through the connection terminal 7. Accordingly, the pixels 340 are in the image recordable state.

If the display section 50 in which the pixels 340 are maintained in the above described voltage application state is scanned by the light pen 250 as shown in FIG. 15B, the leak current is generated in the selection transistor 41 in the pixel 340 illuminated by the light LT emitted from the light pen 250, and the electric potential of the pixel electrode 35 is increased. As a result, the pixel 340 illuminated by the light is selectively transited into the black display, and the image can be over-written as shown in the figure.

Then, if the procedure goes to the second image maintenance step S206, the ground electric potential GND is input to the data lines 368 from the controller 363 through the connection terminal 308. The ground electric potential GND is input to the common electrode 37 through the connection terminal 7. Thus, the change in the display state with respect to the image of the pixels 340 is prevented and the recorded image is maintained.

As described above, according to the electrophoretic display device 400 of the third embodiment, since the pixels 40 and the pixels 340 are mixed with each other and arranged in the checker board shape, a desired image can be displayed in the display section 50 by the pixels 40, and the handwriting input can be performed using the pixels 340. Accordingly, for example, the electrophoretic display device 400 can be appropriately used in such a manner that the letter information is displayed by the pixels 40, and a check mark, a line segment or the like is added thereto by means of the light pen 250 or the like.

In the electrophoretic display device 400 according to the third embodiment, a mechanism which is configured to determine whether the light pen 250 comes into contact with or is close to the electrophoretic display device 400 may be provided. Thus, the recording can be performed by the light pen 250 as necessary, and a false operation (unintended recording) due to the incidence of outside light or the like can be prevented.

In the third embodiment, an image is displayed using only the pixels 40, and an image by means of the handwriting input is displayed using the pixels 340, but the letter information or the image may be displayed using both of the pixels 40 and the pixels 340. In this case, in the first image erasure step S201 to the first image maintenance step S203 shown in FIG. 13, the pixels 40 and the pixels 340 can be driven at the same time, to thereby easily record the image.

In a case where the pixels 40 and the pixels 340 are driven to record the image at the same time, the second image erasure step S204 is not performed and the procedure goes to the second image recording step S205. Then, in the second image recording step S205, the handwriting input can be performed with respect to the pixels 340 (namely, the pixels 340 which are not black-displayed) which are not used in the image display in the first image erasure step S201 to the first image maintain step S203. Thus, through the first image erasure step S201 to the first image maintenance step S203, the image by means of the handwriting input can be over-written in the second image recording step S205, with respect to the image which is recorded in the pixels 40 and the pixels 340.

In the electrophoretic display device 400 according to the third embodiment, the display section 50 can be formed of the pixels 40 and 340 each having an arbitrary number. In FIGS. 14 and 15A, the pixels 40 and the pixels 340 are approximately arranged by one-to-one, but different ratios may be employed. For example, in a region where a plurality of pixels 40 is arranged, the pixels 340 of about ½ to 1/10 of the number of the pixels 40 may be mixed and arranged. Further, the sizes of the pixels 40 and the pixels 340 may be different from each other. For example, the pixels 40 may have a size for the accuracy (for example, about 300 to 600 ppi) suitable for the display of letters or images, and the pixels 340 may have a size for the accuracy (for example, about 50 to 100 ppi) suitable for the handwriting input.

Fourth Embodiment

Figure 16:
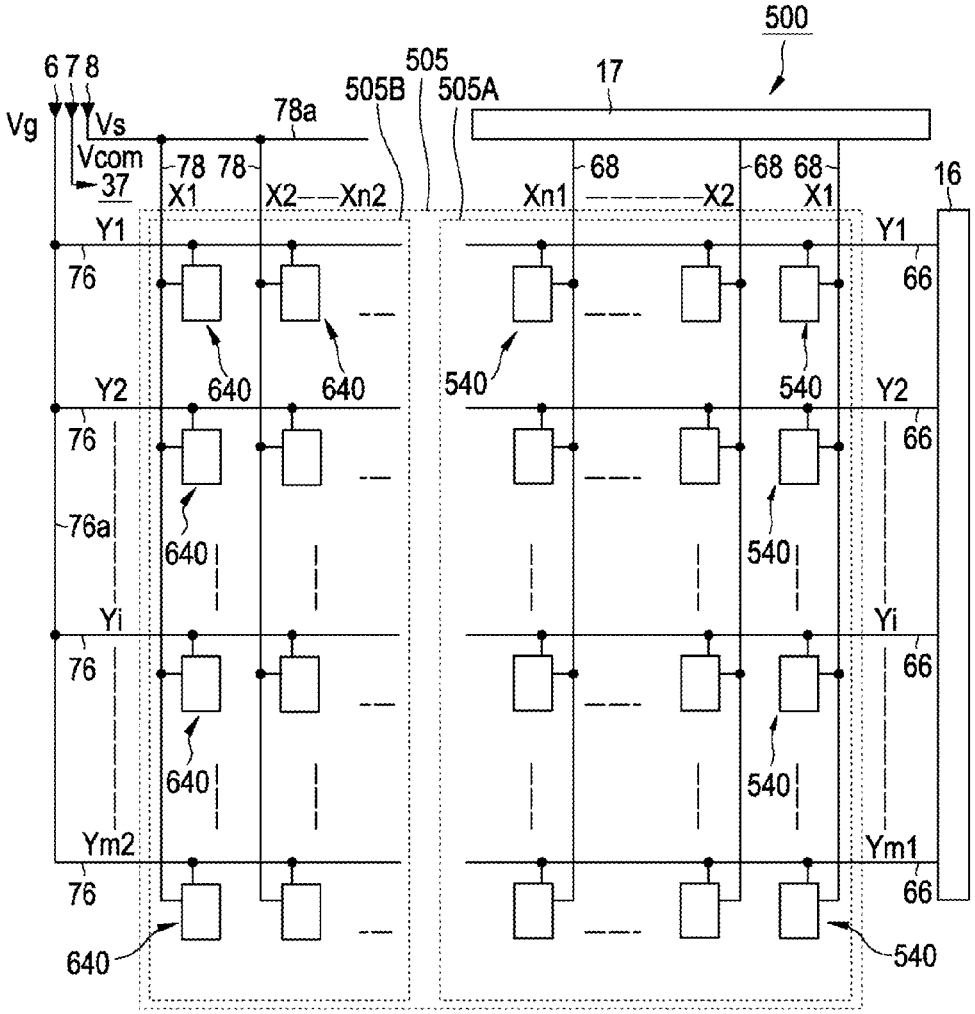
FIG. 16 is a diagram illustrating a circuit configuration of an electrophoretic display device according to a fourth embodiment of the present invention.
Figure 17A:
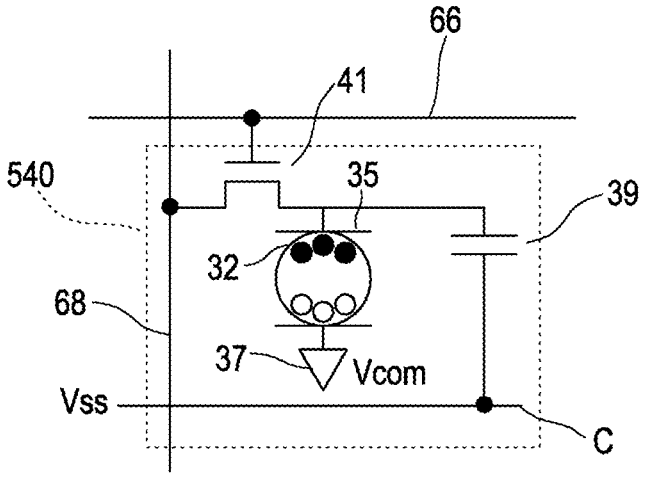
FIG. 17A is a diagram illustrating a configuration of a pixel which belongs to a first display section according to the fourth embodiment.
Figure 17B:
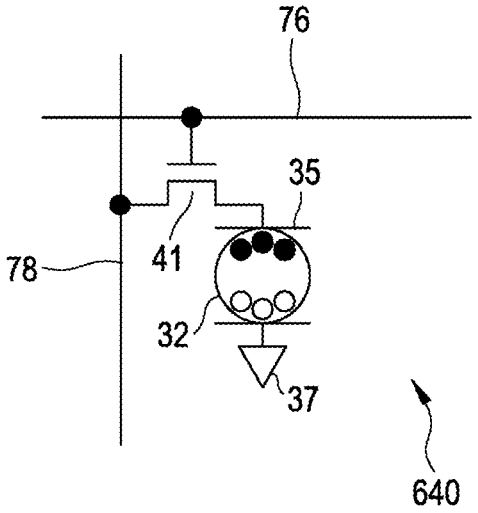
FIG. 17B is a diagram illustrating a configuration of each pixel which belongs to a second display section according to the fourth embodiment.

FIG. 16 is a diagram illustrating a circuit configuration of an electrophoretic display device which is a fourth embodiment of an electro-optical device according to the present invention. FIG. 17A is a diagram illustrating a configuration of a pixel in a first display section of the electrophoretic display device according to the fourth embodiment, and FIG. 17B is a diagram illustrating a configuration of a pixel in a second display section of the electrophoretic display device according to the fourth embodiment.

As shown in FIG. 16, the electrophoretic display device (electro-optical device) 500 according to the fourth embodiment includes a first display section 505A of an electronic display type and a second display section 505B of an optical recording display type. A plurality of pixels 540 (first pixels) is arranged in a matrix shape in the first display section 505A, while a plurality of pixels 640 (second pixels) is arranged in a matrix shape in the second display section 505B.

In the first display section 505A, m1 items of scanning lines 66 (Y1, Y2, . . . , Ym1) and n1 items of data lines 68 (X1, X2, . . . , Xn1) are extended in a direction in which they intersects with each other. The pixel 540 is disposed to correspond to an intersection of the scanning line 66 and the data line 68.

In the second display section 505B, m2 items of scanning lines 76 (Y1, Y2, . . . , Ym2) and n2 items of data lines 78 (X1, X2, . . . , Xn2) are extended in a direction in which they intersect with each other. The pixel 640 is disposed to correspond to an intersection of the scanning line 76 and the data line 78.

A scanning line driving circuit 16 connected with the plurality of scanning lines 66 extending from the first display section 505A and a data line driving circuit 17 connected with the plurality of data lines 68 extending from the first display section 505A are formed around the first display section 505A. The scanning line driving circuit 16 is connected to the pixels 540 through the plurality of scanning lines 66 and the data line driving circuit 17 is connected to the pixels 540 through the plurality of data lines 68.

As shown in FIG. 17A, the selection transistor 41, the pixel electrode 35, the electrophoretic element 32 (electro-optical material layer), the common electrode 37 and a retentive capacitance 39 are formed in the pixel 540 of the first display section 505A.

One electrode of the retentive capacitance 39 is connected to a drain of the selection transistor 41, and the other electrode thereof is connected to a capacitance line C. By the retentive capacitance 39, an electric potential of an image signal recorded through the selection transistor 41 can be maintained for a predetermined time.

In the pixel circuit shown in FIG. 17A, if the scanning line 66 is selected, the selection transistor 41 becomes in a turned on state, and the retentive capacitance is charged by the image signal input through the data line 68. Then, if the scanning line 66 is not selected, the selection transistor 41 becomes in a turned off state, thereby moving charged particles of the electrophoretic element 32 by energy accumulated in the retentive capacitance.

A connection wiring 76*a* which connects end parts of the plurality of scanning lines 76 extending from the second display section 505B, a connection wiring 78*a* which connects end parts of the plurality of data lines 78 extending from the second display section 505B, and connection terminals 6, 7 and 8 are formed around the second display section 505B. The connection terminal 6 is connected to the connection wiring 76*a* and is connected to the entire scanning lines 76 of the display section 5 through the connection wiring 76*a*. The connection terminal 8 is connected to the connection wiring 78*a* and is connected to the entire data lines 78 of the second display section 5B through the connection wiring 78*a*. The connection terminal 7 is connected to the common electrode 37 formed as a common electrode in the plurality of pixels 340.

As shown in FIG. 17B, the selection transistor 41, the pixel electrode 35, the electrophoretic element 32 (electro-optical material layer) and the common electrode 37 are formed in the pixel 640 of the second display section 505B, respectively. Although not shown, a retentive capacitance may be provided between the pixel electrode 35 and the capacitance line C, as in the pixel 540.

The selection transistor 41 is a pixel switching element made of, for example, NMOS (Negative Metal Oxide Semiconductor)-TFT (Thin Film Transistor). A gate terminal of the selection transistor 41 is connected with the scanning line 66 (76), a source terminal thereof is connected with the data line 68 (78), and a drain terminal thereof is connected with the pixel electrode 35.

The gates of the selection transistors 41 for forming the pixels 540 of the first display section 505A are connected with each scanning line 66 in the unit of a set in each row, and are connected with the scanning line driving circuit 16. The sources of the selection transistors 41 for forming the pixels 540 of the first display section 505A are connected with each data line 68 in the unit of a set in each column, and are connected with the data line driving circuit 17.

Figure 18A:
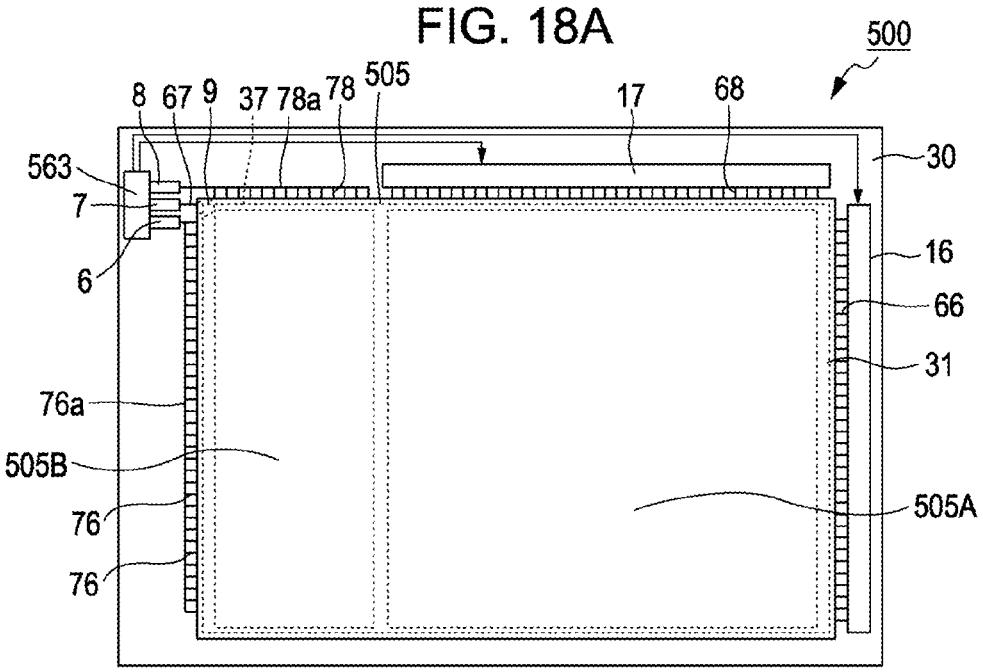
FIG. 18A is a plan view illustrating an electrophoretic display device according to the fourth embodiment.
Figure 18B:
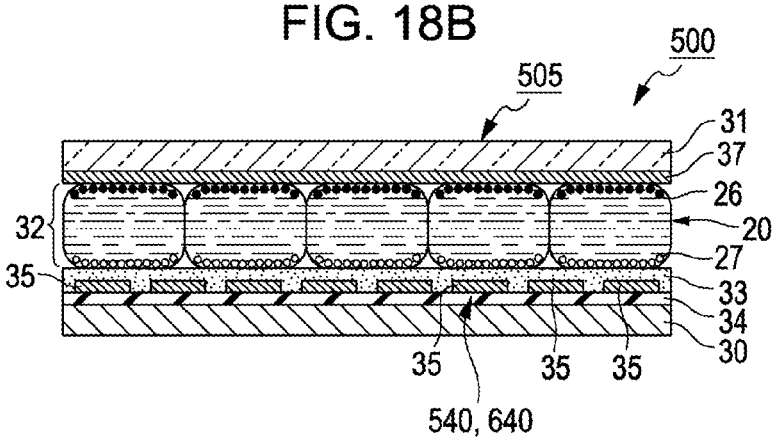
FIG. 18B is a sectional view illustrating an electrophoretic display device according to the fourth embodiment.

FIG. 18A is a plan view illustrating an electrophoretic display device 500. FIG. 18B is a partial sectional view illustrating the electrophoretic display device 500 in the display section 505.

As shown in FIG. 18A, the display section 505 is formed in a region where the element substrate 30 and the opposite substrate 31 are overlapped with each other from a planar view. The scanning line driving circuit 16 is mounted on the right side (in the figure) of the element substrate 30. The scanning line driving circuit 16 is connected to the plurality of scanning lines 66 extended from the display section 505. Similarly, the data line driving circuit 17 is mounted on the upper side (in the figure) of the element substrate 30. The data line driving circuit 17 is connected to the plurality of data lines 68. The connection terminal 7 formed between the connection terminals 6 and 8 is connected to the common electrode 37 through the connection wiring 67 formed on the element substrate 30 and the inter-substrate connection section 9 which electrically connects the element substrate 30 and the opposite substrate 31.

The electrophoretic display device 500 is operated by electric power or a control signal line from a controller 563 (control section). In FIG. 18A, a schematic wiring connection state is shown with arrows. As shown, the controller 563 is connected with the connection terminals 6 to 8, the scanning line driving circuit 16 and the data line driving circuit 17.

The controller 563 can control the plurality of pixels 540 which belong to the display section 505 through the electric potential input through the scanning line driving circuit 16 and the data line driving circuit 17, and can control the plurality of pixels 640 by the electric potential input through the connection terminals 6 and 8.

As shown in FIG. 18B, the electrophoretic display device 500 has a configuration in which the electrophoretic element 32, in which a plurality of microcapsules 20 is arranged, is disposed between the element substrate (substrate) 30 and the opposite substrate (substrate) 31.

In the display section 505, the circuit layer 34 in which the scanning lines 66 and 76, the data lines 68 and 78, the selection transistor 41 and the like are formed is provided on the side of the element substrate 30 facing the electrophoretic element 32, and the plurality of pixel electrodes 35 is arranged on the circuit layer 34.

Figure 19A:
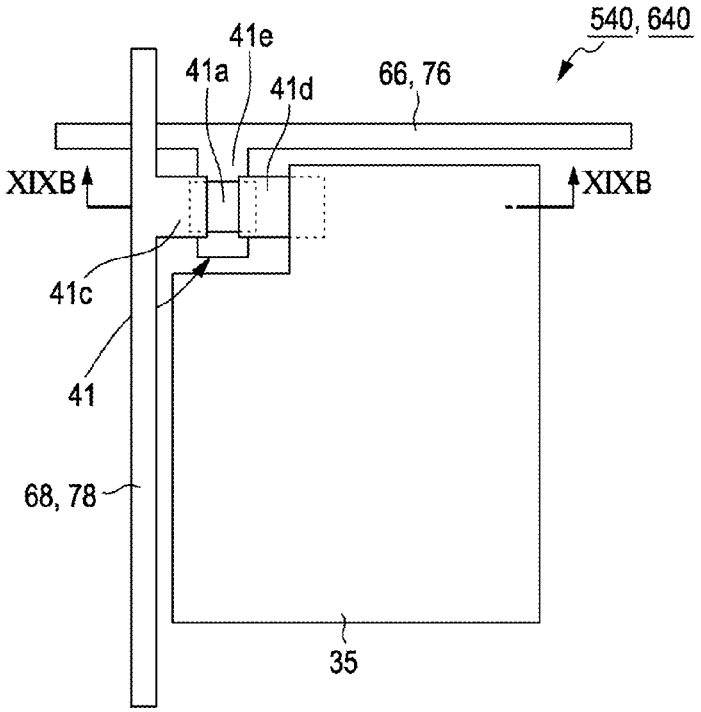
FIG. 19A is a plan view illustrating an element substrate in a single pixel.
Figure 19B:
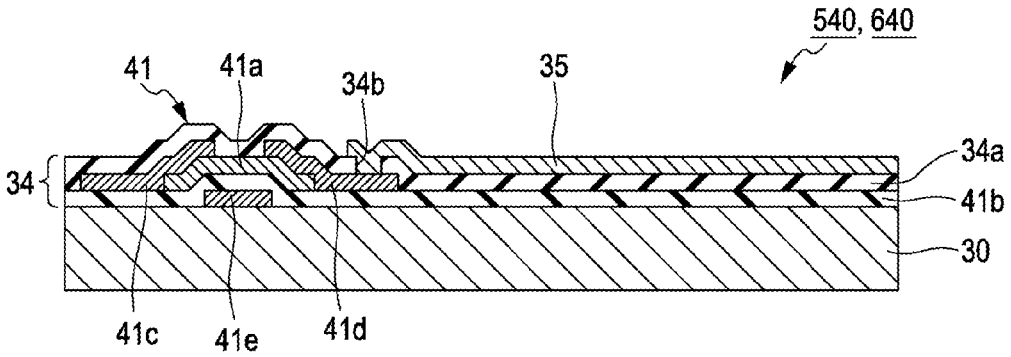
FIG. 19B is a sectional view of an element substrate in a single pixel.

FIG. 19A is a plan view illustrating the element substrate 30 in the single pixel 640, and FIG. 19B is a sectional view in a position taken along line XIXB-XIXB in FIG. 19A.

As shown in FIG. 19A, the selection transistor 41 includes a semiconductor layer 41*a* of a rectangular shape from a planar view, a source electrode 41*c* extended from the data line 78, a drain electrode 41*d* for connecting the semiconductor layer 41*a* and the pixel electrode 35, and a gate electrode 41*e* extended from the scanning line 76.

Referring to a sectional view shown in FIG. 19B, a gate electrode 41*e* (scanning line 76) made of Al or Al alloy is formed on the element substrate 30. Further, a gate insulating film 41*b* made of silicon oxide or silicon nitride is formed to cover the gate electrode 41*e*. The semiconductor layer 41*a* made of amorphous silicon or poly silicon is formed in a region opposite to the gate electrode 41*e* through the gate insulating film 41*b*. The source electrode 41*c* and the drain electrode 41*d* made of Al or Al alloy are formed to partly run on the semiconductor layer 41*a*. An inter-layer insulating film 34*a* made of silicon oxide or silicon nitride is formed to cover the source electrode 41*c* (data line 78), the drain electrode 41*d*, the semiconductor layer 41*a*, and the gate insulating film 41*b*. The pixel electrode 35 is formed on the inter-layer insulating film 34*a*. The pixel electrode 35 and the drain electrode 41*d* are connected with each other through a contact hole 34*b* which is formed through the inter-layer insulating film 34*a* and reaches the drain electrode 41*d*.

The pixel 540 may be formed by adding the retentive capacitance 39 to the pixel 640.

In the electrophoretic display device 500 according to the fourth embodiment, the number m1 of scanning lines 66 and the number n1 of the data lines 68, and the number m2 of scanning lines 76 and the number n2 of the data lines 78 may be set as an arbitrary natural number. That is, the first display section 505A and the second display section 505B may be formed of the pixels 540 and 640 each having an arbitrary number.

The accuracies of the pixels 540 and 640 in the first display section 505A and the second display 505B may be different from each other. For example, the first display section 505A may be set to an accuracy (for example, about 300 to 600 ppi) suitable for the display of letters or images, and the second display section 505B may be set to an accuracy (for example, about 50 to 100 ppi) suitable for the handwriting input.

External shapes of the first display section 505A and the second display section 505B is not limited to the rectangular shape, but may have an arbitrary planar shape such as a triangular shape, a polygonal shape higher than a pentagon, or a circular or elliptical shape.

Returning to FIG. 18B, the common electrode 37 of the planar shape facing the plurality of pixel electrodes 35 is formed on the side of the opposite substrate 31 facing the electrophoretic element 32, and the electrophoretic element 32 is provided on the common electrode 37. The electrophoretic element 32 and the pixel electrode 35 are adhered to each other through an adhesive layer 33, and thus, the element substrate 30 and the opposite substrate 31 are adhered to each other.

Figure 18C:
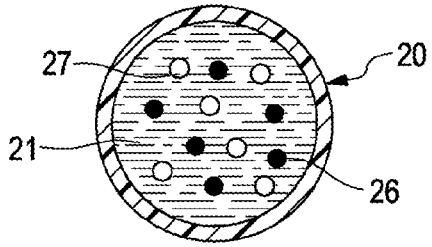
FIG. 18C is a sectional view illustrating a microcapsule which is provided in an electrophoretic display device according to the fourth embodiment.

FIG. 18C is a sectional view schematically illustrating the microcapsule 20. The microcapsules 20 are disposed between the common electrode 37 and the pixel electrodes 35 as shown in FIG. 18B, and the single or plural microcapsules 20 are arranged inside the single pixel 540 and 640. The single microcapsule 20 may be arranged over the plurality of pixels 540 and 640.

Driving Method

Next, a driving method of the electrophoretic display device according to the fourth embodiment will be described with reference to FIGS. 20 to 24.

Figure 20:
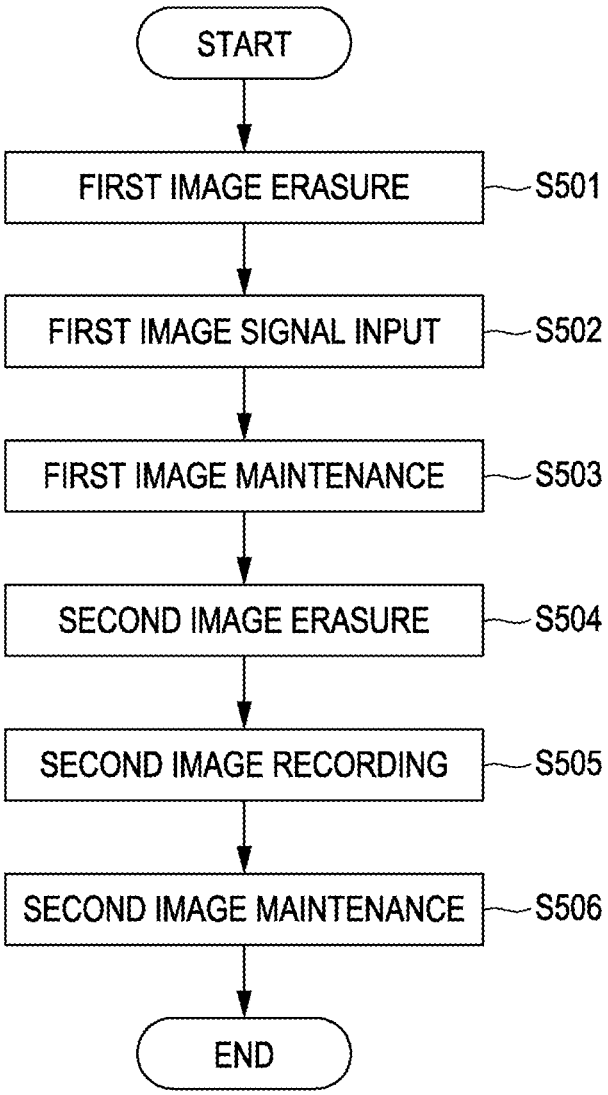
FIG. 20 is a flowchart illustrating a driving method according to the fourth embodiment.

FIG. 20 is a flowchart illustrating an example of a driving method of the electrophoretic display device 500.

As shown in FIG. 20, a driving method of the electrophoretic display device 500 according to the fourth embodiment includes a first image erasure step S501, a first image signal input step S502, a first image maintenance step S503, a second image erasure step S504, a second image recording step S505 and a second image maintenance step S506.

Figure 24A:
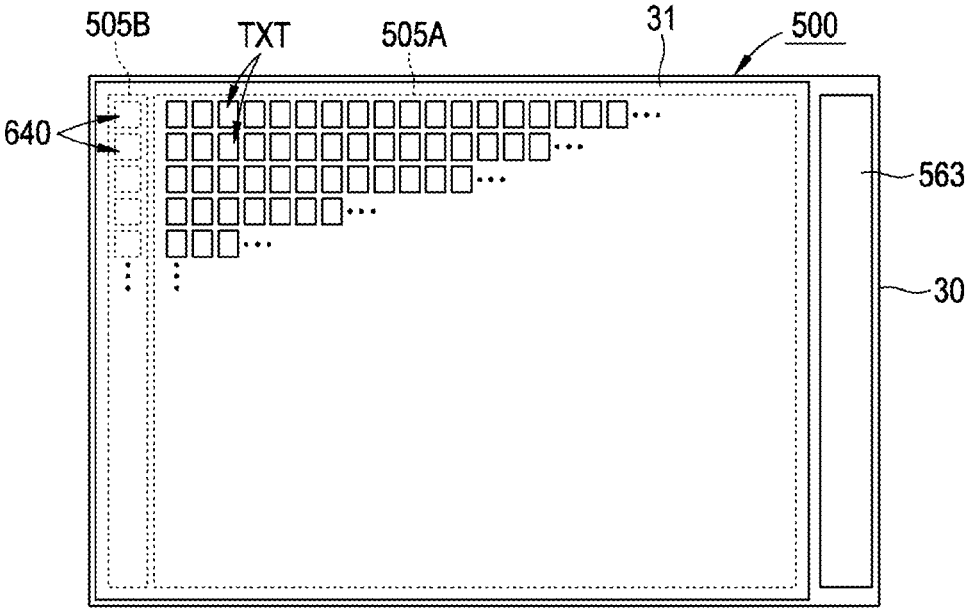
FIG. 24A is a plan view illustrating an electrophoretic display device according to the fourth embodiment.

In the first image erasure step S501 to the first image maintenance step S503, with respect to the arrangement of the plurality of pixels 540 of the first display section 505A in the display section 505, a desired image recording is performed. Specifically, in the first image erasure step S501 to the first image maintenance step S503, for example, recording of the letter information TXT shown in FIG. 24A is performed with respect to the first display section 505A.

In the display section 505 before the first image erasure step S501, the scanning line driving circuit 16 and the data line driving circuit 17 are in a power off state, or in an electrically disconnected state with respect to each electrode of the display section 505. Accordingly, both the pixel electrode 35 and the common electrode 37 are in a high impedance state (Hi-Z) in which they are all electrically disconnected, and the respective pixels 40 are in the state of the black display, the white display or the grayscale display. That is, the display is stored with no power.

In the first image erasure step S501, the high level electric potential at which the selection transistor 41 is in the turned on state is input to the entire scanning lines 66 of the first display section 505A from the controller 563 through the scanning line driving circuit 16. The low level electric potential VL (for example, −10V) for white-displaying the electrophoretic element 32 is input to the entire data lines 68 through the data line driving circuit 17. The ground electric potential GND (0V) is input to the common electrode 37 through a common electrode wiring (not shown). Accordingly, the entire pixels 540 of the first display section 505A are white-displayed and become in the erasure state.

In the first image erasure step S501, since all the pixels 540 of the display section 505 only have to be transited to a single grayscale, a specific driving method can be changed in a range in which such an object can be achieved. For example, in the above description, the electric potential Vcom of the common electrode 37 is defined as the ground electric potential GND (0V), but may be defined as the high level electric potential VH (for example, 10V).

Next, in the first image signal input step S502, predetermined electric potentials are input to the pixel electrode 35 and the common electrode 37 of the pixel 540 which belongs to the first display section 505A, respectively, and thus, a driving voltage is applied to the electrophoretic element 32 (microcapsule 20). Specifically, a selection signal (for example, a high level of 40V) is input to the scanning lines 66 of the respective rows in a sequential manner, for a predetermined period of time. Accordingly, the selection transistor 41 connected with the selected scanning line 66 is turned on, and an image data voltage (image signal) is input to the respective pixels 540 from the data lines 68. In this way, the retentive capacitance 39 in the pixel 540 is charged at the image data voltage, and the grayscale display according to the electrostatic energy of the retentive capacitance 39 is performed. In this way, a predetermined image is recorded in the first display section 505A.

In the fourth embodiment, in the first image signal input step S502, the electric potential Vcom of the common electrode 37 is maintained at the ground electric potential GND, but may be maintained at the low level electric potential VL (for example, −10V).

Then, if the procedure goes to the first image maintenance step S503, the ground electric potential GND is input to the data lines 68 (electric potential Vs) from the controller 563 through the data line driving circuit 17, and the ground electric potential GND is input to the common electrode 37 (electric potential Vcom) through a common electrode wiring (not shown). Thus, thereafter, the display state in the pixels 540 is prevented from being changed, and the display image is maintained.

In the first image maintenance step S503, the data lines 68 and the common electrode 37 may not necessarily be at the same electric potential. Specifically, the electric potential Vs of the data lines 68 and the electric potential Vcom of the common electrode 37 may be set so that the electric potential difference between the electric potential Vs of the data lines 68 and the electric potential Vcom of the common electrode 37 becomes equal to or smaller than a threshold voltage of the electrophoretic element 32. There may be a case where a distinct threshold voltage is not present in the electrophoretic element 32, and in this case, the threshold voltage may be set to a voltage which does not substantially affect the optical characteristic.

With such a configuration, if the letter information TXT is displayed in the first display section 505A, the procedure goes to a handwriting input mode by means of the light pen. In such a handwriting input mode, the second image erasure step S504 to the second image maintenance step S506, are repeatedly performed.

In the handwriting input mode (steps S504 to S506), the first display section 505A maintains the electric potential state of the above described first image maintenance step S503, and the display image of the first display section 505A is not changed.

Figure 21:
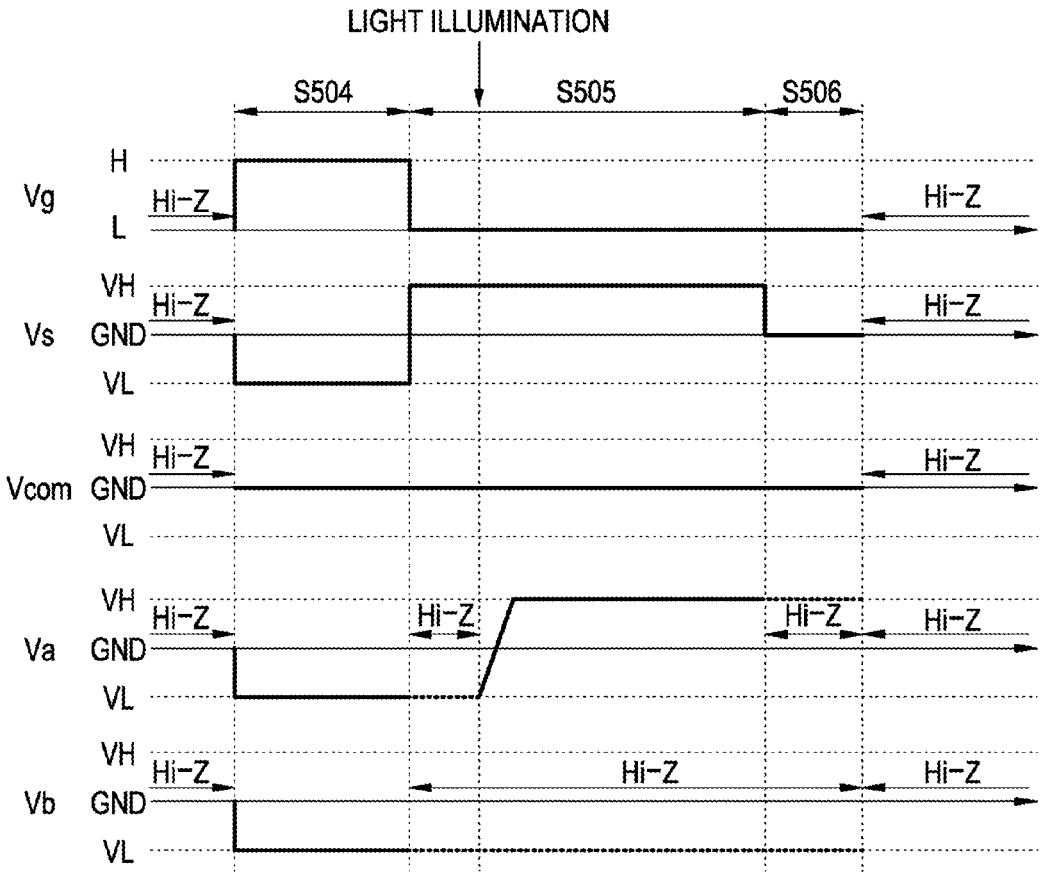
FIG. 21 is a timing chart illustrating a driving method (optical recording) according to the fourth embodiment.
Figure 22A:
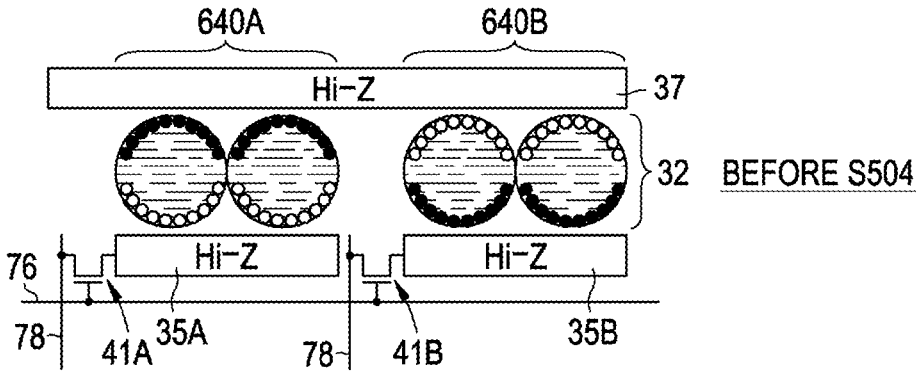
FIG. 22A is a diagram illustrating two pixels which are a description target of a driving method (optical recording) of the fourth embodiment.
Figure 22B:
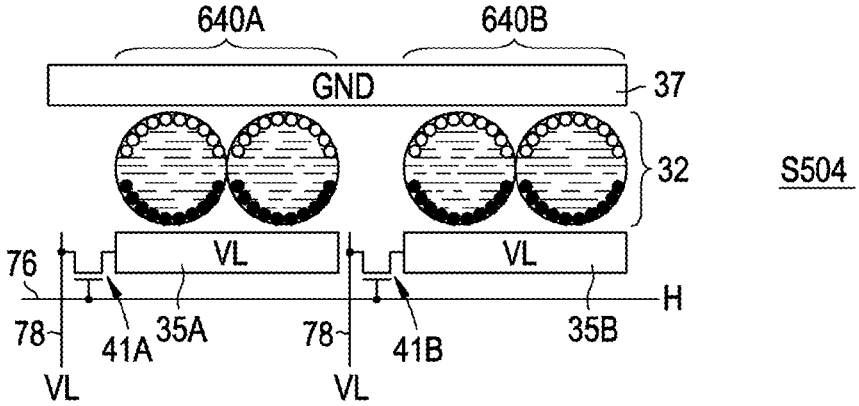
FIG. 22B is a diagram illustrating two pixels which are a description target of a driving method (optical recording) of the fourth embodiment.
Figure 22C:
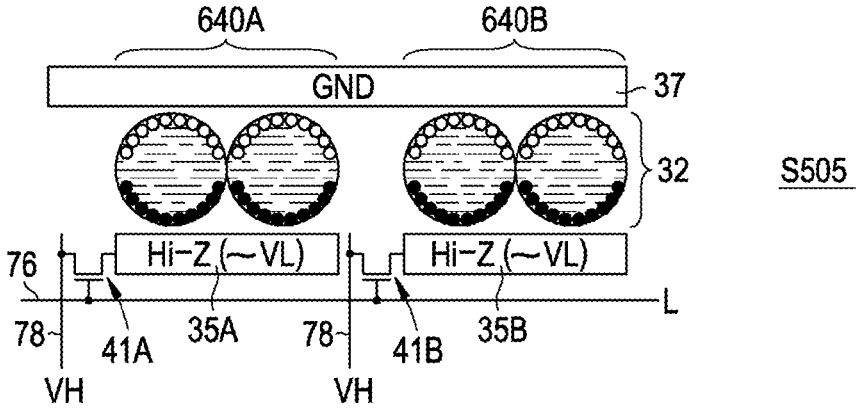
FIG. 22C is a diagram illustrating two pixels which are a description target of a driving method (optical recording) of the fourth embodiment.

FIG. 21 is a timing chart corresponding to the handwriting input mode, which illustrates a timing chart in cases where the pixels 640 are black-displayed and white-displayed. In FIG. 21, for identification, the pixels 640 to be black-displayed is given a reference numeral 640A, and the pixels 640 to maintain the white display is given a reference numeral 640B. FIGS. 22A to 22C, FIG. 23A and FIG. 23B are diagrams illustrating electric potential states of two pixels in each operation of the optical recording input method (handwriting input method) according to the present embodiment.

FIG. 21 illustrates an electric potential Vg of the scanning lines 76 which is input through the connection terminal 6, an electric potential Vs of the data lines 78 which is input through the connection terminal 8, an electric potential Vcom of the common electrode 37 which is input through the connection terminal 7, an electric potential Va of the pixel electrode 35A which belongs to the pixel 640A, and an electric potential Vb of the pixel electrode 35B which belongs to the pixel 640B.

In FIGS. 22 to 23, subscripts "A" and "B" of reference numerals (640A, 640B and the like) indicating the elements in the figure are used to clearly distinguish the two pixels 640A and 640B (640) which are description targets and components which belong to the two pixels 640A and 640B.

Firstly, in the second image erasure step S504, the high level electric potential at which the selection transistor 41 is in the turned on state is input to the entire scanning lines 76 of the second display section 505B from the controller 563 through the connection terminal 6. The low level electric potential VL (for example, −10V) for white-displaying the electrophoretic element 32 is input to the entire data lines 78 through the connection terminal 8. The ground electric potential GND (0V) is input to the common electrode 37 through the connection terminal 7. Accordingly, the entire surface of the second display section 505B is white-displayed, and becomes in an erasure state.

Next, in the second image recording step S505, as shown in FIG. 10B, the handwriting input by means of the light pen 250 is performed in the second display section 505B of the electrophoretic display device 100.

In the second image recording step S505, the low level electric potential at which the selection transistor 41 is in the turned off state is input to the scanning lines 76 from the controller 563 through the connection terminal 6. The high level electric potential VH (for example, 10V) is input to the data lines 78 through the connection terminal 8. The ground electric potential GND (0V) is input to the common electrode 37 (electric potential Vcom) through the connection terminal 7. Accordingly, the second display section 505B is in the image recordable state.

Figure 24B:
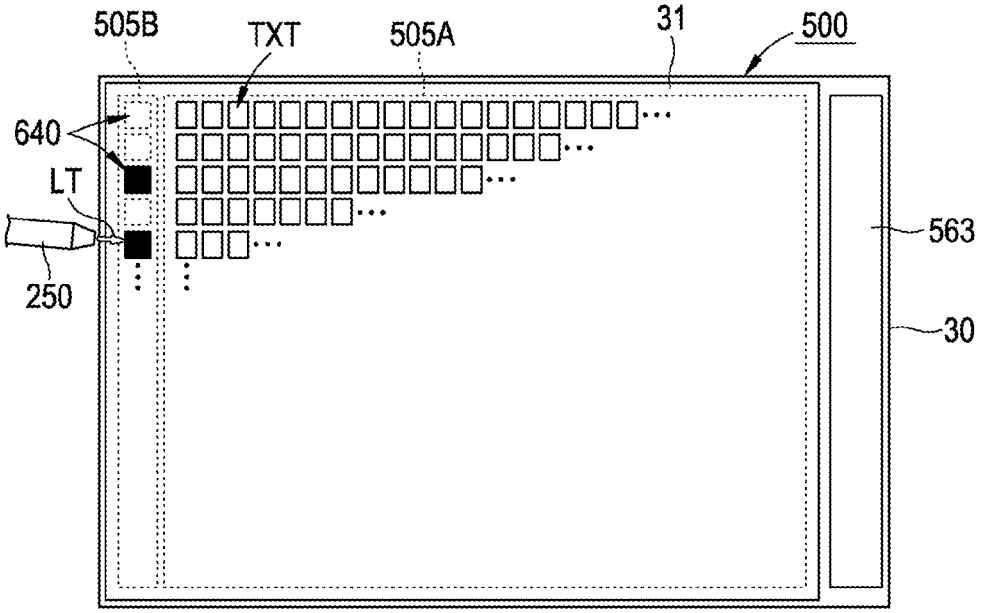
FIG. 24B is a diagram illustrating an operation of an electrophoretic display device according to the fourth embodiment.

As shown in FIG. 24B, if the light pen 250 moves close to the second display section 505B maintained in the above described voltage application state, the leak current is generated in the selection transistor 41 in the pixel 640 illuminated by the light LT emitted from the light pen 250, and the electric potential of the pixel electrode 35 is increased. As a result, the pixel 640 illuminated by the light is selectively changed into the black display, and a black mark is recorded in the second display section 505B.

Figure 23A:
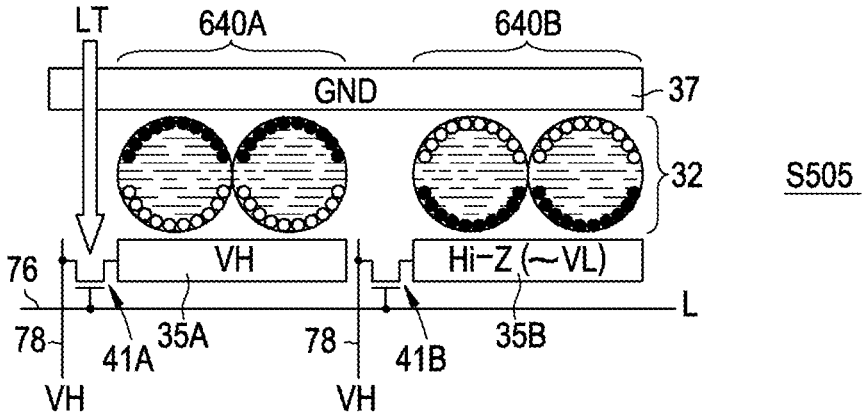
FIG. 23A is a diagram illustrating two pixels which are a description target of a driving method (optical recording) of the fourth embodiment.
Figure 23B:
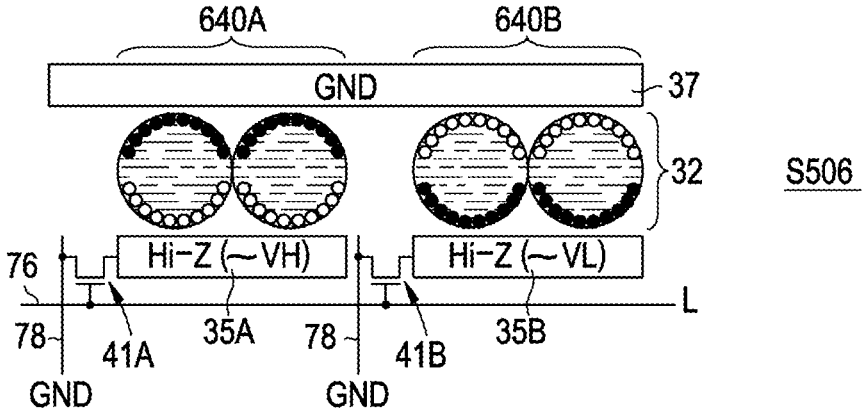
FIG. 23B is a diagram illustrating two pixels which are a description target of a driving method (optical recording) of the fourth embodiment.

Then, if the procedure goes to the second image maintenance step S506, as shown in FIG. 23B, the ground electric potential GND is input to the data lines 78 from the controller 563 through the connection terminal 8. The ground electric potential GND is input to the common electrode 37 through the connection terminal 7. As the data line 78 and the common electrode 37 have the same electric potential as described above, a false recording can be prevented from being generated when the light illuminates the pixels 640 of the second display section 505B. That is, in the second image maintenance step S506, even though the light leak is generated in the selection transistor 41 as the pixel 640 is illuminated by the light, since the electric potential of the pixel electrode 35 which belongs to the pixel 640 which is illuminated by the light becomes the ground electric potential GND, the electric potential difference is not generated with respect to the common electrode 37 which is maintained at the ground electric potential GND in a similar way, and thus, the display state of the electrophoretic element 32 is not changed.

In this way, the display state in the second display section 505B is prevented from being changed, and the recorded black mark is maintained.

As described above, according to the electrophoretic display device 500 of the fourth embodiment, through the display section 505 including the first display section 505A which is capable of an electronic display according to the image signal input and the second display section 505B which is capable of a display by means of the optical recording, the electronic display and the display by means of the optical recording are performed in the same display panel.

Since the first display section 505A and the second display section 505B can be independently operated, only the second display section 505B can be in the image recordable state while the display state of the first display section 505A is being maintained.

Specifically, the selection transistors 41 which belong to the first display section 505A are individually driven through the scanning line driving circuit 16 and the data line driving circuit 17, and thus, it is possible to easily and rapidly display a predetermined image on the first display section 505A. Further, as predetermined electric potentials are input to the scanning lines 76 which are connected with each other and the data lines 78 which are connected with each other, which belong to the second display section 505B, it is possible to easily and rapidly transit the entire second display section 505B to the same display state, and thus, the handwriting input can be performed.

Thus, for example, the electrophoretic display device 500 can be suitably used in such a manner that letter information of a horizontal writing is electronically displayed in the first display section 505A, and then a check mark or the like is added to a line head (second display section 505B) by the light pen 250 or the like. Accordingly, the electrophoretic display device which can easily perform an image display with a relatively simplified structure and can perform the handwriting input is obtained.

Further, since the first display section 505A and the second display section 505B are provided in the same panel, the selection transistors 41, the pixel electrodes 35, the scanning lines 66 and 76, the data lines 68 and 78, and so forth which are provided in the respective display sections 505A and 505B can be formed in the same manufacturing process.

In the electrophoretic display device 500 according to the fourth embodiment, a mechanism which is configured to determine whether the light pen 250 comes in contact with or close to the electrophoretic display device 500 may be provided. Accordingly, the recording can be performed by the light pen 250 as necessary, and also a false operation (unintended recording) due to the incidence of the outside light or the like can be prevented.

Further, the second display section 505B shown in FIG. 24A is not only a line head (left side in the figure) of the letter information TXT displayed in the first display section 505A, but also may be provided in a line end (right side in the figure). Further, the second display section 505B may be provided on one side part (upper side part) of a column direction (a direction orthogonal to the row direction) of the letter information TXT in the first display section 505A, or may be provided on the other side part (lower side part) thereof.

Figure 25:
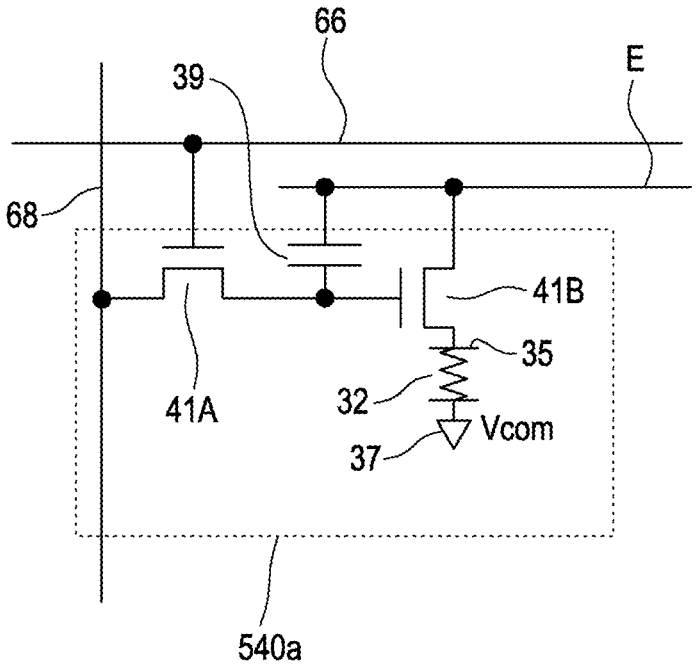
FIG. 25 is a diagram illustrating a modified example of a pixel circuit.

In the electrophoretic display device 500 according to the fourth embodiment, the pixel circuit of the pixel 540 in the first display section 505A is not limited the above described configuration. For example, the pixel 540*a* as shown in FIG. 25 can be employed. The pixel 540*a* shown in FIG. 25 includes the selection transistor 41A, the driving transistor 41B, the pixel electrode 35, the electrophoretic element 32, the common electrode 37 and the retentive capacitance 39. A gate of the driving transistor 41B is connected with a drain of the selection transistor 41A and one electrode of the retentive capacitance 39. A source of the driving transistor 41B is connected with an electric power line E, together with the other electrode of the retentive capacitance 39. The electric power line E is formed in the unit of a row in a similar way to the scanning line 66. A drain of the driving transistor 41B is connected to the pixel electrode 35.

In the display operation in the pixel 540*a* as shown in FIG. 25, the selection transistor 41A is in the turned on state on the basis of a control signal from the scanning line 66, and an electric potential of a data signal from the data line 68 is maintained in the retentive capacitance 39. The driving transistor 41B supplies a driving current to the electrophoretic element 32 from the electric power line E in accordance with the electric potential of the data signal maintained in the retentive capacitance 39. Even though the scanning line 66 is not selected, a predetermined current is continuously supplied to the electrophoretic element 32 by the retentive capacitance 39. If the selection transistor 41A is re-selected to set the voltage of the retentive capacitance 39 to 0 after a predetermined time elapses, the power supply is cut off with respect to the electrophoretic element 32. The grayscale display is performed according to the amount of the electric current flowed in the electrophoretic element 32 thus far.

In a case where the pixel 540*a* is used in the first display section 505A in this way, the scanning lines 66 are sequentially selected, the selection transistors 41A of the selected row are in the turned on state and the retentive capacitances 39 are charged by voltage applied to the data lines 68, and thus, charged particles of the electrophoretic element 32 can be moved to perform the electronic display in the first display section 505A.

Fifth Embodiment

Hereinafter, a fifth embodiment of the present invention will be described with reference to FIGS. 26, 27A and 27B.

Figure 26:
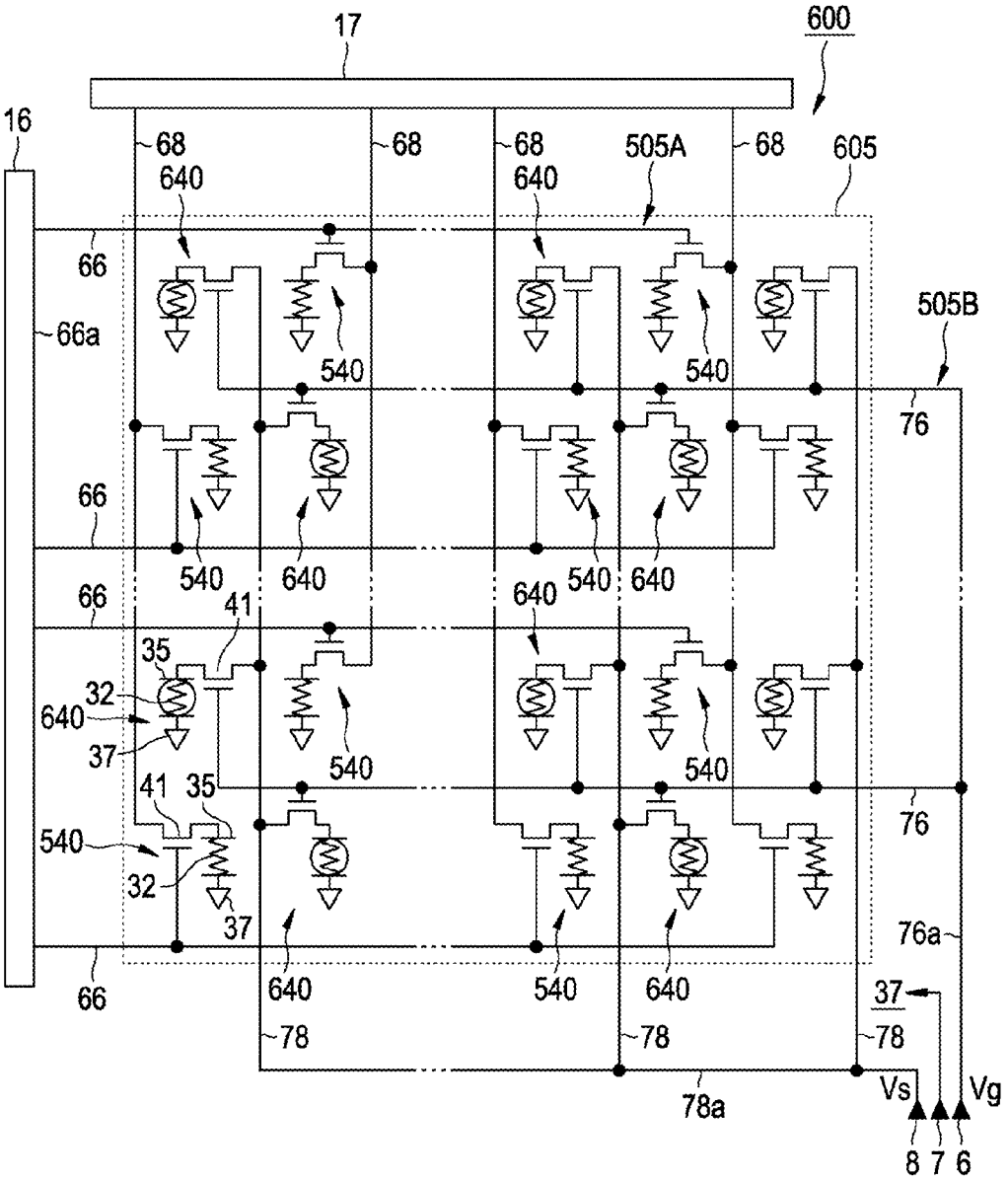
FIG. 26 is a diagram illustrating a circuit configuration of an electrophoretic display device according to a fifth embodiment of the present invention.
Figure 27A:
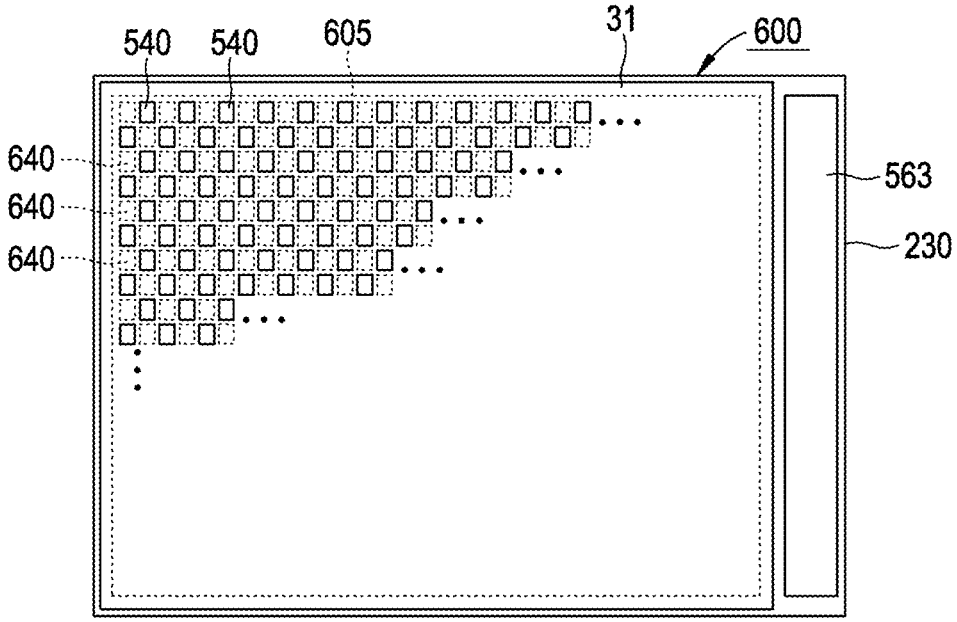
FIG. 27A is a plan view illustrating an electrophoretic display device of the fifth embodiment.
Figure 27B:
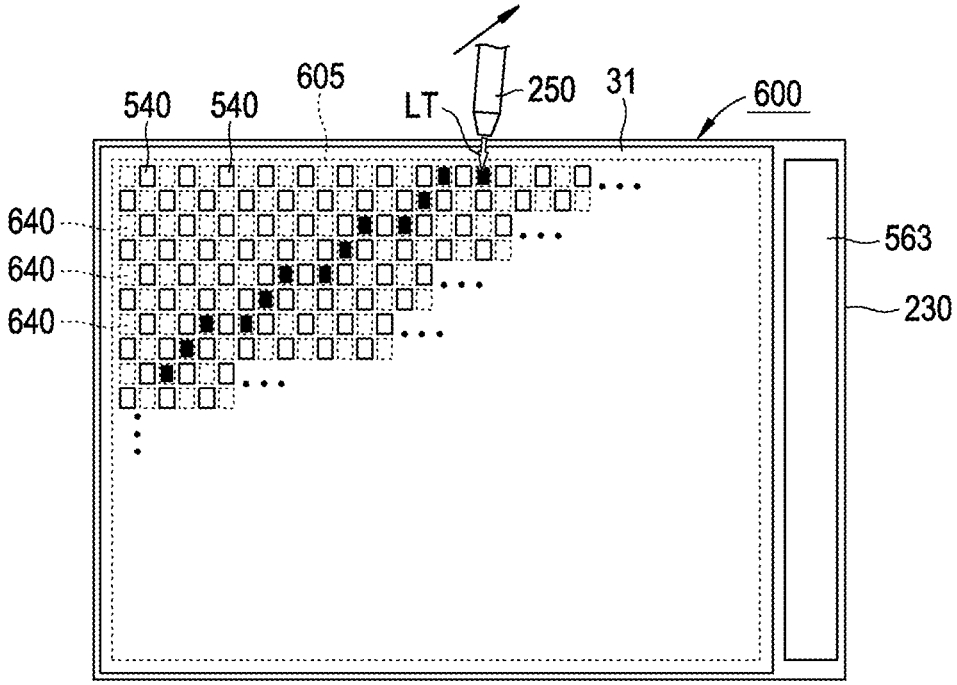
FIG. 27B is a diagram illustrating an operation of an electrophoretic display device of the fifth embodiment.

FIG. 26 is a diagram illustrating a circuit configuration of an electrophoretic display device according to the fifth embodiment of the invention; and FIGS. 27A and 27B are diagrams illustrating an operation of the electrophoretic display device according to the fifth embodiment.

In the following figures, the same reference numerals are used in the same elements as in the previous embodiments, and detailed description thereof will be omitted.

As shown in FIG. 26, an electrophoretic display device 600 according to the fifth embodiment is provided with a display section 605 in which a plurality of pixels 540 and a plurality of pixels 640 are alternately arranged.

The display section 605 is formed with a plurality of scanning lines 66 and a plurality of data lines 68. The pixel 540 is formed to correspond to an intersection of the scanning line 66 and the data line 68. The entire scanning lines 66 are connected with the scanning line driving circuit 16, and the entire data lines 68 are connected with the data line driving circuit 17. The pixel 540 is provided with the retentive capacitance 39, which is not shown in FIG. 26.

The display section 605 is formed with a plurality of scanning lines 76 and a plurality of data lines 78. The pixel 640 is formed to correspond to an intersection of the scanning line 76 and the data line 78. The entire scanning lines 76 are connected with the connection terminal 6 through the connection wiring 76*a*, the entire data lines 78 are connected with the connection terminal 8 through the connection wiring 78*a*.

Either of the pixel 540 and the pixel 640 includes the selection transistor 41, the pixel electrode 35, the electrophoretic element 32 and the common electrode 37.

In the display section 605 of the electrophoretic display device 600 according to the fifth embodiment, the pixels 540 and the pixels 640 are alternately arranged so as to be adjacent to each other in a row direction (an extension direction of the scanning lines 66 and 76) and in a column direction (an extension direction of the data lines 68 and 78). In other words, the display section 605 has a configuration in which the pixels 540 of the first display section 505A and the pixels 640 of the second display section 505B are mixed with each other and arranged in a checker board shape.

FIG. 27A is a plan view illustrating a schematic configuration of the electrophoretic display device 600.

The electrophoretic display device 600 is provided with the element substrate 230 and the opposite substrate 31. The display section 605 is provided in a region in which the element substrate 230 and the opposite substrate 31 are overlapped with each other from a planar view. In a region of the element substrate 230 which is extended outside the opposite substrate 31, a controller 563 (control section) is mounted. The controller 563 is connected with the connection terminals 6 to 8, the scanning line driving circuit 16 and the data line driving circuit 17 as shown in FIG. 12, through wirings (not shown).

The element substrate 230 has the same configuration as in the element substrate 30 according to the fourth embodiment, except the arrangement of the pixels 540 and the pixels 640. The controller 563 is configured to be able to supply predetermined electric potentials to the connection terminals 6 to 8, the scanning line driving circuit 16 and the data line driving circuit 17. The control 563 controls the plurality of pixels 540 which belongs to the display section 605 by the electric potential inputs through the connection terminals 6 and 8, and controls the plurality of pixels 640 by the electric potential inputs through the scanning line driving circuit 16 and the data line driving circuit 17.

Driving Method

Next, a driving method of the electrophoretic display device 600 according to the fifth embodiment will be described. The flowchart as shown in FIG. 20 in the fourth embodiment can be applied to the driving method of the electrophoretic display device 600 according to the present embodiment.

In the first image erasure step S501 to the first image maintenance step S503 in the electrophoretic display device 600 according to the fifth embodiment, a desired image recording is performed with respect to the arrangement of the plurality of pixels 540 of the display section 605.

Firstly, in the first image erasure step S501, an electric potential of a high level at which the selection electrode 41 is in the turned on state is input to the scanning line 66 from the controller 563 through the scanning line driving circuit 16. The low level electric potential VL is input to the data line 68 through the data line driving circuit 17. Accordingly, the entire pixels 540 of the display section 150 are white-displayed, and become in the erasure state.

Thereafter, in the first image signal input step S502, predetermined electric potentials are respectively input to the pixel electrode 35 and the common electrode 37 which belong to each pixel 540 of the display section 605, and thus, a driving voltage is applied to the electrophoretic element 32 (microcapsule 20). Specifically, a selection signal (high level of 40V) is input to the scanning line 66 for a predetermined period of time, and an image signal corresponding to image data is input to the data line 68. Accordingly, the selection transistor 41 is turned on through the scanning line 66, the image signal (image data) is input to each pixel 540 from the data line 68, and each pixel 540 stores the input image data. In this way, a predetermined image is recorded in the display section 605.

Next, if the procedure goes to the first image maintenance step S503, the ground electric potential GND is input to the data line 68 (electric potential Vs) from the controller 563 through the data line driving circuit 17, the ground electric potential GND is input to the common electrode 37 (electric potential Vcom) through a common electrode wiring (not shown). Accordingly, thereafter, the change in the display state of the pixel 540 is prevented, and the display image is maintained.

If the predetermined image is displayed on the display section 605 as described above, the procedure goes to the handwriting input mode by means of the light pen. In such a handwriting input mode, the pixel 540 maintains the electric potential state in the above described first image maintenance step S503, and the displayed image is not changed.

Then, in the second image erasure step S504, the high level electric potential at which the selection electrode 41 is in the turned on state is input to the scanning line 76 from the controller 563 through the connection terminal 6. The low level electric potential VL (for example, −10V) for white-displaying the electrophoretic element 32 is input to the data line 78 through the connection terminal 8. Further, the ground electric potential GND (0V) is input to the common electrode 37 through the connection terminal 7. Accordingly, the entire pixels 640 of the display section 605 are white-displayed, and become in the erasure state.

Next, in the second image recording step S505, as shown in FIG. 27B, the handwriting input by means of the light pen 250 is performed in a region (second display section 505B), which is formed of the pixels 640, of the display section 605 in the electrophoretic display device 600.

In the second image recording step S505, the low level electric potential at which the selection terminal 41 is in the turned off state is input to the scanning line 76 from the controller 563 through the connection terminal 6. The high level electric potential VH (for example, 10V) is input to the data line 78 through the connection terminal 8. The ground electric potential GND (0V) is input to the common electrode 37 (electric potential Vcom) through the connection terminal 7. Accordingly, each pixel 640 of the display section 150 is in the image recordable state.

If the display section 605 maintained in the voltage application state is scanned by the light pen 250 as shown in FIG. 27B, the leak current is generated in the selection electrode 41 in the pixel 640 which is illuminated by the light LT emitted from the light pen 250, and the electric potential of the pixel electrode 35 is increased. As a result, the pixel 640 which is illuminated by the light is selectively transited to the black display, and the image can be overwritten as shown in the figure.

Thereafter, the procedure goes to the second image maintenance step S506. The ground electric potential GND is input to the data line 78 from the controller 563 through the connection terminal 8, and the ground electric potential GND is input to the common electrode 37 through the connection terminal 7. Accordingly, the change in the display state is also prevented in the image which is formed of the pixels 640, and the recorded image is maintained.

As described above, according to the electrophoretic display device 600 according to the fifth embodiment, since the pixels 540 and the pixels 640 are mixed with each other and arranged in the checkerboard shape, a desired image can be displayed in the display section 605 through the pixels 540, and the handwriting input can be performed using the pixels 640. Thus, for example, the electrophoretic display device 600 can be appropriately used in such a manner that letter information or the like before correction is electronically displayed through the pixels 540, and check marks, line segments or the like are added thereto by means of the light pen 250.

Sixth Embodiment

Hereinafter, a sixth embodiment of the present invention will be described with reference to FIG. 28.

Figure 28:
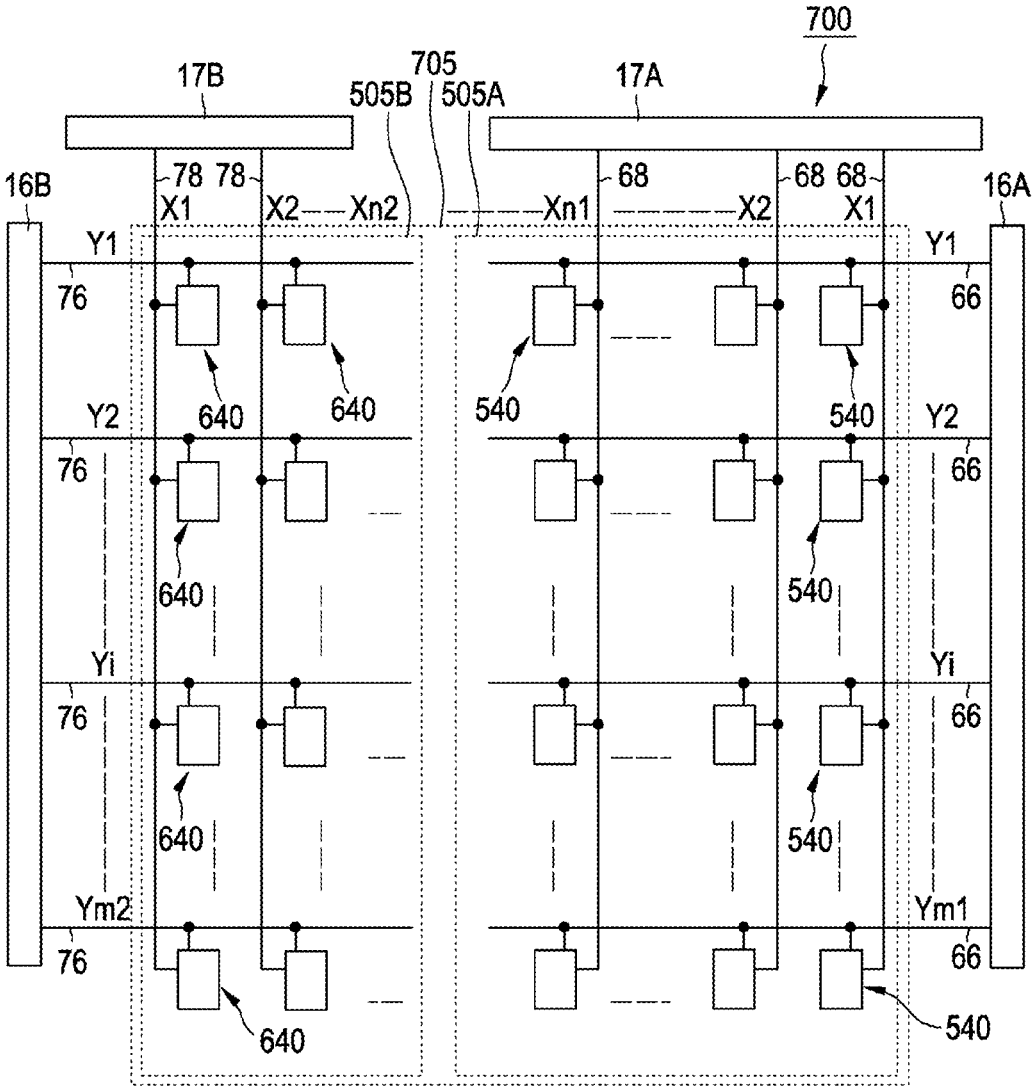
FIG. 28 is a diagram illustrating a circuit configuration of an electrophoretic display device of a sixth embodiment of the present invention.

FIG. 28 is a diagram illustrating a circuit configuration of an electrophoretic display device according to the sixth embodiment.

In the following figures, the same reference numerals are used in the same elements as in the previous embodiments, and detailed description thereof will be omitted.

The electrophoretic display device 600 according to the sixth embodiment is provided with a display section 705 including a first display section 505A which is capable of an electronic display and a second display section 505B which is capable of a display by means of the optical recording. A scanning line driving circuit 16A is connected with the scanning lines 66 extended from the first display section 505A, and a data line driving circuit 17A is connected with the data lines 68. A scanning line driving circuit 16B is connected with the scanning lines 76 extended from the second display section 505B, and a data line driving circuit 17B is connected with the data lines 78.

As the scanning line driving circuit 16B and the data line driving circuit 17B connected with the second display section 505B is provided in this way, and driving voltage waveforms can be individually applied to the respective scanning lines 76 and the respective data lines 78, the electronic display can be also performed in the second display section 505B.

In such a configuration, it is possible to drive the respective scanning lines 76 and the respective data lines 78 as a whole by means of the scanning line driving circuit 16B and the data line driving circuit 17B. Accordingly, the same optical recording sequence as in the fourth embodiment can be performed, and the display by means of the optical recording can be performed as necessary.

Seventh Embodiment

Hereinafter, a seventh embodiment of the present invention will be described with reference to FIG. 29.

Figure 29:
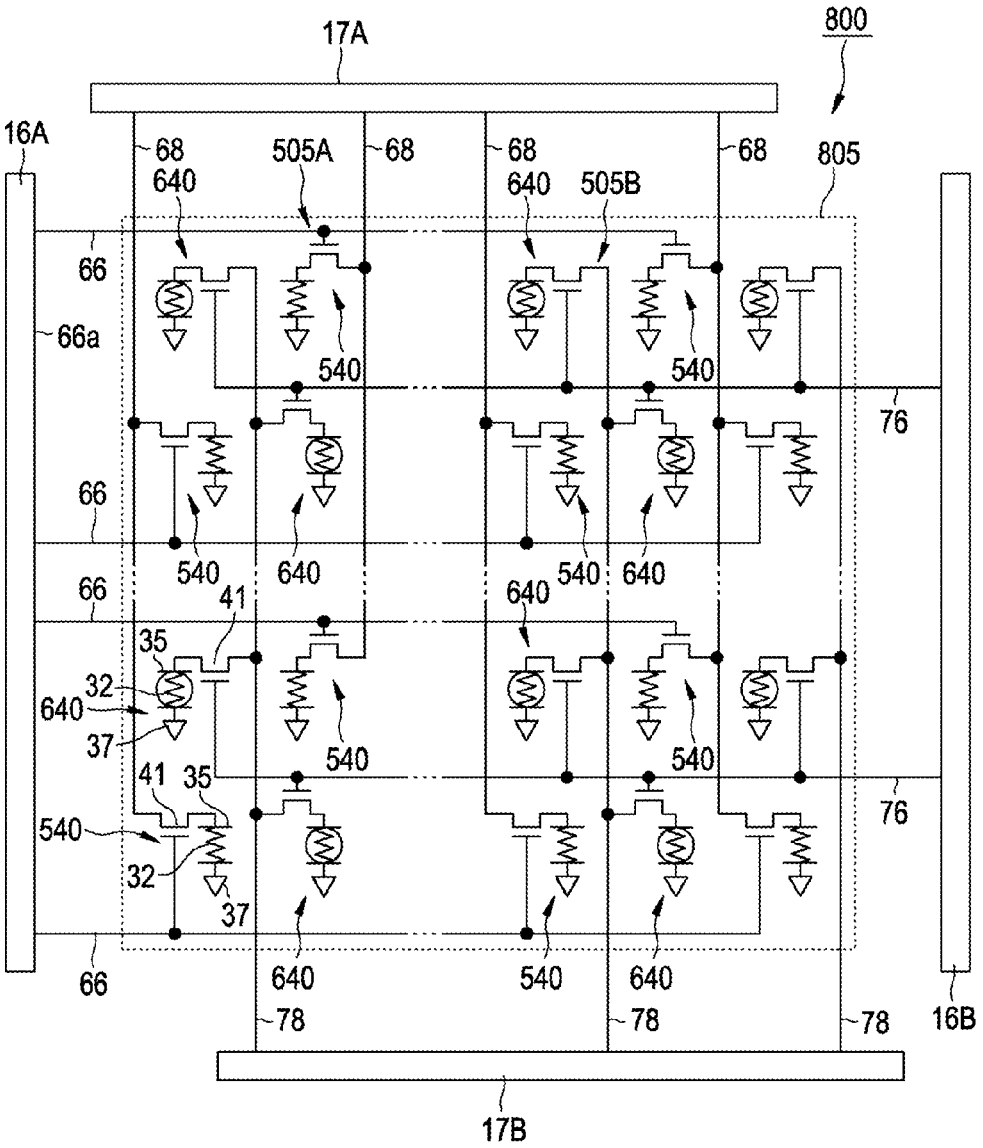
FIG. 29 is a diagram illustrating a circuit configuration of an electrophoretic display device of a seventh embodiment of the present invention.

FIG. 29 is a diagram illustrating a circuit configuration of an electrophoretic display device according to the seventh embodiment.

In the following figures, the same reference numerals are used in the same elements as in the previous embodiments and the modified embodiments thereof, and detailed description thereof will be omitted.

An electrophoretic display device 800 according to the seventh embodiment is provided with a display section 805 in which the plurality of pixels 540 and the plurality pixels 640 are arranged in a checker board shape. The display section 805 includes the first display section 505A having the pixels 640 arranged in a matrix shape from a planar view and the second display section 505B having the pixels 540 arranged in a matrix shape from a planar view. By means of the scanning line driving circuit 16A connected to the scanning lines 66 in the first display section 505A and the data line driving circuit 17A connected with the data lines 68, the display driving of the pixels 540 is performed. By means of the scanning line driving circuit 16B connected to the scanning lines 76 in the second display section 505B and the data line driving circuit 17B connected with the data lines 78, the display driving of the pixels 640 is performed.

In the seventh embodiment, each scanning line 66 and each data line 68 are driven by means of the scanning line driving circuit 16A and the data line driving circuit 17A connected with the first display section 505A, and thus, the same optical recording sequence as in the sixth embodiment can be performed in the first display section 505A. That is, the display by means of the optical recording can be also performed with respect to the pixels 540 in which the electronic display is performed.

Accordingly, according to the seventh embodiment, the pixels 540 and 640 of the display section 805 are driven by means of the scanning line driving circuits 16A and 16B and the data line driving circuits 17A and 17B, thereby making it possible to perform the electronic display according to the image signal input, and to perform the display according to the optical recording over the display section 805.

A technical scope of the embodiments of the present invention is not limited to the above described embodiments, and may be appropriately modified in a range without departing from the spirit of the present invention.

Figure 30:
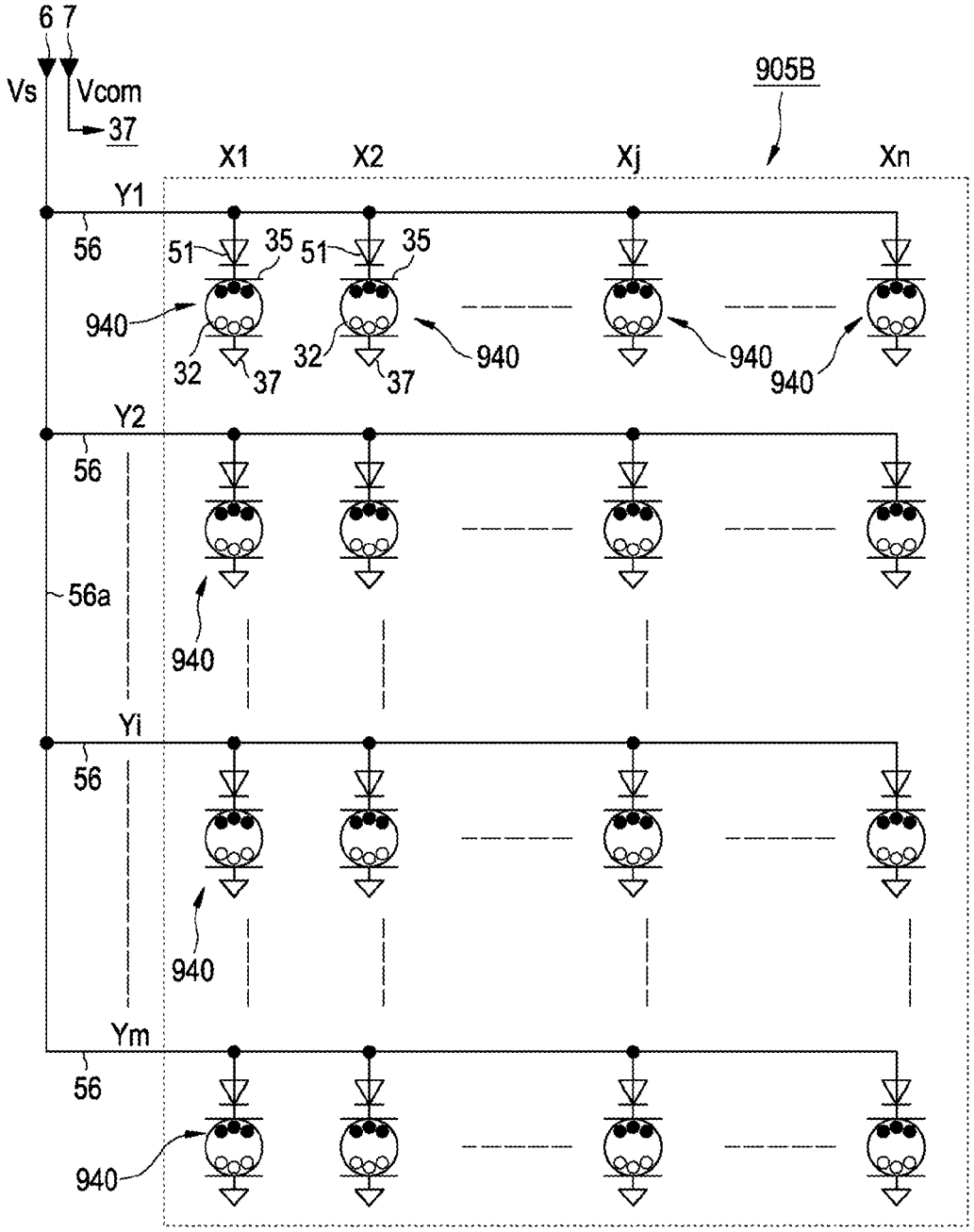
FIG. 30 is a diagram illustrating a circuit configuration of a second display section according to the seventh embodiment.

For example, the configuration of the display section 5 and the second display section 5B according to the first to the third embodiments, and of the second display section 505B capable of the display by means of the optical recording among the display section according to the fourth to the seventh embodiments, is not limited to the configuration using the transistor. For example, as shown in FIG. 30, a second display section 905B which uses a diode in place of a thin film transistor may be employed. A diode 51, the pixel electrode 35, the electrophoretic element 32 and the common electrode 37 are provided in pixels 940 of a second display section 905B shown in FIG. 30. An anode terminal (second terminal) of the diode 51 is connected with a signal line 56 and a cathode terminal (first terminal) thereof is connected with the pixel electrode 35. The signal line 56 of each row is connected with the connection terminal 6 through the connection wiring 56*a*.

Figure 31:
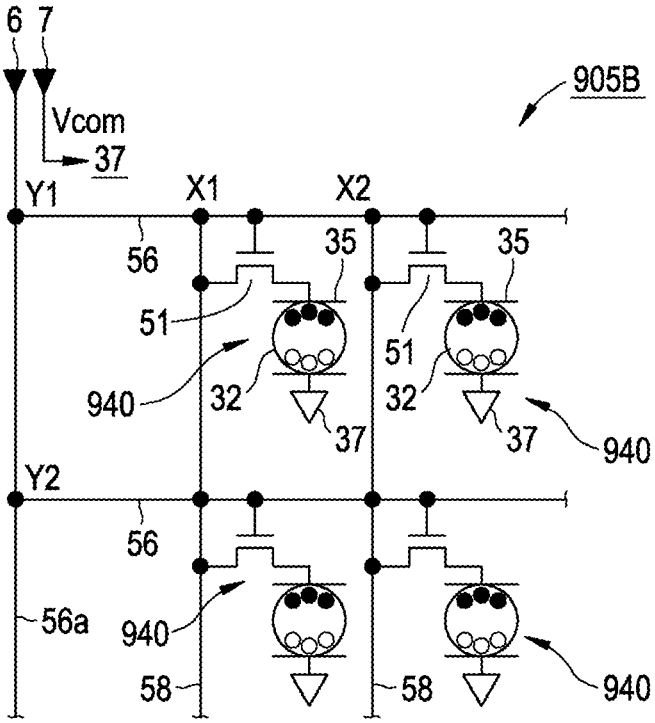
FIG. 31 is a diagram illustrating another circuit configuration of a second display section.

FIG. 31 is a diagram illustrating a configuration for employing as the diode 51*a* configuration in which a transistor is diode-connected (configuration in which a source terminal and a gate terminal are short-circuited to each other). A plurality of signal lines 58 which is extended in a direction of being intersected with the signal lines 56 is formed, the source terminal of the transistor for forming the diode 51 is connected with the signal line 58.

With a configuration such that the transistor of the diode connection is used, since the same electrode structure as in an active matrix liquid crystal device can be used, the structure can be simplified, manufacturability thereof can be enhanced, and a low cost can be achieved. Further, by only inputting a predetermined electric potential to the diode 51 through the signal lines 56, the entire display section 5 can be transited to the single grayscale, and thus, the reset operation can be easily and rapidly performed.

Further, various modifications may be performed. For example, the light LT illuminates the outside of the opposite substrate 31, but the light LT may illuminate the outside of the element substrate 30 or the element substrate 330. The light LT may illuminate the outsides of the opposite substrate 31 and the element substrate 30 (330).

The configuration of the selection transistor 41 is not particularly limited, but may include a transistor using an organic semiconductor layer, in addition to a configuration using amorphous silicon or polysilicon. If the selection transistor 41 is a TFT using the amorphous silicon or polysilicon, the sensitivity with respect to the light LT is increased, and energy for the optical recording is decreased. In the case of the TFT using the silicon, it is easy for the display section to be a large-sized screen. On the other hand, if the selection transistor 41 is a transistor using an organic semiconductor layer, the transistor may be formed at a low temperature, and may be formed of a transparent member having higher flexibility than glass.

The retentive capacitances connected with the electrophoretic elements 32 in parallel may be provided in the pixels 40, 340, 640 and 940.

In the above described embodiments and modified examples, the signal lines 56, the scanning lines 66, the data lines 68, the scanning lines 366, and the data lines 368 are respectively connected with each other through the connection wirings 56*a*, 66*a*, 68*a*, 366*a* and 368*a*, but the present invention is not limited to the configurations. For example, the scanning lines 66 may be connected with each other through any other electric circuit.

That is, there may be provided a signal line driving circuit which is connected with the signal lines 56 and has the function of enabling the entire signal lines 56 to be collectively in a selection state. Further, there may be provided a scanning line driving circuit which is connected with the scanning lines 66 and has the function of enabling the entire signal lines 66 to be collectively in a selection state. Furthermore, there may be provided a data line driving circuit which is connected with the data lines 68 and has the function of enabling the data lines 68 to be collectively in a selection state.

In the above described embodiments and the modified examples, the electrophoretic display device having the electrophoretic element 32 as the electro-optical material layer is described as an example, but the electro-optical material layer is not limited to the electrophoretic element. As long as the electro-optical material layer has a memory property, a known electro-optical material layer can be employed. For example, the electro-optical material layer made of cholesteric liquid crystal, PDLC, electro-chromic materials, twisting balls, toner or the like can be used.

Electronic Apparatus

Next, a case where the electrophoretic display device (the optical recording display device and the electro-optical device) according to the above embodiments is applied to electronic apparatuses will be described.

Figure 32:
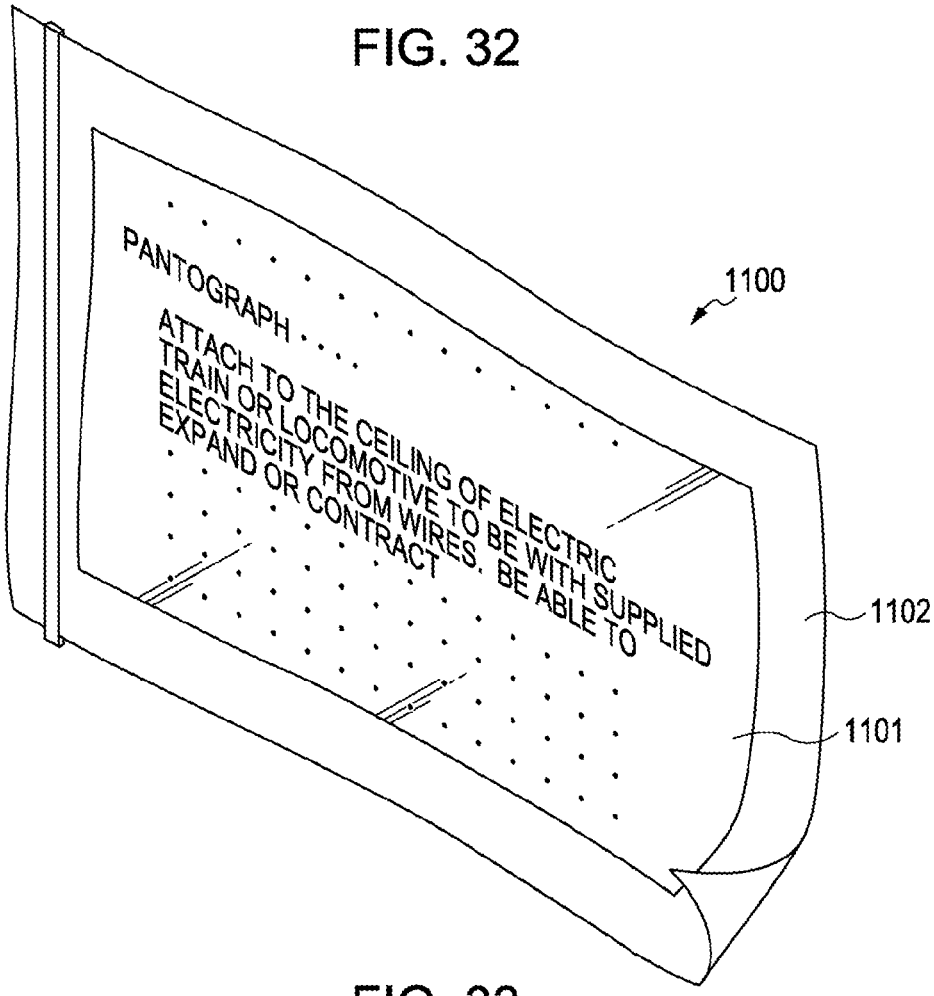
FIG. 32 is a diagram illustrating an example of an electronic apparatus.

FIG. 32 is a perspective view illustrating a configuration of an electronic paper 1100. The electronic paper 1100 includes the electrophoretic display device according to the embodiments in a display section 1101. The electronic paper 1100 has a flexible property and is formed of a main body 1102 made of a rewritable sheet having the same texture and flexibility as paper in the related art.

Figure 33:
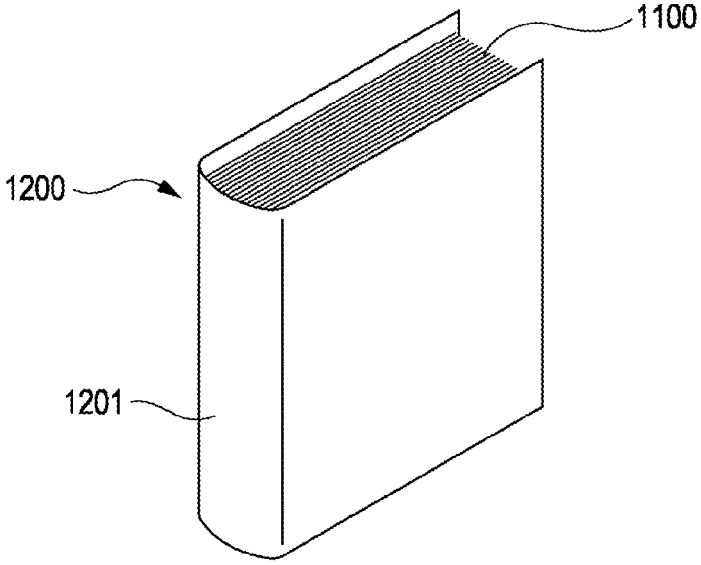
FIG. 33 is a diagram illustrating an example of an electronic apparatus.

FIG. 33 is a perspective view illustrating a configuration of an electronic note 1200. The electronic note 1200 has the plurality of pieces of electronic paper 1100 which is bundled and is covered with a cover 1201. The cover 1201 includes a display data input means (not shown) for receiving display data transmitted from an external apparatus, for example. Thus, according to the display data, in a state where the electronic paper is bundled, a displayed content can be changed or updated.

According to the electronic paper 1100 and the electronic note 1200 as described above, since the electrophoretic display device according to the above embodiments is employed, there is provided an electronic apparatus including the optical recording display means which is configured to be easily resettable with a simplified configuration.

The above described electronic apparatuses are examples of electronic apparatuses according to the embodiments of the present invention, and do not limit the technical scope of the present invention. For example, the electrophoretic display device (optical recording display device) according to the embodiments of the present invention can be suitably applied to a display section of electronic apparatuses such as a mobile phone or mobile audio device.

The present invention is not limited to the above described embodiments or the modified examples. That is, a variety of additions, omissions, substitutions or other modifications may fall within a range without departing from the spirit of the present invention. The present invention is not limited by the above description, but is limited by the appended claims.

The entire disclosure of Japanese Patent Application Nos: 2009-153818, filed Jun. 29, 2009 and 2009-259846, filed Nov. 13, 2009 are expressly incorporated by reference herein.

What is claimed is:

1. An optical recording display device having a display section, the display section comprising:

a plurality of pixels;

a plurality of pixel electrodes each of which is formed for each of the plurality of pixels, and is connected to a transistor;

a common electrode which is opposite to the plurality of pixel electrodes;

an electro-optical material layer having a memory property which is disposed between the plurality of pixel electrodes and the common electrode;

a plurality of scanning lines which is respectively connected to a gate of the transistor, each of the plurality of scanning lines being directly connected to a first connection wiring such that a voltage applied to the first connection wiring is simultaneously applied to each of the plurality of scanning lines;

a plurality of data lines which is respectively connected to a source of the transistor, each of the plurality of data lines being directly connected to a second connection wiring such that a voltage applied to the second connection wiring is simultaneously applied to each of the plurality of data lines; and a controller configured to perform:

a first operation for inputting a first gate electric potential at which the transistor is in a turned on state to the scanning lines and for inputting a first data electric potential to the data lines, and a second operation for inputting a second gate electric potential at which the transistor is in a turned off state to the scanning lines and for inputting a second data electric potential to the data lines which belong to the display section, wherein the second data electric potential is lower than an electric potential of the common electrode in a case where the first data electric potential is higher than the electric potential of the common electrode, and is higher than the electric potential of the common electrode in a case where the first data electric potential is lower than the electric potential of the common electrode, and a display image is recorded in the display section by generating a leak current in the transistor when the pixel associated with the transistor is illuminated with light.

2. The optical recording display device according to claim 1, wherein the optical recording display device includes a plurality of display sections.

3. The optical recording display device according to claim 2, wherein the optical recording display device includes a first region and a second region which are sectioned in a planar surface, and wherein the plurality of pixels which belongs to a first display section of the display section is arranged in the first region, and the plurality of pixels which belongs to a second display section of the display section which is different from the first display section is arranged in the second region.

4. The optical recording display device according to claim 2, wherein the pixels which belong to a first display section among the plurality of display sections and the pixels which belong to a second display section which is different from the first display section are alternately arranged along an extension direction of the scanning lines or the data lines.

5. The optical recording display device according to claim 1, wherein the controller erases a display image of the display section by means of the first operation, and maintains the display section in a recordable state of being recordable by light input by means of the second operation.

6. The optical recording display device according to claim 1, wherein the controller performs a third operation for inputting a third data electric potential which is approximately the same as the electric potential of the common electrode to the data lines which belong to the display section, after the first operation or the second operation.

7. The optical recording display device according to claim 6, wherein the controller maintains the display section in a state of being protected from rewriting by light input by the third operation.

8. The optical recording display device according to claim 1, wherein the first gate electric potential at which the transistor is in the turned on state is input to the scanning lines, and the first data electric potential is input to the data lines, in a period of time in which an image of the display section is erased, and wherein the second data electric potential is input to the data lines, in a period of time in which the display section is maintained in a recordable state.

9. The optical recording display device according to claim 8, wherein a third data electric potential which is approximately the same as the electric potential of the common electrode is input to the data lines, in a period of time in which the display section is maintained in a rewriting protection state.

10. A driving method of an optical recording display device having a display section which includes: a plurality of pixels; a plurality of pixel electrodes each of which is formed for each of the plurality of pixels, and is connected to a transistor; a common electrode which is opposite to the plurality of pixel electrodes; an electro-optical material layer having a memory property which is disposed between the plurality of pixel electrodes and the common electrode; a plurality of scanning lines which is respectively connected to a gate of the transistor, each of the plurality of scanning lines being directly connected to a first connection wiring such that a voltage applied to the first connection wiring is simultaneously applied to each of the plurality of scanning lines; and a plurality of data lines which is respectively connected to a source of the transistor, each of the plurality of data lines being directly connected to a second connection wiring such that a voltage applied to the second connection wiring is simultaneously applied to each of the plurality of data lines, the method comprising:

erasing an image by inputting a first gate electric potential, at which the transistor is in a turned on state, to the scanning lines via the first connection wiring, and inputting a first data electric potential to the data lines via the second connection wiring; and recording an image by inputting a second gate electric potential, at which the transistor is in a turned off state, to the scanning lines via the first connection wiring, inputting a second data electric potential, which is lower than an electric potential of the common electrode in a case where the first data electric potential is higher than the electric potential of the common electrode and is higher than the electric potential of the common electrode in a case where the first data electric potential is lower than the electric potential of the common electrode, to the data lines via the second connection wiring, and generating a leak current in the transistor by illuminating the pixel associated with the transistor with light.

11. The method according to claim 10, further comprising maintaining an image by inputting a third data electric potential, which is approximately the same as the electric potential of the common electrode, to the data lines which belong to the display section via the second connection wiring.

12. The method according to claim 10, wherein the optical recording display device includes a first display section and a second display section which is different from the first display section, as the display section, and wherein the second data electric potential is input to the data lines which belong to the second display section, and a third data electric potential which is approximately the same as the electric potential of the common electrode is input to the data lines which belong to the first display section, in the image recording.

13. An electro-optical device comprising a plurality of pixels;

a plurality of pixel electrodes, each of which is formed for each of the plurality of pixels and is connected to a transistor; and an electro-optical material layer having a memory property between a pair of substrates;

wherein a first display section including the electro-optical material layer and which is capable of rewriting an image display by means of an image signal input and a second display section including the electro-optical material layer are formed on the same substrates, and wherein the first display section is protected from rewriting by light input, and the second display section is capable of rewriting an image display by generating a leak current in the transistor associated with a pixel of the plurality of pixels when light is input to the pixel while the transistor is in a turned off state and a data electric potential is applied to a source of the transistor, the data electric potential being different from an electrical potential of a common electrode opposite the pixel electrode.

14. The electro-optical device according to claim 13, wherein a plurality of first pixels is arranged in the first display section, in each of the first pixels are formed a pixel electrode and a transistor having a drain which is connected to the pixel electrode, the plurality of first pixels is divided into a plurality of first sets, in each first set is formed a plurality of scanning lines which is respectively connected to a gate of the transistor, is connected to each other, and is connected to a scanning line driving circuit, the plurality of first pixels is divided into a plurality of second sets, in each second set is formed a plurality of data lines which is respectively connected to a source of the transistor, is connected to each other, and is connected to a data line driving circuit, a plurality of second pixels is arranged in the second display section, in each of the second pixels are formed a pixel electrode and a transistor having a drain which is connected to the pixel electrode, and in each of the second pixels are further formed scanning lines which are respectively connected to a gate of the transistor and are connected to each other and data lines which are respectively connected to a source of the transistor and are connected to each other.

15. The electro-optical device according to claim 13, wherein a plurality of first pixels is arranged in the first display section, in each of the first pixels are formed a pixel electrode and a transistor having a drain which is connected to the pixel electrode, the plurality of first pixels is divided into a plurality of first sets, in each first set is formed a plurality of scanning lines which is respectively connected to a gate of the transistor, is connected to each other, and is connected to a scanning line driving circuit, the plurality of first pixels is divided into a plurality of second sets, in each second set is formed a plurality of data lines which is respectively connected to a source of the transistor, is connected to each other, and is connected to a data line driving circuit, a plurality of second pixels is arranged in the second display section, in each of the second pixels are formed a pixel electrode and a transistor having a drain which is connected to the pixel electrode, the plurality of second pixels is divided into a plurality of third sets, in each third set is formed a plurality of scanning lines which is respectively connected to a gate of the transistor, is connected to each other, and is connected to a scanning line driving circuit, the plurality of second pixels is divided into a plurality of fourth sets, and in each fourth set is formed a plurality of data lines of which each is connected to a source of the transistor, is connected to each other, and is connected to a data line driving circuit.

16. The electro-optical device according to claim 13, wherein a plurality of first pixels is arranged in the first display section, in each of the first pixels are formed a pixel electrode and a transistor having a drain which is connected to the pixel electrode, the plurality of first pixels is divided into a plurality of first sets, in each first set is formed a plurality of scanning lines which is respectively connected to a gate of the transistor, is connected to each other, and is connected to a scanning line driving circuit, the plurality of first pixels is divided into a plurality of second sets, in each second set is formed a plurality of data lines which is respectively connected to a source of the transistor, is connected to each other, and is connected to a data line driving circuit, a plurality of second pixels is arranged in the second display section, in each of the second pixels are formed a pixel electrode, a diode which is connected to the pixel electrode through a first terminal thereof, and singal lines which are respectively connected to a second terminal of the diode and are connected to each other.

17. The electro-optical device according to claim 13, wherein the electro-optical device includes a first region and a second region which are sectioned in a planar surface, and wherein the plurality of first pixels which belongs to the first display section is arranged in the first region, and the plurality of second pixels which belongs to the second display section is arranged in the second region.

18. The electro-optical device according to claim 13, wherein the first pixels which belong to the first display section and the second pixels which belong to the second display section are alternately arranged along an extension direction of the scanning lines or the data lines.

19. An electronic apparatus comprising the optical recording display device according to claim 1.

20. An electronic apparatus comprising the electro-optical device according to claim 13.

* * * * *